US010062490B2

(12) United States Patent
Horikawa et al.

(10) Patent No.: US 10,062,490 B2
(45) Date of Patent: Aug. 28, 2018

(54) METHOD OF MANUFACTURING AN INDUCTOR

(71) Applicants: SHINKO ELECTRIC INDUSTRIES CO., LTD., Nagano (JP); TOKYO COIL ENGINEERING CO., LTD., Tokyo (JP)

(72) Inventors: Yasuyoshi Horikawa, Nagano (JP); Tsukasa Nakanishi, Nagano (JP); Kazuyuki Okita, Tokyo (JP); Yukihiro Miyasaka, Tokyo (JP)

(73) Assignees: SHINKO ELECTRIC INDUSTRIES CO., LTD., Nagano (JP); TOKYO COIL ENGINEERING CO., LTD., Tokyo (JP)

( * ) Notice: Subject to any disclaimer, the term of this patent is extended or adjusted under 35 U.S.C. 154(b) by 86 days.

(21) Appl. No.: 15/150,532

(22) Filed: May 10, 2016

(65) Prior Publication Data

US 2016/0343489 A1 Nov. 24, 2016

(30) Foreign Application Priority Data

May 19, 2015 (JP) ..... 2015-101992

(51) Int. Cl.
*H01F 7/06* (2006.01)
*H01F 17/00* (2006.01)
(Continued)

(52) U.S. Cl.
CPC ..... *H01F 17/0013* (2013.01); *H01F 17/04* (2013.01); *H01F 27/292* (2013.01); *H01F 41/046* (2013.01); *H01F 2017/048* (2013.01)

(58) Field of Classification Search
CPC .... H01F 17/0013; H01F 17/04; H01F 27/292; H01F 41/04; H01F 5/00; H01F 3/08
See application file for complete search history.

(56) References Cited

U.S. PATENT DOCUMENTS 7,477,127 B2 * 1/2009 Kamijima ..... H01F 17/0013 336/206
8,004,383 B2 8/2011 Konoue et al.
(Continued)

FOREIGN PATENT DOCUMENTS

JP 2013-118394 6/2013
JP 2013-135220 7/2013
JP 2015-026812 2/2015

*Primary Examiner* — Paul D Kim
(74) *Attorney, Agent, or Firm* — IPUSA, PLLC

(57) ABSTRACT

An inductor includes a coil substrate, an encapsulation material containing a magnetic material and selectively covering the coil substrate, and first and second external electrodes formed on the exterior of the encapsulation material. The coil substrate includes a laminate of stacked structures each including a conductive track and first and second connection parts on opposite sides of the conductive track in a single wiring layer. The conductive tracks are connected in series to form a helical coil. The first connection parts are connected by a first via to form a first electrode terminal connected to a first end of the helical coil. The second connection parts are connected by a second via to form a second electrode terminal connected to a second end of the helical coil. The first and second external electrodes are connected to the first and second electrode terminals, respectively.

4 Claims, 28 Drawing Sheets

(51) Int. Cl.

| | |
|---|---|
| ***H01F 17/04*** | (2006.01) |
| ***H01F 27/29*** | (2006.01) |
| ***H01F 41/04*** | (2006.01) |

(56) References Cited

U.S. PATENT DOCUMENTS

| | | | | |
|---|---|---|---|---|
| 8,618,902 | B2 * | 12/2013 | Nogi | H01F 17/0013 336/192 |
| 9,183,979 | B2 | 11/2015 | Cha et al. | |
| 2005/0003199 | A1 * | 1/2005 | Takaya | B32B 15/08 428/413 |
| 2005/0164520 | A1 * | 7/2005 | Muranaka | H01L 21/312 438/778 |
| 2015/0028983 | A1 | 1/2015 | Ryu et al. | |

* cited by examiner

METHOD OF MANUFACTURING AN INDUCTOR

CROSS-REFERENCE TO RELATED APPLICATION

This application is based upon and claims the benefit of priority of the prior Japanese Patent Application No. 2015-101992, filed on May 19, 2015, the entire contents of which are incorporated herein by reference.

FIELD

A certain aspect of the embodiment discussed herein is related to inductors and methods of manufacturing an inductor.

BACKGROUND

Recently, reduction in the size of electronic apparatuses such as game machines and smartphones has accelerated, so that there has also been a demand for reduction in the size of devices, such as inductors, to be provided in such electronic apparatuses. Inductors to be provided in such electronic apparatuses may be mounted on a board by connecting each end of the internal coil part to an external electrode. (See, for example, Japanese Patent No. 5454712, Japanese Laid-open Patent Publication No. 2013-135220, and Japanese Laid-open Patent Publication No. 2015-26812.)

SUMMARY

According to an aspect of the invention, an inductor includes a coil substrate, an encapsulation material containing a magnetic material and selectively covering the coil substrate, and first and second external electrodes formed on the exterior of the encapsulation material. The coil substrate includes a laminate of stacked structures each including a conductive track and first and second connection parts on opposite sides of the conductive track in a single wiring layer. The conductive tracks are connected in series to form a helical coil. The first connection parts are connected by a first via to form a first electrode terminal connected to a first end of the helical coil. The second connection parts are connected by a second via to form a second electrode terminal connected to a second end of the helical coil. The first and second external electrodes are connected to the first and second electrode terminals, respectively.

The object and advantages of the invention will be realized and attained by means of the elements and combinations particularly pointed out in the claims.

It is to be understood that both the foregoing general description and the following detailed description are exemplary and explanatory and not restrictive of the invention, as claimed.

DESCRIPTION OF EMBODIMENTS

Figure 1A:
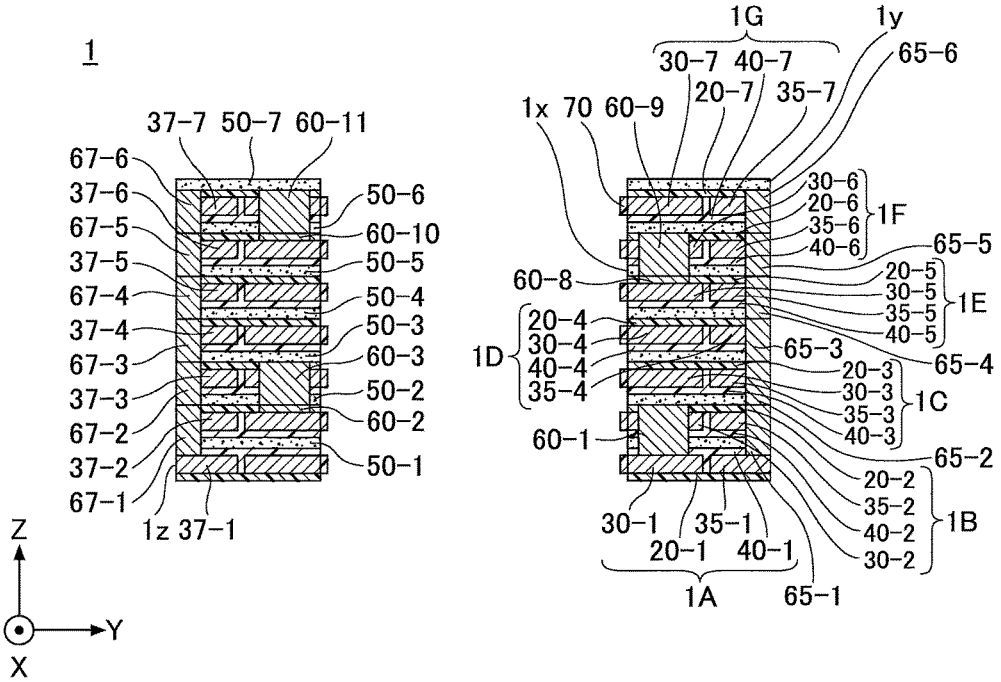
FIGS. 1A through 1C are diagrams depicting a coil substrate according to an embodiment.

As described above, there are inductors that are mounted on a board by connecting each end of the internal coil part to an external electrode. According to such inductors, however, the contact area of each end of the internal coil part and an external electrode is limited, so that there is the problem of high parasitic resistance of the coil part.

According to an aspect of the present invention, it is possible to provide an inductor in which parasitic resistance of the coil part is reduced.

One or more preferred embodiments of the present invention will be explained with reference to accompanying drawings. In the specification and the drawings, the same elements are referred to using the same reference numeral, and a repetitive description thereof may be omitted. In the drawings, the arrows X, Y, and Z indicate the width direction, the length direction, and the height (thickness) direction, respectively, of a depicted structure, which may be described as the X direction, the Y direction, and the Z direction, respectively, in the following description.

Figure 1B:
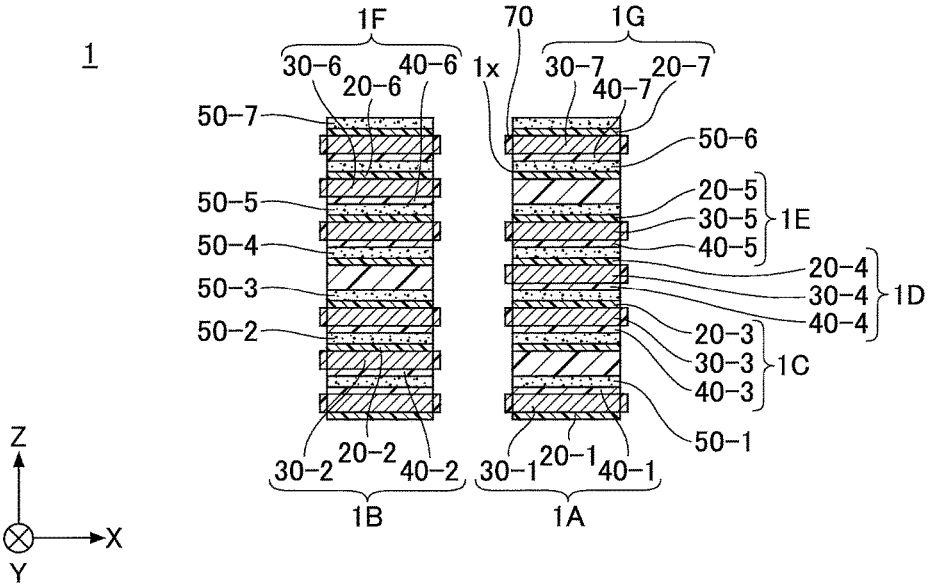
Figure 1C:
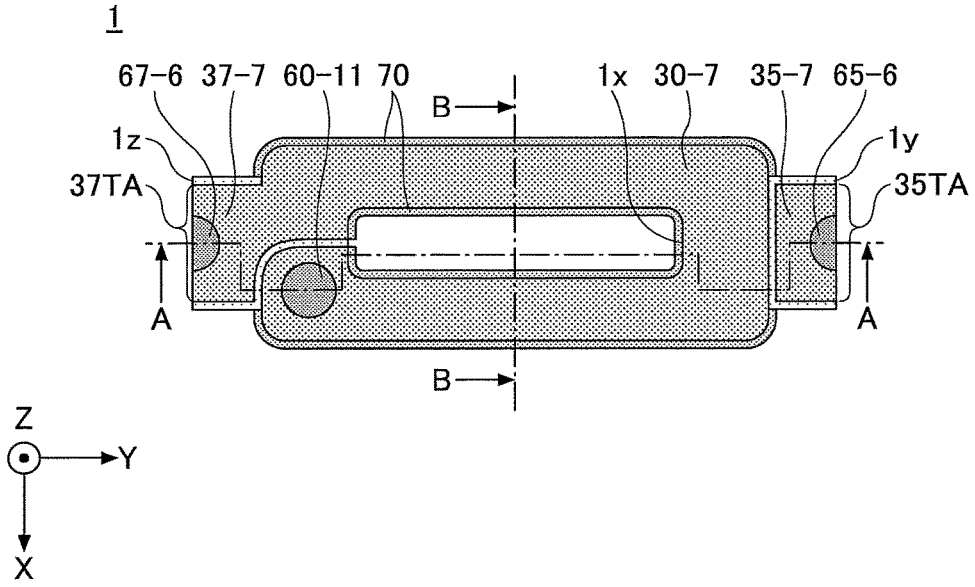
Figure 2:
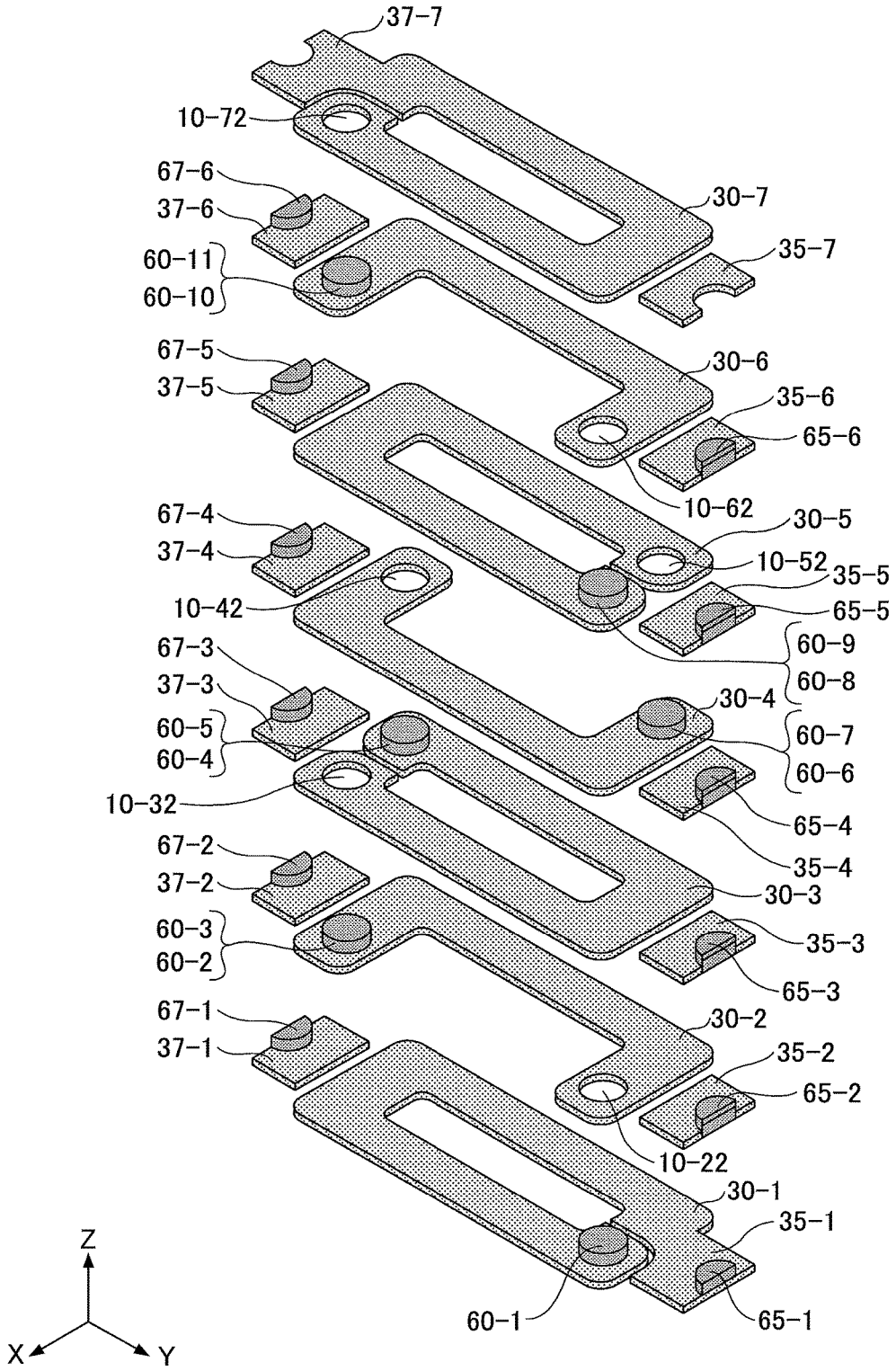
FIG. 2 is an exploded perspective view of the coil substrate, schematically depicting the shape of a conductive track of each of the constituent structures of the coil substrate according to the embodiment.

First, the structure of a coil substrate according to an embodiment is described. FIGS. 1A through 10 are diagrams depicting a coil substrate according to the embodiment. FIG. 1C is a plan view of the coil substrate. FIG. 1A is a cross-sectional view of the coil substrate taken along a line A-A in FIG. 1C. FIG. 1B is a cross-sectional view of the coil substrate taken along a line B-B in FIG. 1C. FIG. 2 is an exploded perspective view of the coil substrate, schematically depicting the shape of the conductive track of each of the constituent structures of the coil substrate.

Referring to FIGS. 1A through 1C and FIG. 2, a coil substrate 1 includes a first structure 1A, a second structure 1B, a third structure 1C, a fourth structure 1D, a fifth structure 1E, a sixth structure 1F, a seventh structure 1G, adhesive layers 50-1 through 50-7, and an insulating film 70. In FIG. 1C, a depiction of an insulating layer 20-7 and the adhesive layer 50-7 is omitted. Furthermore, in FIG. 1C, part of the coil substrate 1 is indicated by a dotted pattern.

In the following description, figures for describing a manufacturing process are referred to as needed. Furthermore, in FIGS. 1A through 1C, reference numerals for openings are omitted, and figures for describing a manufacturing process are referred to for the reference numerals of openings as needed.

According to this embodiment, for the sake of convenience, the adhesive layer 50-7 side of the coil substrate 1 will be referred to as "upper side" or "first side," and the insulating layer 20-1 side of the coil substrate 1 will be referred to as "lower side" or "second side." Furthermore, with respect to each part or element of the coil substrate 1, a surface on the adhesive layer 50-7 side will be referred to as "upper surface" or "first surface," and a surface on the insulating layer 20-1 side will be referred to as "lower surface" or "second surface." The coil substrate 1, however, may be used in an upside-down position or oriented at any angle. Furthermore, a plan view refers to a view of an object taken in a direction normal to the first surface of the insulating layer 20-1, and a planar shape refers to the shape of an object viewed in a direction normal to the first surface of the insulating layer 20-1.

For example, the planar shape of the coil substrate 1 may be sized so that an inductor 100 (see FIGS. 3A and 3B) manufactured using the coil substrate 1 has a substantially rectangular planar shape of, for example, 1.6 mm by 0.8 mm or 2.0 mm by 1.6 mm, or a planar shape of approximately 3.0 mm square. The thickness of the coil substrate 1 may be, for example, approximately 0.5 mm.

The planar shape (contour) of the coil substrate 1 is not a simple rectangle but a shape close to the contour of conductive tracks (such as a seventh conductive track 30-7) of the coil substrate 1. This allows the provision of more encapsulation material 110 around the coil substrate 1 in manufacturing the inductor 100 using the coil substrate 1. Furthermore, a through hole 1*x* is formed in the substantial center of the coil substrate 1. This also is for providing more encapsulation material 110 around the coil substrate 1 in manufacturing the inductor 100 using the coil substrate 1. It is possible to increase the inductance of the inductor 100 by using, for example, an encapsulation material containing magnetic metal powder or a filler of a magnetic material, such as a ferrite, as the encapsulation material 110 and encapsulating a larger area around the coil substrate 1 including an area inside the through hole 1*x*. The magnetic metal power may be composed of, for example, iron (Fe) or an alloy composed of iron (Fe) as a main constituent and one or more of silicon (Si), chromium (Cr), Nickel (Ni), and cobalt (Co).

The first structure 1A includes the insulating layer 20-1 and a first wiring layer (an outermost wiring layer on the second side) formed on the insulating layer 20-1. The first wiring layer includes a first conductive track 30-1, a connection part 35-1, and a connection part 37-1. The first structure 1A further includes an insulating layer 40-1 formed on the insulating layer 20-1 to cover the first conductive track 30-1, the connection part 35-1, and the connection part 37-1.

The insulating layer 20-1 is the outermost layer (lowermost layer in FIGS. 1A and 1B) of the coil substrate 1. Suitable materials for the insulating layer 20-1 include, for example, an epoxy insulating resin. The thickness of the insulating layer 20-1 may be, for example, approximately 8 μm to approximately 12 μm.

The connection part 35-1 and the connection part 37-1 are on opposite sides of the first conductive track 30-1 in the Y direction within the same layer as the first conductive track 30-1 on the insulating layer 20-1. The connection part 35-1 is electrically connected to the first conductive track 30-1. The connection part 37-1 is not connected to the first conductive track 30-1.

Suitable materials for the first conductive track 30-1, the connection part 35-1, and the connection part 37-1 include, for example, copper (Cu) and copper alloys. The thickness of the first conductive track 30-1, the connection part 35-1, and the connection part 37-1 may be, for example, approximately 12 μm to approximately 50 μm. The width of the first conductive track 30-1, the connection part 35-1, and the connection part 37-1 may be, for example, approximately 50 μm to approximately 130 μm. In order to reduce resistance, the thickness is preferably approximately 20 μm to approximately 50 μm, and the width is preferably approximately 100 μm to approximately 130 μm.

The first conductive track 30-1 is a first-layer conductive track (approximately one turn) forming part of a coil. The first conductive track 30-1 is patterned into a substantially elliptical shape in the direction indicated in FIG. 2. The cross section of the first conductive track 30-1 taken along the X direction may be substantially rectangular. A direction along the spiral of the coil substrate (the length or Y direction) in a plan view may be referred to a longitudinal direction, and a direction perpendicular to the longitudinal direction (the width or X direction) may be referred to as a transverse direction.

The connection part 35-1 extends from the first conductive track 30-1. The connection part 35-1 is monolithically formed with the first conductive track 30-1 at a first lengthwise end of the first conductive track 30-1. A side surface of the connection part 35-1, facing away from the first conductive track 30-1, is exposed at a first side surface 1*y* of the coil substrate 1 to form part of a first electrode terminal 35TA connected to one of the external electrodes, for example, a first external electrode 120 (FIGS. 3A and 3B), of the inductor 100. Furthermore, the connection part 37-1 is across a predetermined gap from a second lengthwise end of the first conductive track 30-1. A side surface of the connection part 37-1, facing away from the first conductive track 30-1, is exposed at a second side surface 1*z* of the coil substrate 1 to form part of a second electrode terminal 37TA connected to the other of the external electrodes, for example, a second external electrode 130 (FIGS. 3A and 3B), of the inductor 100.

The insulating layer 40-1 is formed on the insulating layer 20-1 to cover the first conductive track 30-1, the connection part 35-1, and the connection part 37-1. The insulating layer 40-1 includes an opening 40-11 (see FIGS. 5A and 5B) that exposes the upper surface of the first conductive track 30-1. The opening 40-11 is filled with part of a via 60-1, so that the via 60-1 is electrically connected to the first conductive track 30-1. Furthermore, the insulating layer 40-1 includes an opening 40-12 (see FIGS. 5A and 5B) that exposes the upper surface of the connection part 35-1. The opening 40-12 is filled with part of a via 65-1, so that the via 65-1 is electrically connected to the connection part 35-1. Furthermore, the insulating layer 40-1 includes an opening 40-13 (see FIGS. 5A and 5B) that exposes the upper surface of the connection part 37-1. The opening 40-13 is filled with part of a via 67-1, so that the via 67-1 is electrically connected to the connection part 37-1. Suitable materials for the insulating layer 40-1 include, for example, a photosensitive epoxy insulating resin. The thickness of the insulating layer 40-1 (measured from the upper surface of the first conductive track 30-1) may be, for example, approximately 5 μm to approximately 30 μm, and preferably, approximately 5 μm to approximately 10 μm.

The second structure 1B is stacked on the first structure 1A through the adhesive layer 50-1. When viewed upside down, the second structure 1B includes an insulating layer 20-2 and a second wiring layer formed on the insulating layer 20-2. The second wiring layer includes a second conductive track 30-2, a connection part 35-2, and a connection part 37-2. The second structure 1B further includes an insulating layer 40-2 formed on the insulating layer 20-2 to cover the second conductive track 30-2, the connection part 35-2, and the connection part 37-2.

Suitable materials for the adhesive layer 50-1 include, for example, a heat-resistant adhesive formed of an insulating resin, such as an epoxy adhesive or a polyimide adhesive. The thickness of the adhesive layer 50-1 may be, for example, approximately 10 μm to approximately 40 μm. The shape, thickness, material, etc., of an insulating layer 20–n (where n is a natural number greater than or equal to 2), the shape, thickness, material, etc., of an insulating layer 40–n (where n is a natural number greater than or equal to 2), and the shape, thickness, material, etc., of an adhesive layer 50–n (where n is a natural number greater than or equal to 2) are the same as those of the insulating layer 20-1, the insulating layer 40-1, and the adhesive layer 50-1, respectively, unless otherwise specified.

The insulating layer 20–n and the insulating layer 40–n, which are referred to using different reference numerals for the sake of convenience, both serve as an insulating layer to cover conductive tracks. Furthermore, the adhesive layer 50–n also serves as an insulating layer. Therefore, the insulating layer 20–n may be referred to as "first insulating layer," the insulating layer 40–n may be referred to as "second insulating layer," and the adhesive layer 50–n may be referred to as "third insulating layer." Furthermore, the first insulating layer, the second insulating layer, and the third insulating layer may be simply referred to as "insulating layers" when there is no particular need to distinguish among them.

Preferably, at least one of the insulating layers (the insulating layer 20–n , the insulating layer 40–n , and the adhesive layer 50–n ) has an elastic modulus of 3 GPa or more, and at least another one of the insulating layers has an elastic modulus of less than 3 GPa. This is because it is possible to achieve the coil substrate 1 having a robust structure as a whole because of high stiffness due to an insulating layer having an elastic modulus of 3 GPa or more and high adhesion due to an insulating layer having an elastic modulus of less than 3 GPa. For example, the insulating layers 20–n and 40–n may have an elastic modulus of less than 3 GPa and the adhesive layer 50–n may have an elastic modulus of 3 GPa or more.

For example, in the case of providing (forming) the encapsulation material 110 in the process depicted in FIG. 22A, described below, high pressure is required to prevent a decrease in the filling density of a magnetic material. In this case, because the coil substrate 1 has a robust structure, it is possible to perform stable molding even under high pressure. As a result, it is possible to achieve high inductance. The elastic modulus of an insulating layer may be adjusted by selecting the material of the insulating layer and selecting the type and amount of a filler contained in the material of the insulating layer. For example, it is possible to increase the elastic modulus by using an inorganic filler such as silica, alumina, or glass powder as a filler.

The insulating layer 40-2 is stacked on the adhesive layer 50-1. The second conductive track 30-2 is formed to have a bottom (lower) surface and side surfaces covered with the insulating layer 40-2 and have an upper surface exposed in (that is, uncovered by) the insulating layer 40-2. The second conductive track 30-2 is a second-layer conductive track (approximately ¾ turns) forming part of the coil. The second conductive track 30-2 is patterned to form part of a substantially semi-elliptical shape in the direction indicated in FIG. 2. The second conductive track 30-2 may have a substantially rectangular cross-sectional shape in the width direction.

The connection part 35-2 and the connection part 37-2 are on opposite sides of the second conductive track 30-2 in the Y direction within the same layer as the second conductive track 30-2. The second conductive track 30-2, the connection part 35-2, and the connection part 37-2 form the second wiring layer.

The connection part 35-2 is across a predetermined gap from a first lengthwise end of the second conductive track 30-2 and is not connected to the second conductive track 30-2. A side surface of the connection part 35-2, facing away from the second conductive track 30-2, is exposed at the first side surface 1*y* of the coil substrate 1 to form part of the first electrode terminal 35TA connected to the first external electrode 120 of the inductor 100. The bottom (lower) surface and side surfaces, except the exposed side surface of the connection part 35-2, are covered with the insulating layer 40-2, and the upper surface of the connection part 35-2 is exposed in (that is, uncovered by) the insulating layer 40-2.

The connection part 37-2 is across a predetermined gap from a second lengthwise end of the second conductive track 30-2 and is not connected to the second conductive track 30-2. A side surface of the connection part 37-2, facing away from the second conductive track 30-2, is exposed at the second side surface 1*z* of the coil substrate 1 to form part of the second electrode terminal 37TA connected to the second external electrode 130 of the inductor 100. The bottom (lower) surface and side surfaces, except the exposed side surface of the connection part 37-2, are covered with the insulating layer 40-2, and the upper surface of the connection part 37-2 is exposed in (that is, uncovered by) the insulating layer 40-2.

The material, thickness, etc. of the second conductive track 30-2, the material, thickness, etc. of the connection part 35-2, and the material, thickness, etc. of the connection part 37-2 may be the same as those of the first conductive track 30-1, the connection part 35-1, and the connection part 37-1, respectively.

The insulating layer 20-2 is stacked on the second conductive track 30-2, the connection parts 35-2 and 37-2, and the insulating layer 40-2. The insulating layer 20-2 covers the upper surface of the second conductive track 30-2, the upper surface of the connection part 35-2, and the upper surface of the connection part 37-2.

An opening that penetrates through the insulating layer 20-2, the second conductive track 30-2, and the insulating layer 40-2 is provided in the second structure 1B. The lower end of the opening communicates with an opening in the adhesive layer 50-1 and an opening in the insulating layer 40-1. The communicating openings (an opening 10-25 in FIGS. 7A through 7C) are filled with the via 60-1. The second conductive track 30-2 is connected in series to the first conductive track 30-1 through the via 60-1. Furthermore, an opening (an opening 10-21 in FIGS. 7A through 7C) that penetrates through the insulating layer 20-2 to expose the upper surface of the second conductive track 30-2 is provided in the second structure 1B and is filled with a via 60-2. The second conductive track 30-2 is electrically connected to the via 60-2.

Furthermore, an opening that penetrates through the insulating layer 20-2, the connection part 35-2, and the insulating layer 40-2 is provided in the second structure 1B. The lower end of the opening communicates with an opening in the adhesive layer 50-1 and an opening in the insulating layer 40-1. The communicating openings (an opening 10-26 in FIGS. 7A through 7C) are filled with the via 65-1. The connection part 35-2 is electrically connected to the connection part 35-1 through the via 65-1. Furthermore, an opening that penetrates through the insulating layer 20-2, the connection part 37-2, and the insulating layer 40-2 is provided in the second structure 1B. The lower end of the opening communicates with an opening in the adhesive layer 50-1 and an opening in the insulating layer 40-1. The communicating openings (an opening 10-27 in FIGS. 7A through 7C) are filled with the via 67-1. The connection part 37-2 is electrically connected to the connection part 37-1 through the via 67-1.

The via 65-1 has a semicircular column shape. A side surface of the via 65-1, on the side opposite to the second conductive track 30-2, is a flat surface and is substantially flush with the side surface of the connection part 35-1 facing away from the first conductive track 30-1 and the side surface of the connection part 35-2 facing away from the second conductive track 30-2. The side surface of the via 65-1, on the side opposite to the second conductive track 30-2, along with the side surfaces of the connection parts 35-1 and 35-2, is exposed at the first side surface 1*y* of the coil substrate 1 to form part of the first electrode terminal 35TA connected to the first external electrode 120 of the inductor 100.

The via 67-1 has a semicircular column shape. A side surface of the via 67-1, on the side opposite to the second conductive track 30-2, is a flat surface and is substantially flush with the side surface of the connection part 37-1 facing away from the first conductive track 30-1 and the side surface of the connection part 37-2 facing away from the second conductive track 30-2. The side surface of the via 67-1, on the side opposite to the second conductive track 30-2, along with the side surfaces of the connection parts 37-1 and 37-2, is exposed at the second side surface 1*z* of the coil substrate 1 to form part of the second electrode terminal 37TA connected to the second external electrode 130 of the inductor 100.

The third structure 1C is stacked on the second structure 1B through the adhesive layer 50-2. When viewed upside down, the third structure 1C includes an insulating layer 20-3 and a third wiring layer formed on the insulating layer 20-3. The third wiring layer includes a third conductive track 30-3, a connection part 35-3, and a connection part 37-3. The third structure 1C further includes an insulating layer 40-3 formed on the insulating layer 20-3 to cover the third conductive track 30-3, the connection part 35-3, and the connection part 37-3.

The insulating layer 40-3 is stacked on the adhesive layer 50-2. The third conductive track 30-3 is formed to have a bottom (lower) surface and side surfaces covered with the insulating layer 40-3 and have an upper surface exposed in the insulating layer 40-3. The third conductive track 30-3 is a third-layer conductive track (approximately one turn) forming part of the coil. The third conductive track 30-3 is patterned into a substantially elliptical shape in the direction indicated in FIG. 2. The third conductive track 30-3 may have a substantially rectangular cross-sectional shape in the width direction.

The connection part 35-3 and the connection part 37-3 are on opposite sides of the third conductive track 30-3 in the Y direction within the same layer as the third conductive track 30-3. The third conductive track 30-3, the connection part 35-3, and the connection part 37-3 form the third wiring layer.

The connection part 35-3 is across a predetermined gap from a first lengthwise end of the third conductive track 30-3 and is not connected to the third conductive track 30-3. A side surface of the connection part 35-3, facing away from the third conductive track 30-3, is exposed at the first side surface 1*y* of the coil substrate 1 to form part of the first electrode terminal 35TA connected to the first external electrode 120 of the inductor 100. The bottom (lower) surface and side surfaces, except the exposed side surface of the connection part 35-3, are covered with the insulating layer 40-3, and the upper surface of the connection part 35-3 is exposed in the insulating layer 40-3.

The connection part 37-3 is across a predetermined gap from a second lengthwise end of the third conductive track 30-3 and is not connected to the third conductive track 30-3. A side surface of the connection part 37-3, facing away from the third conductive track 30-3, is exposed at the second side surface 1*z* of the coil substrate 1 to form part of the second electrode terminal 37TA connected to the second external electrode 130 of the inductor 100. The bottom (lower) surface and side surfaces, except the exposed side surface of the connection part 37-3, are covered with the insulating layer 40-3, and the upper surface of the connection part 37-3 is exposed in the insulating layer 40-3.

The material, thickness, etc. of the third conductive track 30-3, the material, thickness, etc. of the connection part 35-3, and the material, thickness, etc. of the connection part 37-3 may be the same as those of the first conductive track 30-1, the connection part 35-1, and the connection part 37-1, respectively.

The insulating layer 20-3 is stacked on the third conductive track 30-3, the connection parts 35-3 and 37-3, and the insulating layer 40-3. The insulating layer 20-3 covers the upper surface of the third conductive track 30-3, the upper surface of the connection part 35-3, and the upper surface of the connection part 37-3.

An opening that penetrates through the insulating layer 20-3, the third conductive track 30-3, and the insulating layer 40-3 is provided in the third structure 1C. The lower end of the opening communicates with an opening in the adhesive layer 50-2. The communicating openings (an opening 10-35 in FIGS. 9A through 9C) are filled with a via 60-3. The via 60-3 is electrically connected to the via 60-2 formed in an opening in the insulating layer 20-2 of the second structure 1B. The third conductive track 30-3 is connected in series to the second conductive track 30-2 through the vias 60-2 and 60-3. Furthermore, an opening (an opening 10-31 in FIG. 8B) that penetrates through the insulating layer 20-3 to expose the upper surface of the third conductive track 30-3 is provided in the third structure 1C and is filled with a via 60-4. The third conductive track 30-3 is electrically connected to the via 60-4.

Furthermore, an opening that penetrates through the insulating layer 20-3, the connection part 35-3, and the insulating layer 40-3 is provided in the third structure 1C. The lower end of the opening communicates with an opening in the adhesive layer 50-2. The communicating openings (an opening 10-36 in FIGS. 9A through 9C) are filled with a via 65-2. The connection part 35-3 is electrically connected to the connection part 35-2 through the via 65-2. Furthermore, an opening that penetrates through the insulating layer 20-3, the connection part 37-3, and the insulating layer 40-3 is provided in the third structure 1C. The lower end of the opening communicates with an opening in the adhesive layer 50-2. The communicating openings (an opening 10-37 in FIGS. 9A through 9C) are filled with a via 67-2. The connection part 37-3 is electrically connected to the connection part 37-2 through the via 67-2.

The via 65-2 has a semicircular column shape. A side surface of the via 65-2, on the side opposite to the third conductive track 30-3, is a flat surface and is substantially flush with the side surface of the connection part 35-2 facing away from the second conductive track 30-2 and the side surface of the connection part 35-3 facing away from the third conductive track 30-3. The side surface of the via 65-2 on the side opposite to the third conductive track 30-3, along with the side surfaces of the connection parts 35-2 and 35-3, is exposed at the first side surface 1*y* of the coil substrate 1 to form part of the first electrode terminal 35TA connected to the first external electrode 120 of the inductor 100.

The via 67-2 has a semicircular column shape. A side surface of the via 67-2, on the side opposite to the third conductive track 30-3, is a flat surface and is substantially flush with the side surface of the connection part 37-2 facing away from the second conductive track 30-2 and the side surface of the connection part 37-3 facing away from the third conductive track 30-3. The side surface of the via 67-2 on the side opposite to the third conductive track 30-3, along with the side surfaces of the connection parts 37-2 and 37-3, is exposed at the second side surface 1*z* of the coil substrate 1 to form part of the second electrode terminal 37TA connected to the second external electrode 130 of the inductor 100.

The fourth structure 1D is stacked on the third structure 1C through the adhesive layer 50-3. When viewed upside down, the fourth structure 1D includes an insulating layer 20-4 and a fourth wiring layer formed on the insulating layer 20-4. The fourth wiring layer includes a fourth conductive track 30-4, a connection part 35-4, and a connection part 37-4. The fourth structure 1D further includes an insulating layer 40-4 formed on the insulating layer 20-4 to cover the fourth conductive track 30-4, the connection part 35-4, and the connection part 37-4.

The insulating layer 40-4 is stacked on the adhesive layer 50-3. The fourth conductive track 30-4 is formed to have a bottom (lower) surface and side surfaces covered with the insulating layer 40-4 and have an upper surface exposed in the insulating layer 40-4. The fourth conductive track 30-4 is a fourth-layer conductive track (approximately ¾ turns) forming part of the coil. The fourth conductive track 30-4 is patterned to form part of a substantially semi-elliptical shape in the direction indicated in FIG. 2.

The connection part 35-4 and the connection part 37-4 are on opposite sides of the fourth conductive track 30-4 in the Y direction within the same layer as the fourth conductive track 30-4. The fourth conductive track 30-4, the connection part 35-4, and the connection part 37-4 form the fourth wiring layer.

The connection part 35-4 is across a predetermined gap from a first lengthwise end of the fourth conductive track 30-4 and is not connected to the fourth conductive track 30-4. A side surface of the connection part 35-4, facing away from the fourth conductive track 30-4, is exposed at the first side surface 1*y* of the coil substrate 1 to form part of the first electrode terminal 35TA connected to the first external electrode 120 of the inductor 100. The bottom (lower) surface and side surfaces, except the exposed side surface of the connection part 35-4, are covered with the insulating layer 40-4, and the upper surface of the connection part 35-4 is exposed in the insulating layer 40-4.

The connection part 37-4 is across a predetermined gap from a second lengthwise end of the fourth conductive track 30-4 and is not connected to the fourth conductive track 30-4. A side surface of the connection part 37-4, facing away from the fourth conductive track 30-4, is exposed at the second side surface 1*z* of the coil substrate 1 to form part of the second electrode terminal 37TA connected to the second external electrode 130 of the inductor 100. The bottom (lower) surface and side surfaces, except the exposed side surface of the connection part 37-4, are covered with the insulating layer 40-4, and the upper surface of the connection part 37-4 is exposed in the insulating layer 40-4.

The material, thickness, etc. of the fourth conductive track 30-4, the material, thickness, etc. of the connection part 35-4, and the material, thickness, etc. of the connection part 37-4 may be the same as those of the first conductive track 30-1, the connection part 35-1, and the connection part 37-1, respectively.

The insulating layer 20-4 is stacked on the fourth conductive track 30-4, the connection parts 35-4 and 37-4, and the insulating layer 40-4. The insulating layer 20-4 covers the upper surface of the fourth conductive track 30-4, the upper surface of the connection part 35-4, and the upper surface of the connection part 37-4.

An opening that penetrates through the insulating layer 20-4, the fourth conductive track 30-4, and the insulating layer 40-4 is provided in the fourth structure 1D. The lower end of the opening communicates with an opening in the adhesive layer 50-3. The communicating openings (an opening 10-45 in FIGS. 11A through 11C) are filled with a via 60-5. The via 60-5 is electrically connected to the via 60-4 formed in an opening in the insulating layer 20-3 of the third structure 1C. The fourth conductive track 30-4 is connected in series to the third conductive track 30-3 through the vias 60-4 and 60-5. Furthermore, an opening (an opening 10-41 in FIGS. 11A through 11C) that penetrates through the insulating layer 20-4 to expose the upper surface of the fourth conductive track 30-4 is provided in the fourth structure 1D and is filled with a via 60-6. The fourth conductive track 30-4 is electrically connected to the via 60-6.

Furthermore, an opening that penetrates through the insulating layer 20-4, the connection part 35-4, and the insulating layer 40-4 is provided in the fourth structure 1D. The lower end of the opening communicates with an opening in the adhesive layer 50-3. The communicating openings (an opening 10-46 in FIGS. 11A through 11C) are filled with a via 65-3. The connection part 35-4 is electrically connected to the connection part 35-3 through the via 65-3. Furthermore, an opening that penetrates through the insulating layer 20-4, the connection part 37-4, and the insulating layer 40-4 is provided in the fourth structure 1D. The lower end of the opening communicates with an opening in the adhesive layer 50-3. The communicating openings (an opening 10-47 in FIGS. 11A through 11C) are filled with a via 67-3. The connection part 37-4 is electrically connected to the connection part 37-3 through the via 67-3.

The via 65-3 has a semicircular column shape. A side surface of the via 65-3, on the side opposite to the fourth conductive track 30-4, is a flat surface and is substantially flush with the side surface of the connection part 35-3 facing away from the third conductive track 30-3 and the side surface of the connection part 35-4 facing away from the fourth conductive track 30-4. The side surface of the via 65-3 on the side opposite to the fourth conductive track 30-4, along with the side surfaces of the connection parts 35-3 and 35-4, is exposed at the first side surface 1*y* of the coil substrate 1 to form part of the first electrode terminal 35TA connected to the first external electrode 120 of the inductor 100.

The via 67-3 has a semicircular column shape. A side surface of the via 67-3, on the side opposite to the fourth conductive track 30-4, is a flat surface and is substantially flush with the side surface of the connection part 37-3 facing away from the third conductive track 30-3 and the side surface of the connection part 37-4 facing away from the fourth conductive track 30-4. The side surface of the via 67-3 on the side opposite to the fourth conductive track 30-4, along with the side surfaces of the connection parts 37-3 and 37-4, is exposed at the second side surface 1*z* of the coil substrate 1 to form part of the second electrode terminal 37TA connected to the second external electrode 130 of the inductor 100.

The fourth structure 1D has the same structure as the second structure 1B. The fourth structure 1D corresponds to the second structure 1B rotated 180° about a normal to the X-Y plane. The opening 10-41 and an opening 10-42 in the fourth structure 1D correspond to the opening 10-21 and an opening 10-22, respectively, in the second structure 1B.

The fifth structure 1E is stacked on the fourth structure 1D through the adhesive layer 50-4. When viewed upside down, the fifth structure 1E includes an insulating layer 20-5 and a fifth wiring layer formed on the insulating layer 20-5. The fifth wiring layer includes a fifth conductive track 30-5, a connection part 35-5, and a connection part 37-5. The fifth structure 1E further includes an insulating layer 40-5, formed on the insulating layer 20-5, to cover the fifth conductive track 30-5, the connection part 35-5, and the connection part 37-5.

The insulating layer 40-5 is stacked on the adhesive layer 50-4. The fifth conductive track 30-5 is formed to have a bottom (lower) surface and side surfaces covered with the insulating layer 40-5 and have an upper surface exposed in the insulating layer 40-5. The fifth conductive track 30-5 is a fifth-layer conductive track (approximately one turn) forming part of the coil. The fifth conductive track 30-5 is patterned into a substantially elliptical shape in the direction indicated in FIG. 2. The fifth conductive track 30-5 may have a substantially rectangular cross-sectional shape in the width direction.

The connection part 35-5 and the connection part 37-5 are on opposite sides of the fifth conductive track 30-5 in the Y direction within the same layer as the fifth conductive track 30-5. The fifth conductive track 30-5, the connection part 35-5, and the connection part 37-5 form the fifth wiring layer.

The connection part 35-5 is across a predetermined gap from a first lengthwise end of the fifth conductive track 30-5 and is not connected to the fifth conductive track 30-5. A side surface of the connection part 35-5, facing away from the fifth conductive track 30-5, is exposed at the first side surface 1*y* of the coil substrate 1 to form part of the first electrode terminal 35TA connected to the first external electrode 120 of the inductor 100. The bottom (lower) surface and side surfaces except the exposed side surface of the connection part 35-5 are covered with the insulating layer 40-5, and the upper surface of the connection part 35-5 is exposed in the insulating layer 40-5.

The connection part 37-5 is across a predetermined gap from a second lengthwise end of the fifth conductive track 30-5 and is not connected to the fifth conductive track 30-5. A side surface of the connection part 37-5, facing away from the fifth conductive track 30-5, is exposed at the second side surface 1*z* of the coil substrate 1 to form part of the second electrode terminal 37TA connected to the second external electrode 130 of the inductor 100. The bottom (lower) surface and side surfaces, except the exposed side surface of the connection part 37-5, are covered with the insulating layer 40-5, and the upper surface of the connection part 37-5 is exposed in the insulating layer 40-5.

The material, thickness, etc. of the fifth conductive track 30-5, the material, thickness, etc. of the connection part 35-5, and the material, thickness, etc. of the connection part 37-5 may be the same as those of the first conductive track 30-1, the connection part 35-1, and the connection part 37-1, respectively.

The insulating layer 20-5 is stacked on the fifth conductive track 30-5, the connection parts 35-5 and 37-5, and the insulating layer 40-5. The insulating layer 20-5 covers the upper surface of the fifth conductive track 30-5, the upper surface of the connection part 35-5, and the upper surface of the connection part 37-5.

An opening that penetrates through the insulating layer 20-5, the fifth conductive track 30-5, and the insulating layer 40-5 is provided in the fifth structure 1E. The lower end of the opening communicates with an opening in the adhesive layer 50-4. The communicating openings (an opening 10-55 in FIGS. 13A through 13C) are filled with a via 60-7. The via 60-7 is electrically connected to the via 60-6 formed in an opening in the insulating layer 20-4 of the fourth structure 1D. The fifth conductive track 30-5 is connected in series to the fourth conductive track 30-4 through the vias 60-6 and 60-7. Furthermore, an opening (an opening 10-51 in FIG. 12B) that penetrates through the insulating layer 20-5 to expose the upper surface of the fifth conductive track 30-5 is provided in the fifth structure 1E and is filled with a via 60-8. The fifth conductive track 30-5 is electrically connected to the via 60-8.

Furthermore, an opening that penetrates through the insulating layer 20-5, the connection part 35-5, and the insulating layer 40-5 is provided in the fifth structure 1E. The lower end of the opening communicates with an opening in the adhesive layer 50-4. The communicating openings (an opening 10-56 in FIGS. 13A through 13C) are filled with a via 65-4. The connection part 35-5 is electrically connected to the connection part 35-4 through the via 65-4. Furthermore, an opening that penetrates through the insulating layer 20-5, the connection part 37-5, and the insulating layer 40-5 is provided in the fifth structure 1E. The lower end of the opening communicates with an opening in the adhesive layer 50-4. The communicating openings (an opening 10-57 in FIGS. 13A through 13C) are filled with a via 67-4. The connection part 37-5 is electrically connected to the connection part 37-4 through the via 67-4.

The via 65-4 has a semicircular column shape. A side surface of the via 65-4 on the side opposite to the fifth conductive track 30-5 is a flat surface and is substantially flush with the side surface of the connection part 35-4 facing away from the fourth conductive track 30-4 and the side surface of the connection part 35-5 facing away from the fifth conductive track 30-5. The side surface of the via 65-4 on the side opposite to the fifth conductive track 30-5, along with the side surfaces of the connection parts 35-4 and 35-5, is exposed at the first side surface 1*y* of the coil substrate 1 to form part of the first electrode terminal 35TA connected to the first external electrode 120 of the inductor 100.

The via 67-4 has a semicircular column shape. A side surface of the via 67-4, on the side opposite to the fifth conductive track 30-5, is a flat surface and is substantially flush with the side surface of the connection part 37-4 facing away from the fourth conductive track 30-4 and the side surface of the connection part 37-5 facing away from the fifth conductive track 30-5. The side surface of the via 67-4, on the side opposite to the fifth conductive track 30-5, along with the side surfaces of the connection parts 37-4 and 37-5, is exposed at the second side surface 1*z* of the coil substrate 1 to form part of the second electrode terminal 37TA connected to the second external electrode 130 of the inductor 100.

The fifth structure 1E has the same structure as the third structure 1C. The fifth structure 1E corresponds to the third structure 1C rotated 180° about a normal to the X-Y plane. The opening 10-51 and an opening 10-52 in the fifth structure 1E correspond to the opening 10-31 and an opening 10-32, respectively, in the third structure 1C.

The sixth structure 1F is stacked on the fifth structure 1E through the adhesive layer 50-5. When viewed upside down, the sixth structure 1F includes an insulating layer 20-6 and a sixth wiring layer formed on the insulating layer 20-6. The sixth wiring layer includes a sixth conductive track 30-6, a connection part 35-6, and a connection part 37-6. The sixth structure 1F further includes an insulating layer 40-6 formed on the insulating layer 20-6 to cover the sixth conductive track 30-6, the connection part 35-6, and the connection part 37-6.

The insulating layer 40-6 is stacked on the adhesive layer 50-5. The sixth conductive track 30-6 is formed to have a bottom (lower) surface and side surfaces covered with the insulating layer 40-6 and have an upper surface exposed in the insulating layer 40-6. The sixth conductive track 30-6 is a six-layer conductive track (approximately ¾ turns) forming part of the coil. The sixth conductive track 30-6 is patterned to form part of a substantially semi-elliptical shape in the direction indicated in FIG. 2. The sixth conductive track 30-6 may have a substantially rectangular cross-sectional shape in the width direction.

The connection part 35-6 and the connection part 37-6 are on opposite sides of the sixth conductive track 30-6 in the Y direction within the same layer as the sixth conductive track 30-6. The sixth conductive track 30-6, the connection part 35-6, and the connection part 37-6 form the sixth wiring layer.

The connection part 35-6 is across a predetermined gap from a first lengthwise end of the sixth conductive track 30-6 and is not connected to the sixth conductive track 30-6. A side surface of the connection part 35-6, facing away from the sixth conductive track 30-6, is exposed at the first side surface 1*y* of the coil substrate 1 to form part of the first electrode terminal 35TA connected to the first external electrode 120 of the inductor 100. The bottom (lower) surface and side surfaces, except the exposed side surface of the connection part 35-6, are covered with the insulating layer 40-6, and the upper surface of the connection part 35-6 is exposed in the insulating layer 40-6.

The connection part 37-6 is across a predetermined gap from a second lengthwise end of the sixth conductive track 30-6 and is not connected to the sixth conductive track 30-6. A side surface of the connection part 37-6 facing away from the sixth conductive track 30-6 is exposed at the second side surface 1*z* of the coil substrate 1 to form part of the second electrode terminal 37TA connected to the second external electrode 130 of the inductor 100. The bottom (lower) surface and side surfaces except the exposed side surface of the connection part 37-6 are covered with the insulating layer 40-6, and the upper surface of the connection part 37-6 is exposed in the insulating layer 40-6.

The material, thickness, etc. of the sixth conductive track 30-6, the material, thickness, etc. of the connection part 35-6, and the material, thickness, etc. of the connection part 37-6 may be the same as those of the first conductive track 30-1, the connection part 35-1, and the connection part 37-1, respectively.

The insulating layer 20-6 is stacked on the sixth conductive track 30-6, the connection parts 35-6 and 37-6, and the insulating layer 40-6. The insulating layer 20-6 covers the upper surface of the sixth conductive track 30-6, the upper surface of the connection part 35-6, and the upper surface of the connection part 37-6.

An opening that penetrates through the insulating layer 20-6, the sixth conductive track 30-6, and the insulating layer 40-6 is provided in the sixth structure 1F. The lower end of the opening communicates with an opening in the adhesive layer 50-5. The communicating openings (an opening 10-65 in FIGS. 14A through 14C) are filled with a via 60-9. The via 60-9 is electrically connected to the via 60-8 formed in an opening in the insulating layer 20-5 of the fifth structure 1E. The sixth conductive track 30-6 is connected in series to the fifth conductive track 30-5 through the vias 60-8 and 60-9. Furthermore, an opening (an opening 10-61 in FIGS. 14A through 14C) that penetrates through the insulating layer 20-6 to expose the upper surface of the sixth conductive track 30-6 is provided in the sixth structure 1F and is filled with a via 60-10. The sixth conductive track 30-6 is electrically connected to the via 60-10.

Furthermore, an opening that penetrates through the insulating layer 20-6, the connection part 35-6, and the insulating layer 40-6 is provided in the sixth structure 1F. The lower end of the opening communicates with an opening in the adhesive layer 50-5. The communicating openings (an opening 10-66 in FIGS. 14A through 14C) are filled with a via 65-5. The connection part 35-6 is electrically connected to the connection part 35-5 through the via 65-5. Furthermore, an opening that penetrates through the insulating layer 20-6, the connection part 37-6, and the insulating layer 40-6 is provided in the sixth structure 1F. The lower end of the opening communicates with an opening in the adhesive layer 50-5. The communicating openings (an opening 10-67 in FIGS. 14A through 14C) are filled with a via 67-5. The connection part 37-6 is electrically connected to the connection part 37-5 through the via 67-5.

The via 65-5 has a semicircular column shape. A side surface of the via 65-5, on the side opposite to the sixth conductive track 30-6, is a flat surface and is substantially flush with the side surface of the connection part 35-5 facing away from the fifth conductive track 30-5 and the side surface of the connection part 35-6 facing away from the sixth conductive track 30-6. The side surface of the via 65-5, on the side opposite to the sixth conductive track 30-6, along with the side surfaces of the connection parts 35-5 and 35-6, is exposed at the first side surface 1*y* of the coil substrate 1 to form part of the first electrode terminal 35TA connected to the first external electrode 120 of the inductor 100.

The via 67-5 has a semicircular column shape. A side surface of the via 67-5, on the side opposite to the sixth conductive track 30-6, is a flat surface and is substantially flush with the side surface of the connection part 37-5 facing away from the fifth conductive track 30-5 and the side surface of the connection part 37-6 facing away from the sixth conductive track 30-6. The side surface of the via 67-5, on the side opposite to the sixth conductive track 30-6, along with the side surfaces of the connection parts 37-5 and 37-6, is exposed at the second side surface 1*z* of the coil substrate 1 to form part of the second electrode terminal 37TA connected to the second external electrode 130 of the inductor 100.

Although referred to using reference numerals different from those of the second structure 1B for the sake of convenience, the sixth structure 1F has the same structure as the second structure 1B, and the opening 10-61 and an opening 10-62 in the sixth structure 1F correspond to the opening 10-21 and the opening 10-22, respectively, in the second structure 1B.

The seventh structure 1G is stacked on the sixth structure 1F through the adhesive layer 50-6. When viewed upside down, the seventh structure 1G includes an insulating layer 20-7 and a seventh wiring layer formed on the insulating layer 20-7. The seventh wiring layer includes the seventh conductive track 30-7, a connection part 35-7, and a connection part 37-7. The seventh structure 1G further includes an insulating layer 40-7 formed on the insulating layer 20-7 to cover the seventh conductive track 30-7, the connection part 35-7, and the connection part 37-7.

The insulating layer 40-7 is stacked on the adhesive layer 50-6. The seventh conductive track 30-7 is formed to have a bottom (lower) surface and side surfaces covered with the insulating layer 40-7 and have an upper surface exposed in the insulating layer 40-7. The seventh conductive track 30-7 is a topmost-layer conductive track and is patterned into a substantially elliptical shape in the direction indicated in FIG. 2.

The connection part 35-7 and the connection part 37-7 are on opposite sides of the seventh conductive track 30-7 in the Y direction within the same layer as the seventh conductive track 30-7. The seventh conductive track 30-7, the connection part 35-7, and the connection part 37-7 form the seventh wiring layer.

The connection part 35-7 is across a predetermined gap from a first lengthwise end of the seventh conductive track 30-7 and is not connected to the seventh conductive track 30-7. A side surface of the connection part 35-7, facing away from the seventh conductive track 30-7, is exposed at the first side surface 1*y* of the coil substrate 1 to form part of the first electrode terminal 35TA connected to the first external electrode 120 of the inductor 100. The bottom (lower) surface and side surfaces, except the exposed side surface of the connection part 35-7, are covered with the insulating layer 40-7, and the upper surface of the connection part 35-7 is exposed in the insulating layer 40-7.

Furthermore, the connection part 37-7 extends from the seventh conductive track 30-7. The connection part 37-7 is monolithically formed with the seventh conductive track 30-7 at a second lengthwise end of the seventh conductive track 30-7. A side surface of the connection part 37-7, facing away from the seventh conductive track 30-7, is exposed at the second side surface 1*z* of the coil substrate 1 to form part of the second electrode terminal 37TA connected to the second external electrode 130 of the inductor 100. The bottom (lower) surface and side surfaces, except the exposed side surface of the connection part 37-7, are covered with the insulating layer 40-7, and the upper surface of the connection part 37-7 is exposed in the insulating layer 40-7.

The material, thickness, etc. of the seventh conductive track 30-7, the material, thickness, etc. of the connection part 35-7, and the material, thickness, etc. of the connection part 37-7 may be the same as those of the first conductive track 30-1, the connection part 35-1, and the connection part 37-1, respectively.

The insulating layer 20-7 is stacked on the seventh conductive track 30-7, the connection parts 35-7 and 37-7, and the insulating layer 40-7. The insulating layer 20-7 covers the upper surface of the seventh conductive track 30-7, the upper surface of the connection part 35-7, and the upper surface of the connection part 37-7.

An opening that penetrates through the insulating layer 20-7, the seventh conductive track 30-7, and the insulating layer 40-7 is provided in the seventh structure 1G. The lower end of the opening communicates with an opening in the adhesive layer 50-6. The communicating openings (an opening 10-75 in FIGS. 16A through 16C) are filled with a via 60-11. The via 60-11 is electrically connected to the via 60-10 formed in an opening in the insulating layer 20-6 of the sixth structure 1F. The seventh conductive track 30-7 is connected in series to the sixth conductive track 30-6 through the vias 60-10 and 60-11. Thus, according to the coil substrate 1, conductive tracks forming the wiring layers of adjacent structures are connected in series to each other to form a helical coil having the connection part 35-1 at a first end and the connection part 37-7 at a second end.

Furthermore, an opening that penetrates through the insulating layer 20-7, the connection part 35-7, and the insulating layer 40-7 is provided in the seventh structure 1G. The lower end of the opening communicates with an opening in the adhesive layer 50-6. The communicating openings (an opening 10-76 in FIGS. 16A through 16C) are filled with a via 65-6. The connection part 35-7 is electrically connected to the connection part 35-6 through the via 65-6. Furthermore, an opening that penetrates through the insulating layer 20-7, the connection part 37-7, and the insulating layer 40-7 is provided in the seventh structure 1G. The lower end of the opening communicates with an opening in the adhesive layer 50-6. The communicating openings (an opening 10-77 in FIGS. 16A through 16C) are filled with a via 67-6. The connection part 37-7 is electrically connected to the connection part 37-6 through the via 67-6.

The via 65-6 has a semicircular column shape. A side surface of the via 65-6, on the side opposite to the seventh conductive track 30-7, is a flat surface and is substantially flush with the side surface of the connection part 35-6 facing away from the sixth conductive track 30-6 and the side surface of the connection part 35-7 facing away from the seventh conductive track 30-7. The side surface of the via 65-6, on the side opposite to the seventh conductive track 30-7, along with the side surfaces of the connection parts 35-6 and 35-7, is exposed at the first side surface 1*y* of the coil substrate 1 to form part of the first electrode terminal 35TA connected to the first external electrode 120 of the inductor 100.

The via 67-6 has a semicircular column shape. A side surface of the via 67-6, on the side opposite to the seventh conductive track 30-7, is a flat surface and is substantially flush with the side surface of the connection part 37-6 facing away from the sixth conductive track 30-6 and the side surface of the connection part 37-7 facing away from the seventh conductive track 30-7. The side surface of the via 67-6, on the side opposite to the seventh conductive track 30-7, along with the side surfaces of the connection parts 37-6 and 37-7, is exposed at the second side surface 1*z* of the coil substrate 1 to form part of the second electrode terminal 37TA connected to the second external electrode 130 of the inductor 100.

Thus, according to the coil substrate 1, the connection parts 35-1 through 35-7 (first connection parts) are provided at positions that substantially coincide with one another in a plan view in the same layers as the conductive tracks 30-1 through 30-7, respectively. Furthermore, the connection parts 35-1 through 35-7 are electrically connected through the vias 65-1 through 65-6 (first vias) into the first electrode terminal 35TA to be connected to the first end of the helical coil. A side surface of the first electrode terminal 35TA, facing away from the conductive tracks 30-1 through 30-7 of the first through seventh structures 1A through 1G, is a substantially flat surface and exposed at the first side surface 1*y* of the coil substrate 1, and is connectable to one of the external electrodes, for example, the first external electrode 120, of the inductor 100.

Furthermore, the connection parts 37-1 through 37-7 (second connection parts) are provided at positions that substantially coincide with one another in a plan view in the same layers as the conductive tracks 30-1 through 30-7, respectively. Furthermore, the connection parts 37-1 through 37-7 are electrically connected through the vias 67-1 through 67-6 (second vias) into the second electrode terminal 37TA to be connected to the second end of the helical coil. A side surface of the second electrode terminal 37TA, facing away from the conductive tracks 30-1 through 30-7 of the first through seventh structures 1A through 1G, is a substantially flat surface and exposed at the second side surface 1*z* of the coil substrate 1, and is connectable to the other of the external electrodes, for example, the second external electrode 130, of the inductor 100.

The adhesive layer 50-7 is stacked on the seventh structure 1G. No opening is formed in the adhesive layer 50-7. That is, the upper surface of a laminate of the stacked first through seventh structures 1A through 1G is covered with the adhesive layer 50-7 that is an insulating layer, so that no conductor is exposed in the adhesive layer 50-7.

According to the laminate of the stacked first through seventh structures 1A through 1G, the end faces of the conductive tracks 30-1 through 30-7 that are exposed at the exterior wall (sidewall) surfaces of the laminate, except the first and second side surfaces 1*y* and 1*z*, and the interior wall surface of the laminate defining the through hole 1*x* are covered with the insulating film 70. The insulating film 70 is provided to prevent a short circuit between the end surfaces of the conductive tracks 30-1 through 30-7 exposed in the laminate and a conductive material (such as a filler of a magnetic material) that may be contained in the encapsulation material 110 when the inductor 100 (see FIGS. 3A and 3B) is manufactured.

Examples of the insulating film 70 include an electrodeposited resist. The thickness of the insulating film 70 may be, for example, approximately 5 μm to approximately 50 μm, and preferably, approximately 5 μm to approximately 10 μm. An epoxy or acrylic insulating resin may alternatively be used as the insulating film 70, for example. In this case, the insulating film 70 that continuously covers the exterior wall (sidewall) surfaces of the laminate, the upper surface of the adhesive layer 50-7, and the interior wall surface of the laminate defining the through hole 1*x* is formed.

Figure 3A:
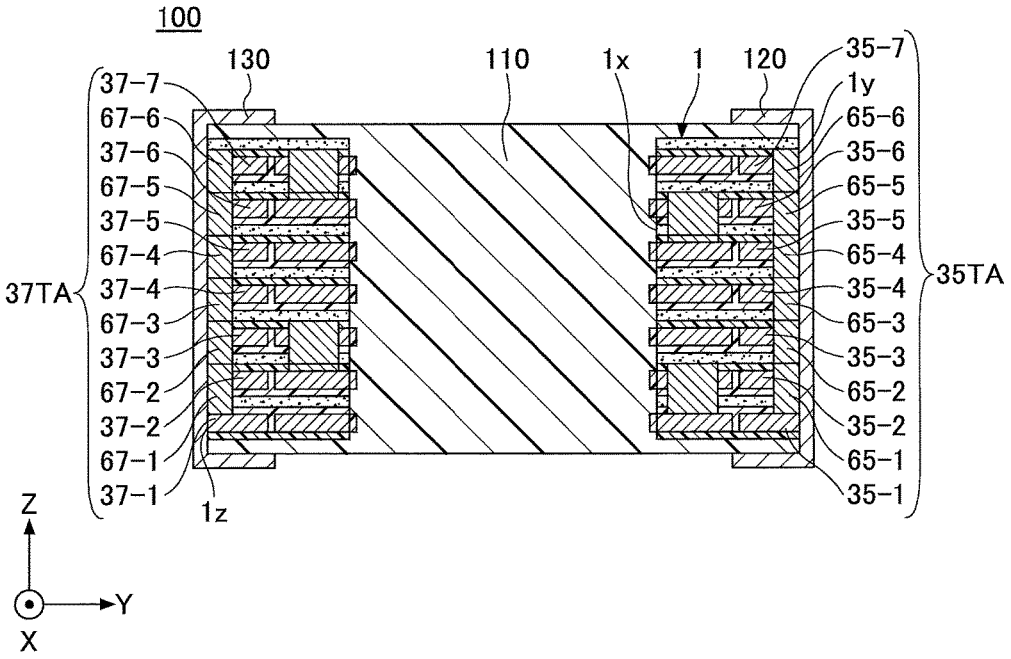
FIGS. 3A and 3B are diagrams depicting an inductor according to the embodiment.
Figure 3B:
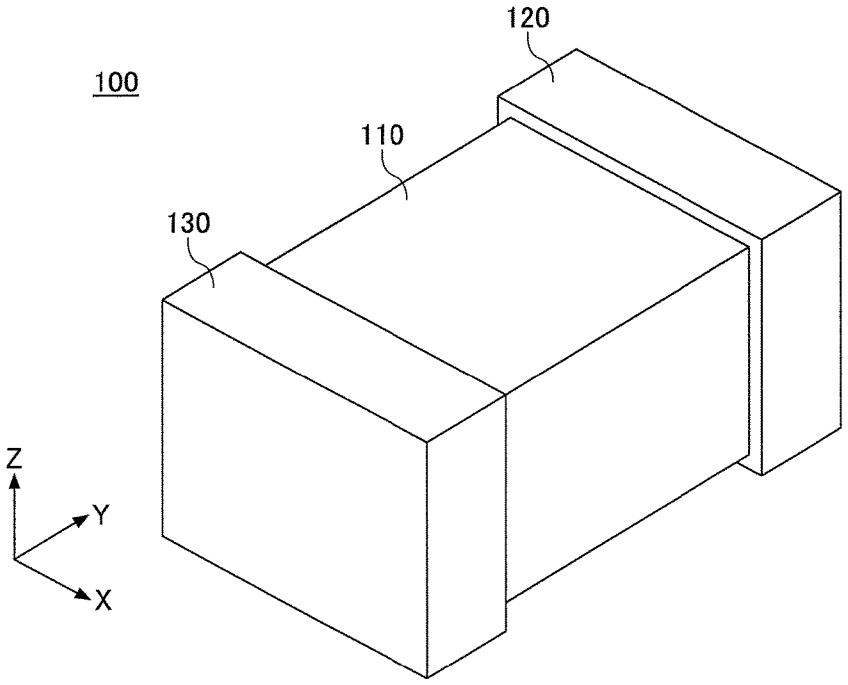

FIGS. 3A and 3B are diagrams depicting an inductor according to the embodiment. FIGS. 3A and 3B are a cross-sectional view and a perspective view, respectively, of the inductor. Referring to FIGS. 3A and 3B, the inductor 100 is a chip inductor in which the coil substrate 1 is selectively covered with the encapsulation material 110 and the first and second external electrodes 120 and 130 are formed. The planar shape of the inductor 100 may be a substantially rectangular shape of, for example, 1.6 mm by 0.8 mm or 2.0 mm by 1.6 mm, or a shape of approximately 3.0 mm square. The thickness of the coil substrate 1 may be, for example, approximately 0.5 mm.

According to the inductor 100, the encapsulation material 110 encapsulates the coil substrate 1 except for the first side surface 1*y* and the second side surface 1*z*. That is, the encapsulation material 110 covers the coil substrate 1 except for surfaces at which the side surface of the first electrode terminal 35TA and the side surface of the second electrode terminal 37TA of the coil substrate 1 are exposed. The encapsulation material 110 is also formed (provided) in the through hole 1*x*. Examples of the encapsulation material 110 include an encapsulation material containing magnetic metal powder or a filler of a magnetic material, such as a ferrite. By using such an encapsulation material, the encapsulation material 110 serves as a magnetic material. The magnetic material serves to increase the inductance of the inductor 100. The encapsulation material 110 preferably contains 90 wt % to 99 wt %, more preferably, 95 wt % to 99 wt %, of a magnetic material.

Thus, the through hole 1*x* is formed in the coil substrate 1. The through hole 1*x* also is filled with the encapsulation material 110 that preferably contains 90 wt % to 99 wt %, more preferably, 95 wt % to 99 wt %, of a magnetic material. Accordingly, it is possible to further increase the inductance. Alternatively, a core of a magnetic material such as a ferrite may be disposed in the through hole 1*x* and the encapsulation material 110 may be so formed as to contain the core. The shape of the core may be, for example, a columnar shape or a parallelepiped shape.

The first external electrode 120 is formed at a first end of the exterior of the encapsulation material 110. The first external electrode 120 has an interior wall surface that is in surface contact with the entirety of the side surface of the first electrode terminal 35TA exposed (that is, uncovered by the encapsulation material 110) at the first side surface 1*y* of the coil substrate 1, so that the interior wall surface of the first external electrode 120 and the side surface of the first electrode terminal 35TA are electrically connected. Furthermore, the first external electrode 120 is formed on the side surface of the first electrode terminal 35TA to extend continuously from the side surface of the first electrode terminal 35TA to the four peripheral surfaces of the encapsulation material 110 at its first end. That is, the first external electrode 120 is formed to cap the first end of the exterior of the encapsulation material 110, covering five surfaces of the encapsulation material 110, namely, a first side surface of the encapsulation material 110 at which the first electrode terminal 35TA is exposed and four surfaces of the encapsulation material 110 extending from the first side surface.

The second external electrode 130 is formed at a second end of the exterior of the encapsulation material 110. The second external electrode 130 has an interior wall surface that is in surface contact with the entirety of the side surface of the second electrode terminal 37TA exposed (that is, uncovered by the encapsulation material 110) at the second side surface 1*z* of the coil substrate 1, so that the interior wall surface of the second external electrode 130 and the side surface of the second electrode terminal 37TA are electrically connected. Furthermore, the second external electrode 130 is formed on the side surface of the second electrode terminal 37TA to extend continuously from the side surface of the second electrode terminal 37TA to the four peripheral surfaces of the encapsulation material 110 at its second end. That is, the second external electrode 130 is formed to cap the second end of the exterior of the encapsulation material 110, covering five surfaces of the encapsulation material 110, namely, a second side surface of the encapsulation material 110 at which the second electrode terminal 37TA is exposed and four surfaces of the encapsulation material 110 extending from the second side surface.

The material of the first and second external electrodes 120 and 130 preferably has good electrical conductivity. Suitable materials for the first and second external electrodes 120 and 130 include, for example, silver (Ag), nickel (Ni), copper (Cu), and copper alloys. The first and second external electrodes 120 and 130 may be laminates of multiple metal layers.

Thus, according to the inductor 100, the first electrode terminal 35TA of the coil substrate 1 and the first external electrode 120 are in surface contact, and the second electrode terminal 37TA of the coil substrate 1 and the second external electrode 130 are in surface contact. Therefore, compared with conventional inductors, it is possible to increase the contact area of an electrode terminal of the coil substrate and an external electrode of the inductor, and it is thereby possible to reduce the electrical resistance between the electrode terminal of the coil substrate and the external electrode of the inductor. Furthermore, it is possible to expect an increase in the long-term reliability of the joint of the electrode terminal and the external electrode.

Figure 4A:
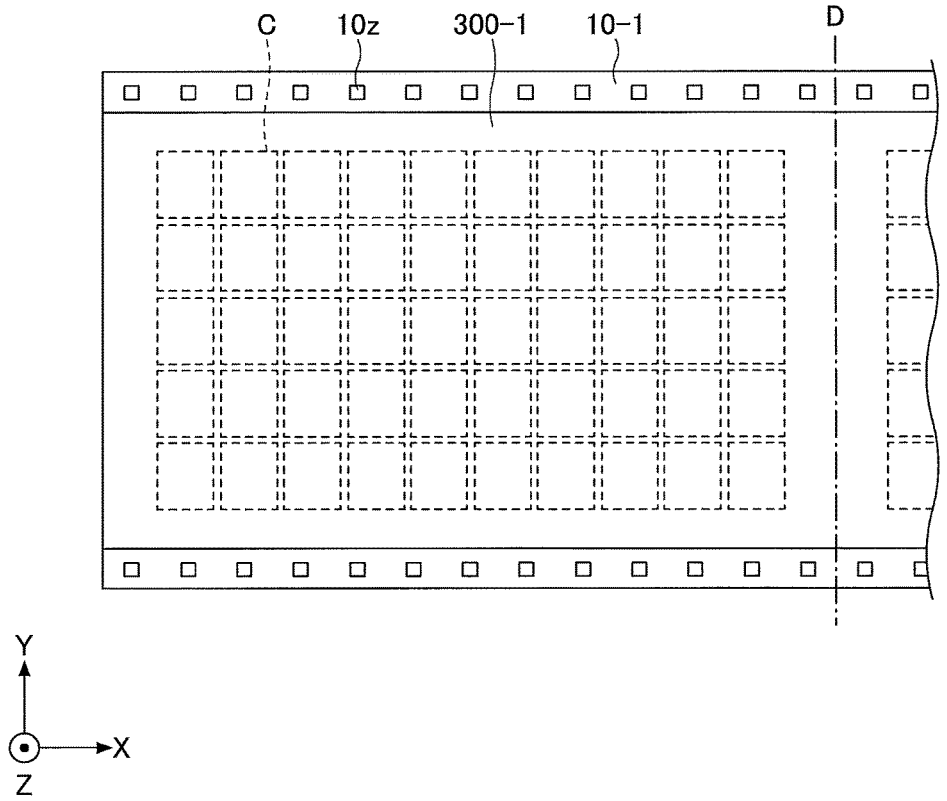
FIGS. 4A and 4B are diagrams depicting a method of manufacturing a coil substrate according to the embodiment.
Figure 4B:
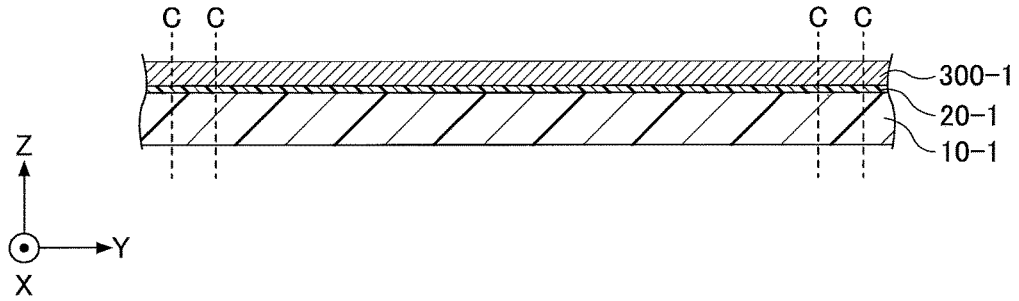

Next, a method of manufacturing a coil substrate according to the embodiment is described. FIGS. 4A through 21C are diagrams depicting a process of manufacturing a coil substrate according to the embodiment. First, the process depicted in FIGS. 4A and 4B is described. FIG. 4A is a plan view, and FIG. 4B is a cross-sectional view of one of individual regions C (described below) and its neighborhood, taken along a plane parallel to a Y-Z plane in FIG. 4A. In the process depicted in FIGS. 4A and 4B, first, for example, a flexible insulating resin film in a reeled state or in the form of tape is prepared as a substrate 10-1 (first substrate).

Then, at each end of the substrate 10-1 in its transverse direction (a vertical [Y] direction in FIG. 4A), sprocket holes 10*z* are successively formed at substantially regular intervals along the longitudinal direction (a lateral [X] direction in FIG. 4A) of the substrate $\mathbf{10}_1$ by a process such as press working. Thereafter, the insulating layer 20-1 and metal foil 300-1 are successively stacked on a first surface of the substrate 10-1 except for the end regions where the sprocket holes 10*z* are formed. Specifically, for example, the insulating layer 20-1 in a semi-cured state and the metal foil 300-1 are successively stacked on the first surface of the substrate 10-1, and the insulating layer 20-1 in a semi-cured state is cured by heating.

The regions C indicated by dashed lines within a region between the end regions, where the sprocket holes 10*z* are formed on the substrate 10-1, are ultimately cut along the dashed lines into individual regions that become coil substrates 1. The regions C are hereinafter referred to as "individual regions C." The individual regions C may be arranged in a matrix, for example. In this case, the individual regions C may be arranged at predetermined intervals as depicted in FIG. 4A or be arranged in contact with each other. Furthermore, the number of individual regions C and the number of sprocket holes 10*z* may be determined as desired. In FIG. 4A, a one-dot chain line D indicates a cutting position (hereinafter referred to as "cutting position D") for cutting the reel-shaped (tape-shaped) substrate 10-1 to obtain a sheet-shaped substrate in a subsequent process.

For example, a film such as a polyphenylenesulfide film, a polyimide film, or a polyethylene naphthalate film may be used as the substrate 10-1. The thickness of the substrate 10-1 may be, for example, approximately 50 μm to approximately 75 μm.

For example, an epoxy insulating resin in the form of a film may be used as the insulating layer 20-1. Alternatively, an epoxy insulating resin in the form of liquid or paste may be used as the insulating layer 20-1. The thickness of the insulating layer 20-1 may be, for example, approximately 8 μm to approximately 12 μm. The metal foil 300-1, which is patterned into a metal layer 301-1, the connection part 35-1, and the connection part 37-1, may be, for example, copper foil. The thickness of the metal foil 300-1 may be, for example, approximately 12 μm to approximately 80 μm.

The sprocket holes 10*z* are through holes that engage the teeth of a sprocket driven by a motor to feed the substrate 10-1 at a given pitch when the substrate 10-1 is attached to various kinds of manufacturing apparatuses in the process of manufacturing the coil substrate 1. The width of the substrate 10-1 (the dimension in a direction (the Y direction) perpendicular to a direction in which the sprocket holes 10*z* are arranged) is so determined as to correspond to a manufacturing apparatus to which the substrate 10-1 is attached.

The width of the substrate 10-1 may be, for example, approximately 40 mm to approximately 90 mm. On the other hand, the length of the substrate 10-1 (the dimension in a direction (the X direction) in which the sprocket holes 10*z* are arranged) may be determined as desired. While arranged in five rows and ten columns in FIG. 4A, the individual regions C may be arranged in, for example, approximately several hundred columns by elongating the substrate 10-1.

Figure 5A:
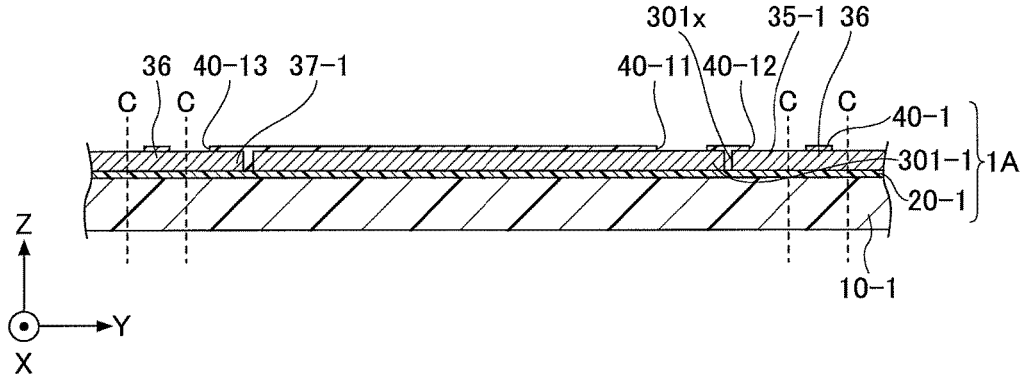
FIGS. 5A and 5B are diagrams depicting the method of manufacturing a coil substrate according to the embodiment.
Figure 5B:
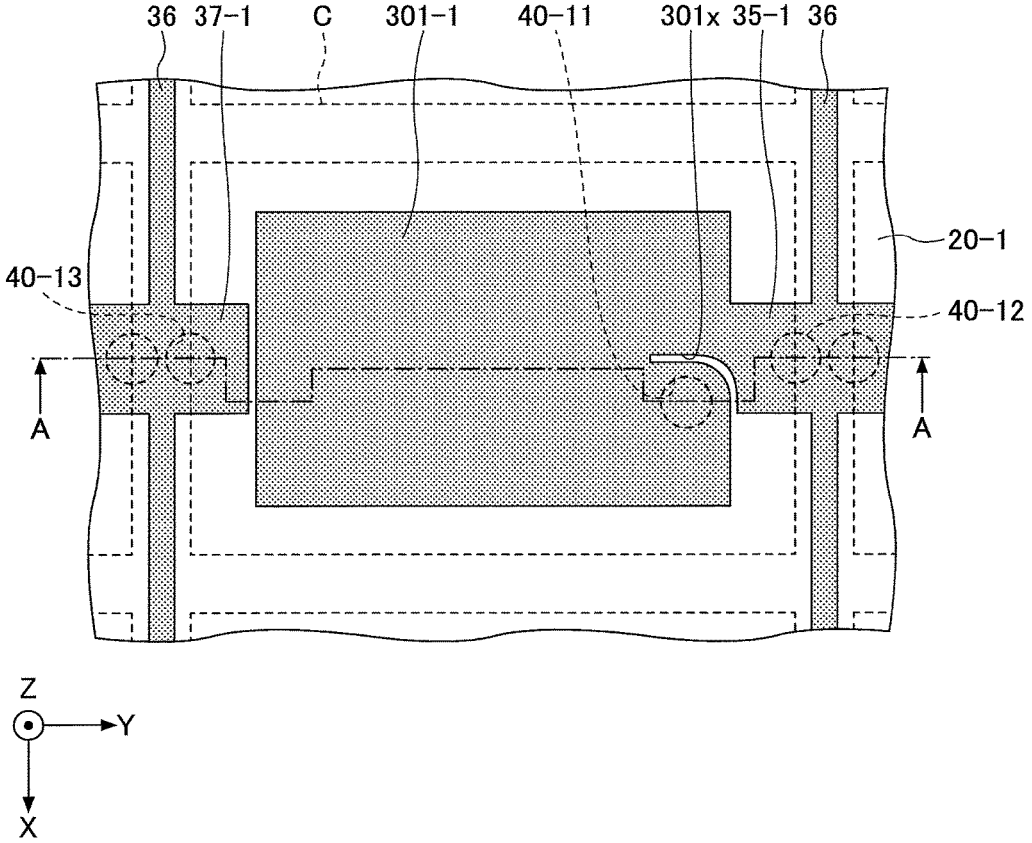

Next, in the process depicted in FIGS. 5A and 5B, the metal foil 300-1 illustrated in FIG. 4B is patterned to form the first structure 1A in which the metal layer 301-1, the connection part 35-1, and the connection part 37-1 are formed in each individual region C on the substrate 10-1. Furthermore, the metal foil 300-1 illustrated in FIG. 4B is patterned to form bus lines 36 connected to the connection parts 35-1 and 37-1 on the substrate 10-1. FIG. 5B is a plan view and FIG. 5A is a cross-sectional view taken along a line A-A in FIG. 5B. The metal layer 301-1 is ultimately subjected to a forming process (such as punching) to become the first conductive track 30-1 that is a first-layer conductive track (approximately one turn) to form part of a coil.

The bus lines 36 are used to supply electric current for electroplating in a subsequent process, and are electrically connected to the metal layer 301-1, the connection part 35-1, and the connection part 37-1 of each of the individual regions C. The bus lines 36 do not have to be formed if no electroplating is performed in a subsequent process. A cut 301$x$ is formed in the metal layer 301-1. The cut 301$x$ is provided to facilitate formation of the helical shape of the coil when shaping the coil substrate 1 (for example, by punching) in a subsequent process.

The metal foil 300-1 may be patterned by, for example, photolithography. That is, the metal foil 300-1 is patterned by applying a photosensitive resist on the metal foil 300-1, forming openings in the resist by exposing to light and developing predetermined regions, and removing the metal foil 300-1 exposed in the openings by etching. The metal layers 301-1, the connection parts 35-1, the connection parts 37-1, and the bus lines 36 are monolithically formed. In each individual region C, however, the metal layer 301-1 and the connection part 37-1 are electrically disconnected.

Thereafter, the metal layer 301-1, the connection part 35-1, and the connection part 37-1 of each individual region C and the bus lines 36 are covered with the insulating layer 40-1. The insulating layer 40-1 may be formed with a laminate of a photosensitive epoxy insulating resin in the form of a film, for example. Alternatively, the insulating layer 40-1 may be formed by applying a photosensitive epoxy insulating resin in the form of liquid or paste. The thickness of the insulating layer 40-1 (measured from the upper surface of the metal layer 301-1) may be, for example, approximately 5 μm to approximately 30 μm.

Thereafter, in each individual region C, the opening 40-11 that exposes the upper surface of the metal layer 301-1, the opening 40-12 that exposes the upper surface of the connection part 35-1, and the opening 40-13 that exposes the upper surface of the connection part 37-1 are formed in the insulating layer 40-1 of the first structure 1A. The planar shape of the openings 40-11, 40-12, and 40-13 may be, for example, a circular shape of approximately 150 μm in diameter. The openings 40-11, 40-12, and 40-13 may be formed by, for example, press working or laser processing. Alternatively, the openings 40-11, 40-12, and 40-13 may be formed by exposing to light and developing the photosensitive insulating layer 40-1. In FIG. 5B, a depiction of the insulating layer 40-1 is omitted. Furthermore, in FIG. 5B, regions of the metal layer 301-1 that correspond to the openings 40-11, 40-12, and 40-13 are indicated by a dashed line.

Figure 6A:
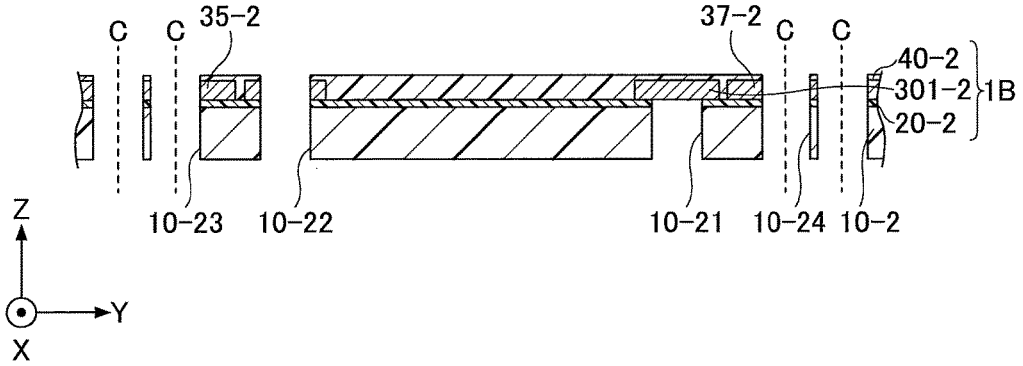
FIGS. 6A and 6B are diagrams depicting the method of manufacturing a coil substrate according to the embodiment.
Figure 6B:
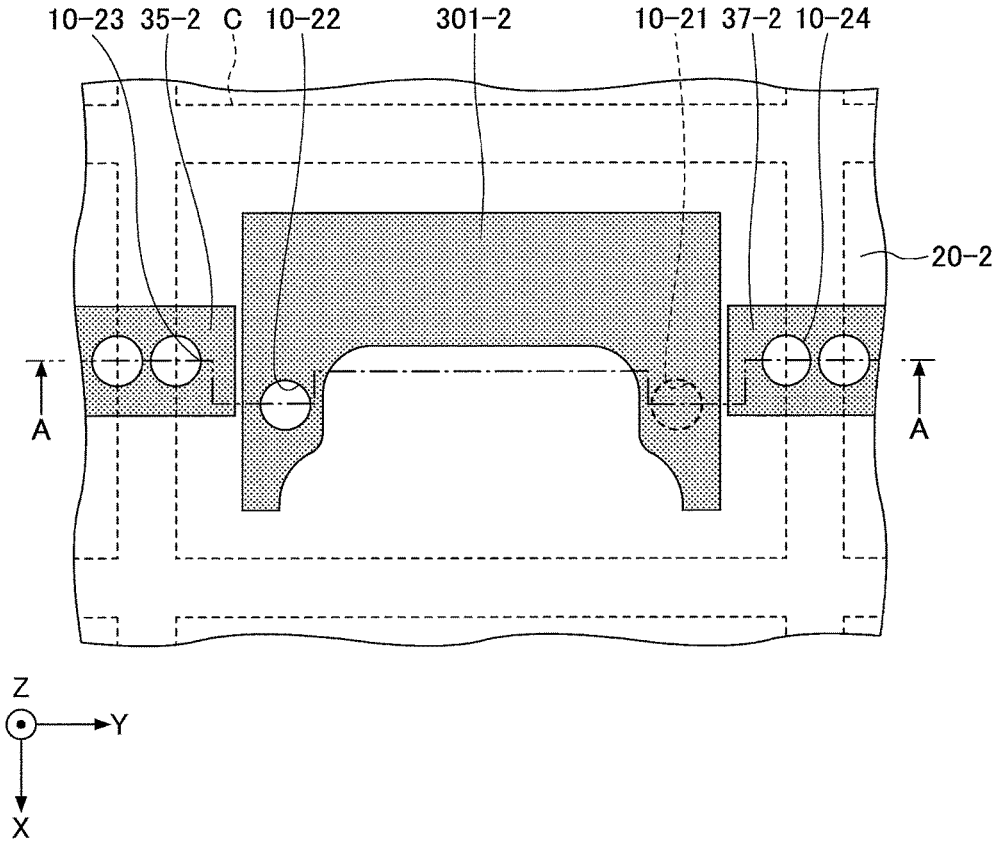

Next, in the process depicted in FIGS. 6A and 6B, the second structure 1B, in which a metal layer 301-2, the connection part 35-2, and the connection part 37-2 are formed, is formed in each individual region C on a substrate 10-2 (second substrate). FIG. 6B is a plan view and FIG. 6A is a cross-sectional view taken along a line A-A in FIG. 6B. The metal layer 301-2 is ultimately subjected to a forming process (such as punching) to become the second conductive track 30-2 that is a second-layer conductive track (approximately ¾ turns) to form part of the coil. Specifically, in the same manner as in the process depicted in FIGS. 4A and 4B, after formation of sprocket holes in the substrate 10-2, the insulating layer 20-2 and a metal foil (not depicted) are successively stacked on the substrate 10-2 except for end regions where the sprocket holes are formed.

Then, the metal foil is patterned in the same manner as in the process depicted in FIGS. 5A and 5B, so that the metal layer 301-2 patterned as depicted in FIG. 6B is formed on the insulating layer 20-2. Furthermore, the metal foil is patterned in the same manner as in the process depicted in FIGS. 5A and 5B, so that the connection part 35-2 is formed across a predetermined gap from a first end of the metal layer 301-2, and the connection part 37-2 is formed across a predetermined gap from a second end of the metal layer 301-2. Thereafter, the metal layer 301-2, the connection part 35-2, and the connection part 37-2 of each individual region C are covered with the insulating layer 40-2. Then, with respect to each individual region C, the opening 10-21 that exposes the bottom surface of the metal layer 301-2 is formed through the substrate 10-2 and the insulating layer 20-2 of the second structure 1B. Furthermore, the opening 10-22 (through hole) that penetrates through the substrate 10-2 and the insulating layer 20-2, the metal layer 301-2, and the insulating layer 40-2 of the second structure 1B is formed. Furthermore, an opening 10-23 (through hole) that penetrates through the substrate 10-2 and the insulating layer 20-2, the insulating layer 40-2, and the connection part 35-2 of the second structure 1B is formed. Furthermore, an opening 10-24 (through hole) that penetrates through the substrate 10-2 and the insulating layer 20-2, the insulating layer 40-2, and the connection part 37-2 of the second structure 1B is formed.

The planar shape of each of the openings 10-21, 10-22, 10-23, and 10-24 may be, for example, a circular shape of approximately 150 μm in diameter. The openings 10-21, 10-22, 10-23, and 10-24 may be formed by, for example, press working or laser processing. The openings 10-22, 10-23, and 10-24 are formed at positions that coincide with the openings 40-11, 40-12, and 40-13, respectively, in a plan view when the first structure 1A and the second structure 1B are stacked in a predetermined direction. In FIG. 6B, a depiction of the insulating layer 40-2 is omitted. Furthermore, in FIG. 6B, a region of the metal layer 301-2 that corresponds to the opening 10-21 is indicated by a dashed line.

The shape, thickness, material, etc., of a substrate 10–n (where n is a natural number greater than or equal to 2) and the shape, thickness, material, etc., of metal foil 300–n (where n is a natural number greater than or equal to 2) are the same as those of the substrate 10-1 and the metal foil 300-1, respectively, unless otherwise specified.

Figure 7A:
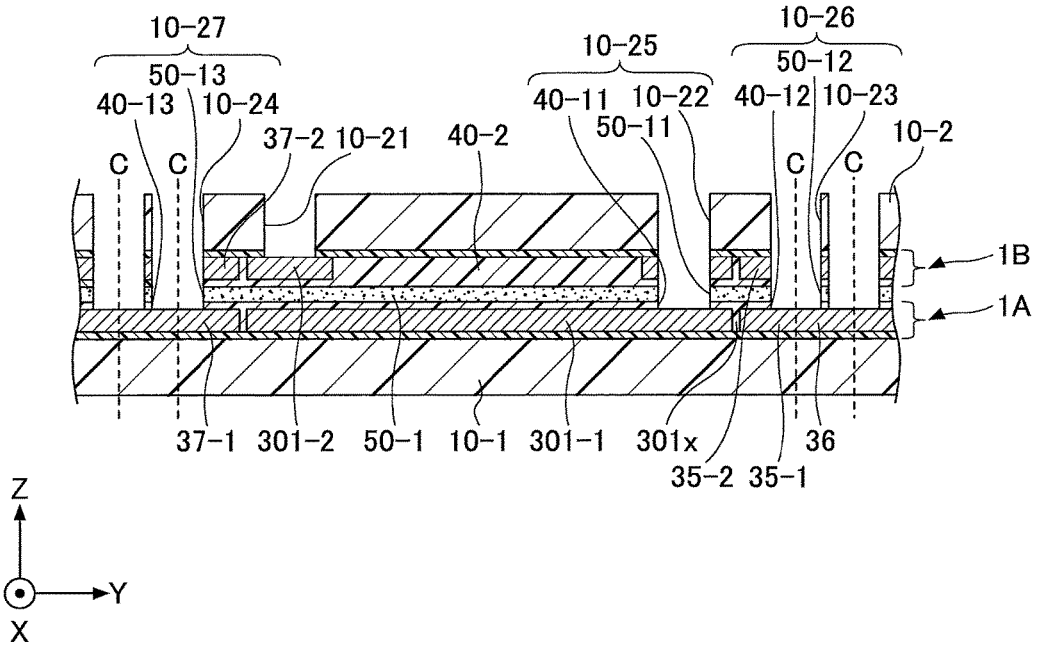
FIGS. 7A through 7C are diagrams depicting the method of manufacturing a coil substrate according to the embodiment.
Figure 7B:
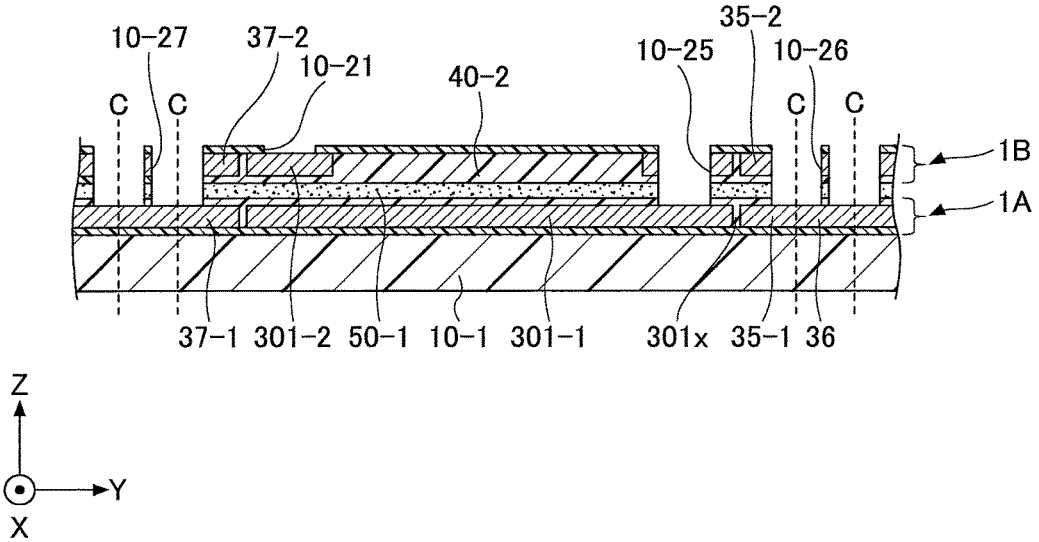
Figure 7C:
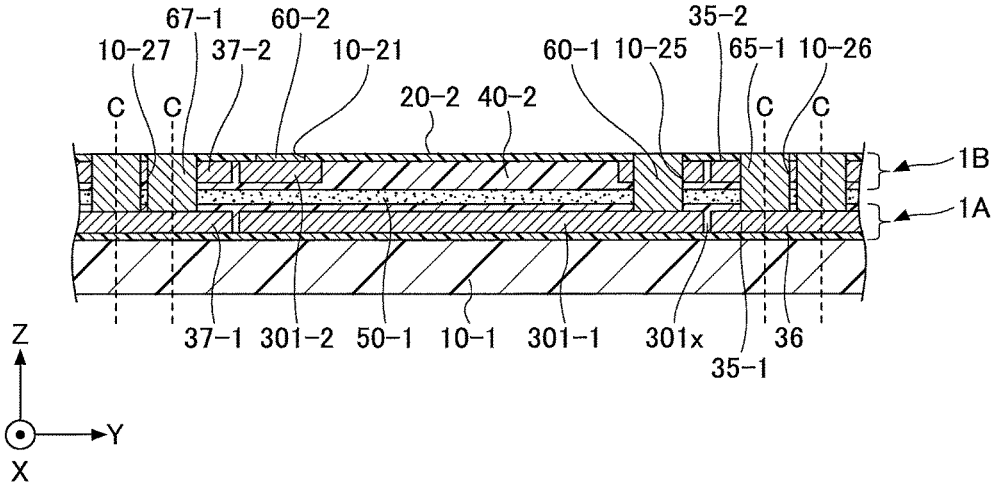

Next, the process depicted in FIGS. 7A through 7C is described. FIGS. 7A through 7C are cross-sectional views that correspond to FIG. 5A. First, in the process depicted in FIG. 7A, the adhesive layer 50-1 is prepared, and openings 50-11, 50-12 and 50-13 (each of which is a through hole) penetrating through the adhesive layer 50-1 are formed by press working or laser processing in each individual region C. The openings 50-11, 50-12, and 50-13 are formed at positions that coincide with the openings 40-11 and 10-22, the openings 40-12 and 10-23, and the openings 40-13 and 10-24, respectively, in a plan view when the first structure 1A and the second structure 1B are stacked through the adhesive layer 50-1 in a predetermined direction. For example, a (thermosetting) heat-resistant adhesive of an insulating resin, such as an epoxy adhesive or a polyimide adhesive, may be used as the adhesive layer 50-1. For example, the adhesive layer 50-1 may be formed with a laminate of an adhesive in the form of a film. Alternatively, the adhesive layer 50-1 may be formed by applying an adhesive in the form of liquid or paste. The thickness of the adhesive layer 50-1 may be, for example, approximately 10 μm to approximately 40 μm.

Next, the substrate 10-2 and the second structure 1B are turned upside down from the state depicted in FIGS. 6A and 6B to be stacked on the first structure 1A through the adhesive layer 50-1. That is, the first structure 1A and the second structure 1B are on opposite sides of the adhesive layer 50-1 so that the substrate 10-1 and the substrate 10-2 face outward. Thereafter, the adhesive layer 50-1 is cured. At this point, the openings 40-11, 50-11, and 10-22 communicate with one another to form the single opening 10-25, so that the upper surface of the metal layer 301-1 is exposed at the bottom of the opening 10-25. Furthermore, the openings 40-12, 50-12, and 10-23 communicate with one another to form the single opening 10-26, so that the upper surface of the connection part 35-1 is exposed at the bottom of the opening 10-26. Furthermore, the openings 40-13, 50-13, and 10-24 communicate with one another to form the single opening 10-27, so that the upper surface of the connection part 37-1 is exposed at the bottom of the opening 10-27.

Alternatively, in the process depicted in FIGS. 6A, 6B and 7A, the substrate 10-2 and the second structure 1B may be stacked on the first structure 1A through the adhesive layer 50-1 before providing the openings 10-21, 10-22, 10-23, 10-24, 50-11, 50-12 and 50-13, and the openings 10-21, 10-22, 10-23, 10-24, 50-11, 50-12 and 50-13 may thereafter be provided by press working or laser processing.

Next, in the process depicted in FIG. 7B, the substrate 10-2 is removed (delaminated) from the insulating layer 20-2 of the second structure 1B of each individual region C. For example, the substrate 10-2 may be mechanically delaminated from the insulating layer 20-2 of the second structure 1B.

Next, in the process depicted in FIG. 7C, the via 60-1 formed of, for example, copper (Cu) is formed on the exposed metal layer 301-1 at the bottom of the opening 10-25. The metal layer 301-1 and the metal layer 301-2 are connected in series through the via 60-1. Furthermore, the via 65-1 formed of, for example, copper (Cu) is formed on the connection part 35-1 exposed at the bottom of the opening 10-26. The connection part 35-1 and the connection part 35-2 are electrically connected through the via 65-1. Furthermore, the via 67-1 formed of, for example, copper (Cu) is formed on the connection part 37-1 exposed at the bottom of the opening 10-27. The connection part 37-1 and the connection part 37-2 are electrically connected through the via 67-1. Furthermore, the via 60-2 formed of, for example, copper (Cu) is formed on the metal layer 301-2 exposed at the bottom of the opening 10-21. The metal layer 301-2 and the via 60-2 are electrically connected.

The vias 60-1, 60-2, 65-1 and 67-1 may be formed by causing copper (Cu) or the like to deposit from the metal layers 301-1 and 301-2 by, for example, electroplating, using the bus lines 36 to supply electric current. The vias 60-1, 60-2, 65-1 and 67-1 may alternatively be formed by filling the openings 10-25, 10-21, 10-26 and 10-27, respectively, with paste of metal such as copper (Cu). The upper surfaces of the vias 60-1, 60-2, 65-1 and 67-1 may be substantially flush with the upper surface of the insulating layer 20-2. As a result of this process, the metal layer 301-1, the via 60-1, and the metal layer 301-2 are connected in series in a laminate where the second structure 1B is stacked on the first structure 1A in each individual region C. This series connection of the laminate is ultimately subjected to a forming process (such as punching) to become a coil of approximately one and ¾ turns.

Figure 8A:
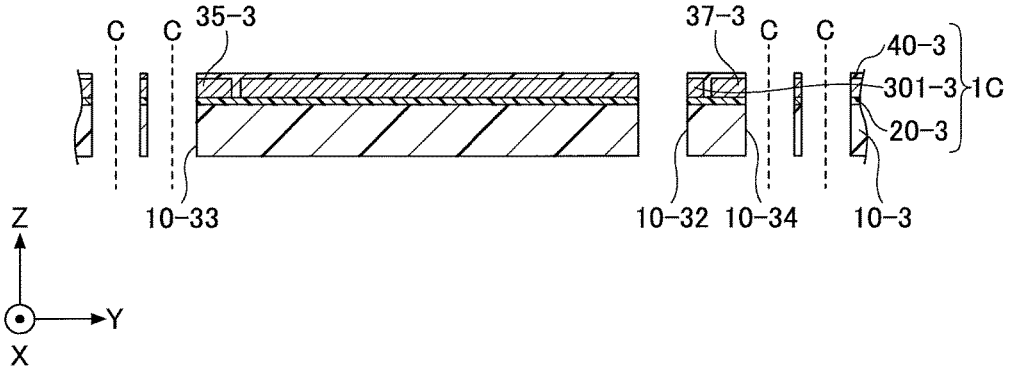
FIGS. 8A through 8C are diagrams depicting the method of manufacturing a coil substrate according to the embodiment.
Figure 8B:
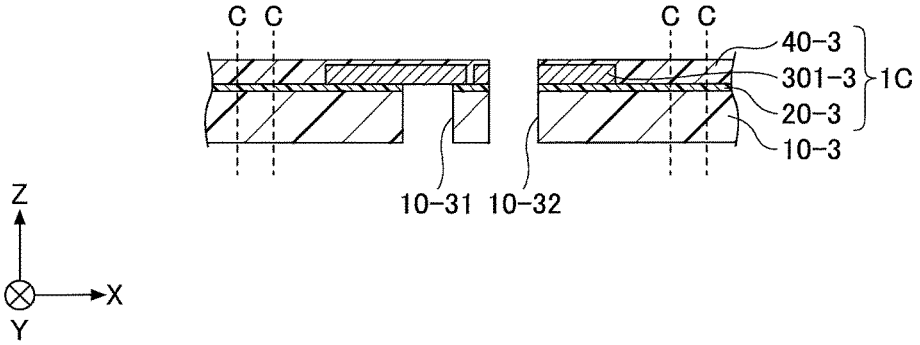
Figure 8C:
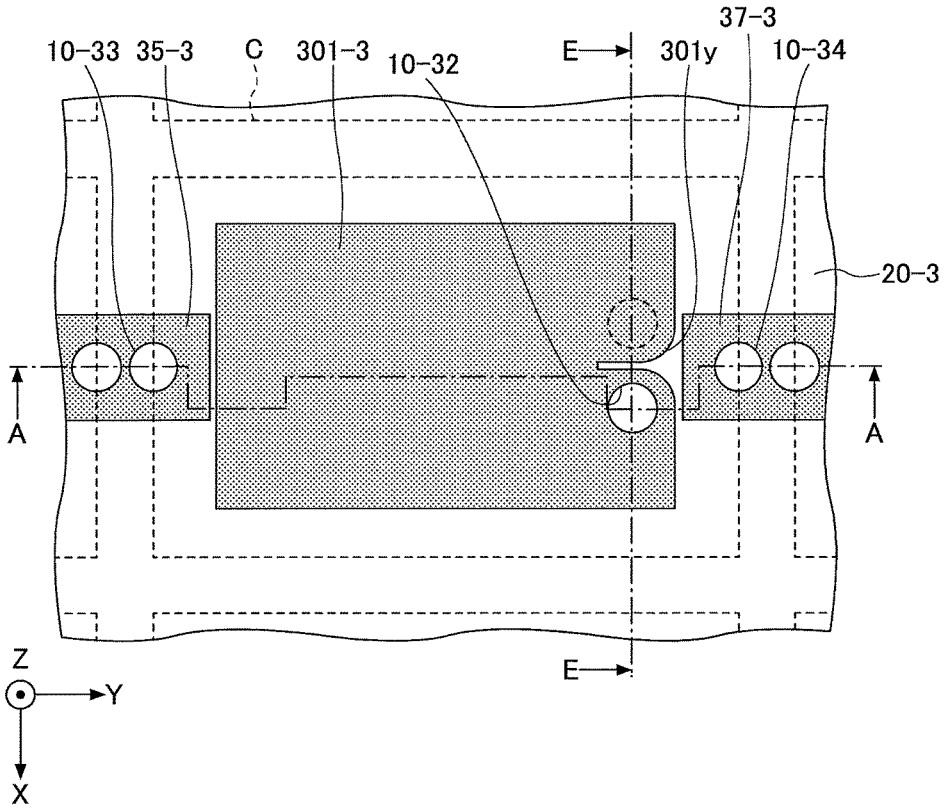

Next, in the process depicted in FIGS. 8A through 8C, the third structure 1C, in which a metal layer 301-3, the connection part 35-3, and the connection part 37-3 are formed, is formed in each individual region C on a substrate 10-3 in the same manner as in the process depicted in FIGS. 6A and 6B. FIG. 8C is a plan view, FIG. 8A is a cross-sectional view taken along a line A-A in FIG. 8C, and FIG. 8B is a cross-sectional view taken along a line E-E in FIG. 8C. The metal layer 301-3 is ultimately subjected to a forming process (such as punching) to become the third conductive track 30-3 that is a third-layer conductive track (approximately one turn) to form part of the coil. A cut 301*y* is formed in the metal layer 301-2. The cut 301*y* is provided to facilitate formation of the helical shape of the coil when shaping the coil substrate 1 (for example, by punching) in a subsequent process.

Next, with respect to each individual region C, the opening 10-31 that exposes the bottom surface of the metal layer 301-3 is formed through the substrate 10-3 and the insulating layer 20-3 of the third structure 1C. Furthermore, the opening 10-32 (through hole) that penetrates through the substrate 10-3 and the insulating layer 20-3, the metal layer 301-3, and the insulating layer 40-3 of the third structure 1C is formed. Furthermore, an opening 10-33 (through hole) that penetrates through the substrate 10-3 and the insulating layer 20-3, the insulating layer 40-3, and the connection part 35-3 of the third structure 1C is formed. Furthermore, an opening 10-34 (through hole) that penetrates through the substrate 10-3 and the insulating layer 20-3, the insulating layer 40-3, and the connection part 37-3 of the third structure 1C is formed.

The planar shape and the processing method of the openings 10-31, 10-32, 10-33 and 10-34 may be the same as those of, for example, the opening 10-21. The openings 10-32, 10-33 and 10-34 are formed at positions that coincide with the vias 60-2, 65-1 and 67-1, respectively, in a plan view when the second structure 1B and the third structure 1C are stacked in a predetermined direction. In FIG. 8C, a depiction of the insulating layer 40-3 is omitted. Furthermore, in FIG. 8C, a region of the metal layer 301-3 that corresponds to the opening 10-31 is indicated by a dashed line.

Figure 9A:
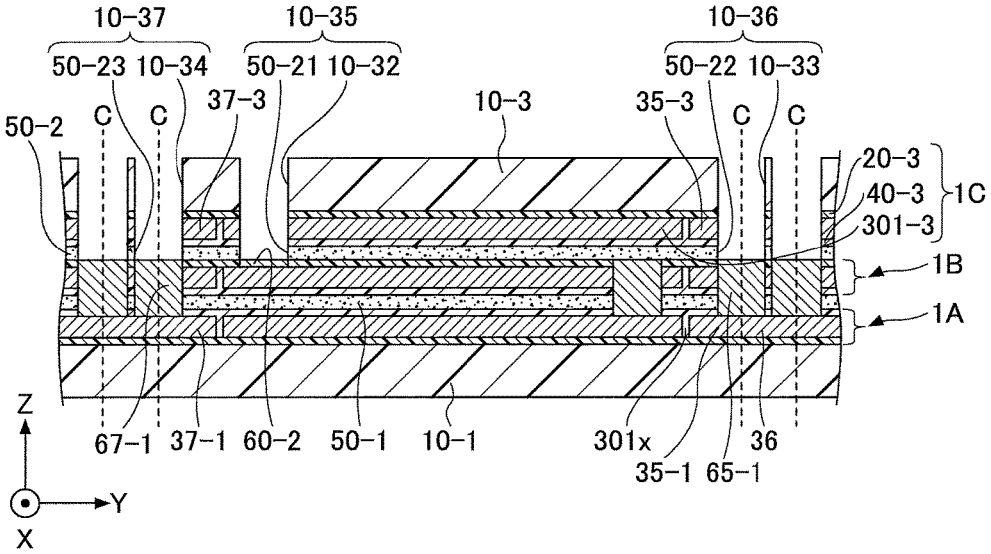
FIGS. 9A through 9C are diagrams depicting the method of manufacturing a coil substrate according to the embodiment.
Figure 9B:
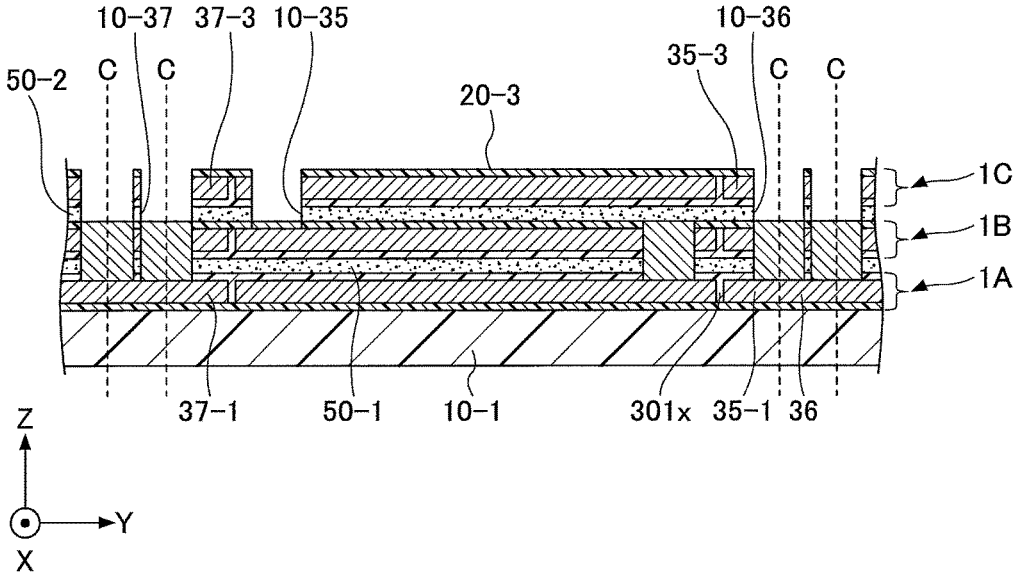
Figure 9C:
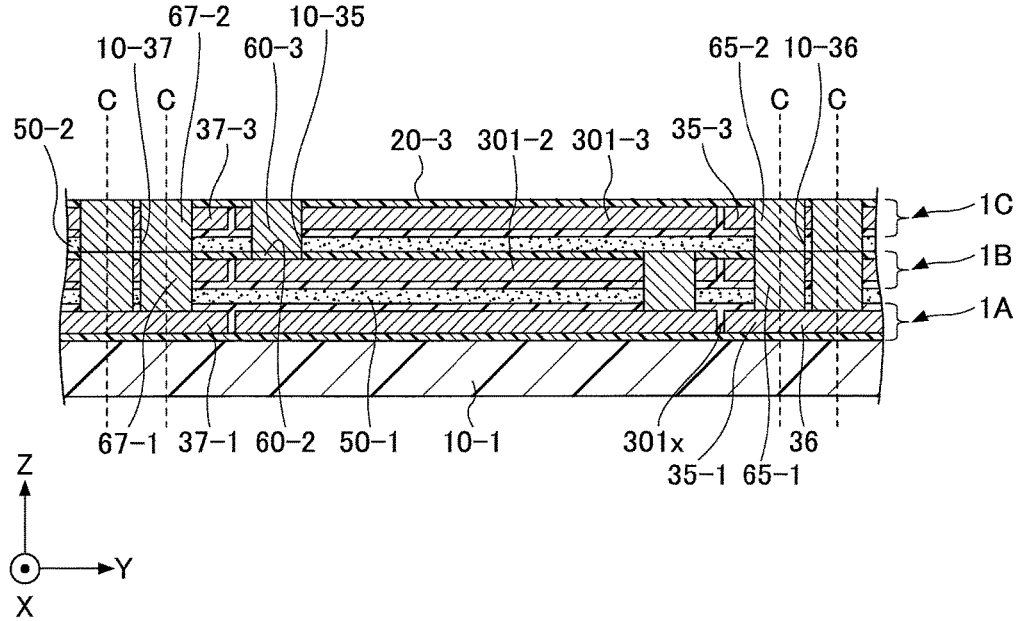

Next, the process depicted in FIGS. 9A through 9C is described. FIGS. 9A through 9C are cross-sectional views that correspond to FIG. 7A. First, in the process depicted in FIG. 9A, the adhesive layer 50-2 is prepared, and openings 50-21, 50-22 and 50-23 (each of which is a through hole) penetrating through the adhesive layer 50-2 are formed in each individual region C. The openings 50-21, 50-22, and 50-23 are formed at positions that coincide with the vias 60-2, 65-1 and 67-1, respectively, in a plan view when the second structure 1B and the third structure 1C are stacked through the adhesive layer 50-2 in a predetermined direction. The shape, thickness, material, etc., of the adhesive layer 50–n (where n is a natural number greater than or equal to 2) are the same as those of the adhesive layer 50-1 unless otherwise specified.

Next, the substrate 10-3 and the third structure 1C are turned upside down from the state depicted in FIGS. 8A through 8C to be stacked on the second structure 1B through the adhesive layer 50-2. That is, the second structure 1B and the third structure 1C are on opposite sides of the adhesive layer 50-2 so that the substrate 10-1 and the substrate 10-3 face outward. Thereafter, the adhesive layer 50-2 is cured. At this point, the openings 50-21 and 10-32 communicate with each other to form the single opening 10-35, so that the upper surface of the via 60-2 is exposed at the bottom of the opening 10-35. Furthermore, the openings 50-22 and 10-33 communicate with each other to form the single opening 10-36, so that the upper surface of the via 65-1 is exposed at the bottom of the opening 10-36. Furthermore, the openings 50-23 and 10-34 communicate with each other to form the single opening 10-37, so that the upper surface of the via 67-1 is exposed at the bottom of the opening 10-37.

Alternatively, in the process depicted in FIGS. 8A through 8C and 9A, the substrate 10-3 and the third structure 1C may be stacked on the second structure 1B through the adhesive layer 50-2 before providing the openings 10-31, 10-32, 10-33, 10-34, 50-21, 50-22 and 50-23, and the openings 10-31, 10-32, 10-33, 10-34, 50-21, 50-22 and 50-23 may thereafter be provided.

Next, in the process depicted in FIG. 9B, the substrate 10-3 is removed (delaminated) from the insulating layer 20-3 of the third structure 1C of each individual region C. For example, the substrate 10-3 may be mechanically delaminated from the insulating layer 20-3 of the third structure 1C.

Next, in the process depicted in FIG. 9C, the via 60-3 is formed on the via 60-2 exposed at the bottom of the opening 10-35. The metal layer 301-2 and the metal layer 301-3 are connected in series through the vias 60-2 and 60-3. Furthermore, the via 60-4 (not depicted) is formed on the metal layer 301-3 exposed at the bottom of the opening 10-31 (not depicted). The metal layer 301-3 and the via 60-4 are electrically connected. Furthermore, the via 65-2 is formed on the via 65-1 exposed at the bottom of the opening 10-36. The connection part 35-2 and the connection part 35-3 are electrically connected through the via 65-2. Furthermore, the via 67-2 is formed on the via 67-1 exposed at the bottom of the opening 10-37. The connection part 37-2 and the connection part 37-3 are electrically connected through the via 67-2.

Like the via 60-1, the vias 60-3, 60-4, 65-2 and 67-2 may be formed by electroplating using the bus lines 36 to supply electric current or by the filling of metal paste, for example. Suitable materials for the vias 60-3, 60-4, 65-2 and 67-2 include, for example, copper (Cu). The upper surfaces of the vias 60-3, 60-4, 65-2 and 67-2 may be substantially flush with the upper surface of the insulating layer 20-3. As a result of this process, the metal layers 301-1, 301-2 and 301-3 are connected in series through the vias 60-1 through 60-3 in a laminate where the first through third structures 1A through 1C are stacked in each individual region C. This series connection of the laminate is ultimately subjected to a forming process (such as punching) to become a coil of approximately two and ¾ turns.

Figure 10A:
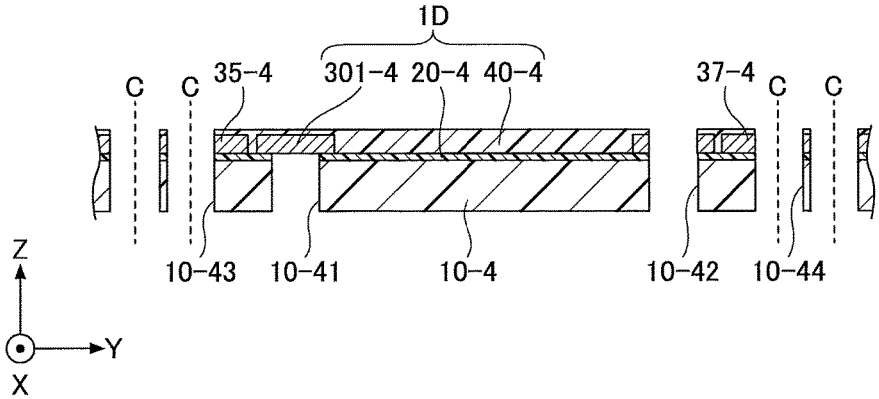
FIGS. 10A and 10B are diagrams depicting the method of manufacturing a coil substrate according to the embodiment.
Figure 10B:
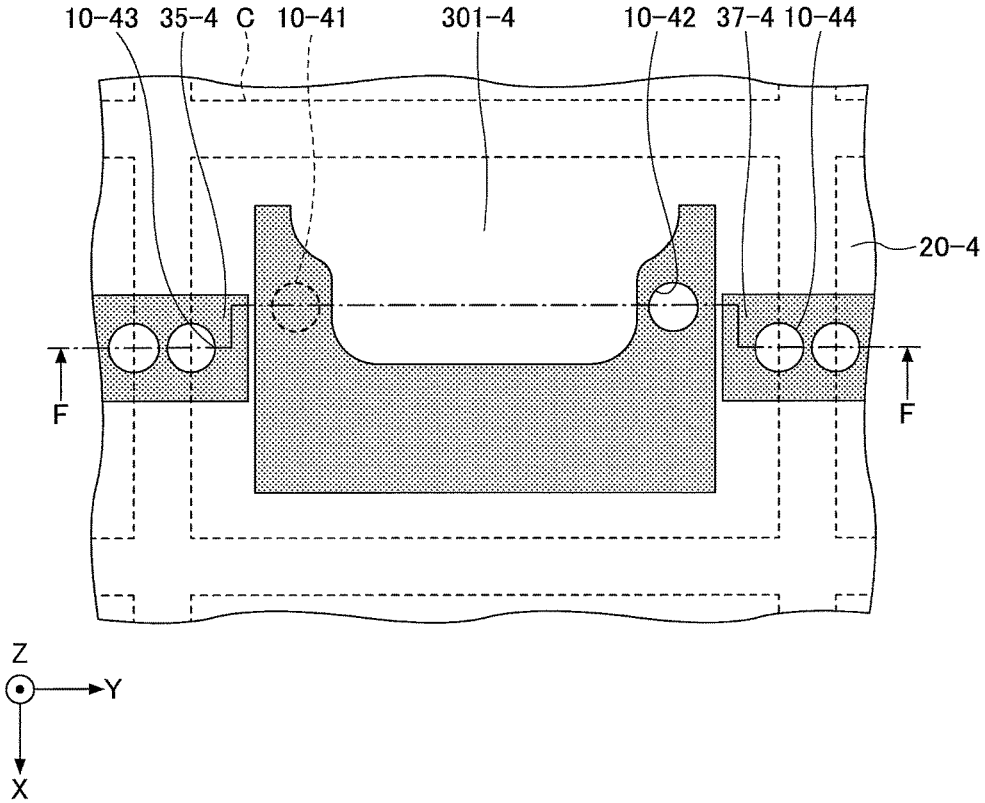

Next, in the process depicted in FIGS. 10A and 10B, the fourth structure 1D, in which a metal layer 301-4, the connection part 35-4, and the connection part 37-4 are formed, is formed in each individual region C on a substrate 10-4 in the same manner as in the process depicted in FIGS. 6A and 6B. FIG. 10B is a plan view and FIG. 10A is a cross-sectional view taken along a line F-F in FIG. 10B. The metal layer 301-4 is ultimately subjected to a forming process (such as punching) to become the fourth conductive track 30-4 that is a fourth-layer conductive track (approximately ¾ turns) to form part of the coil.

Next, with respect to each individual region C, the opening 10-41 that exposes the bottom surface of the metal layer 301-4 is formed through the substrate 10-4 and the insulating layer 20-4 of the fourth structure 1D. Furthermore, the opening 10-42 (through hole) that penetrates through the substrate 10-4 and the insulating layer 20-4, the metal layer 301-4, and the insulating layer 40-4 of the fourth structure 1D is formed. Furthermore, an opening 10-43 (through hole) that penetrates through the substrate 10-4 and the insulating layer 20-4, the insulating layer 40-4, and the connection part 35-4 of the fourth structure 1D is formed. Furthermore, an opening 10-44 (through hole) that penetrates through the substrate 10-4 and the insulating layer 20-4, the insulating layer 40-4, and the connection part 37-4 of the fourth structure 1D is formed.

The planar shape and the processing method of the openings 10-41, 10-42, 10-43 and 10-44 may be the same as those of, for example, the opening 10-21. The openings 10-42, 10-43 and 10-44 are formed at positions that coincide with the vias 60-4, 65-2 and 67-2, respectively, in a plan view when the third structure 1C and the fourth structure 1D are stacked in a predetermined direction. In FIG. 10B, a depiction of the insulating layer 40-4 is omitted. Furthermore, in FIG. 10B, a region of the metal layer 301-4 that corresponds to the opening 10-41 is indicated by a dashed line.

Figure 11A:
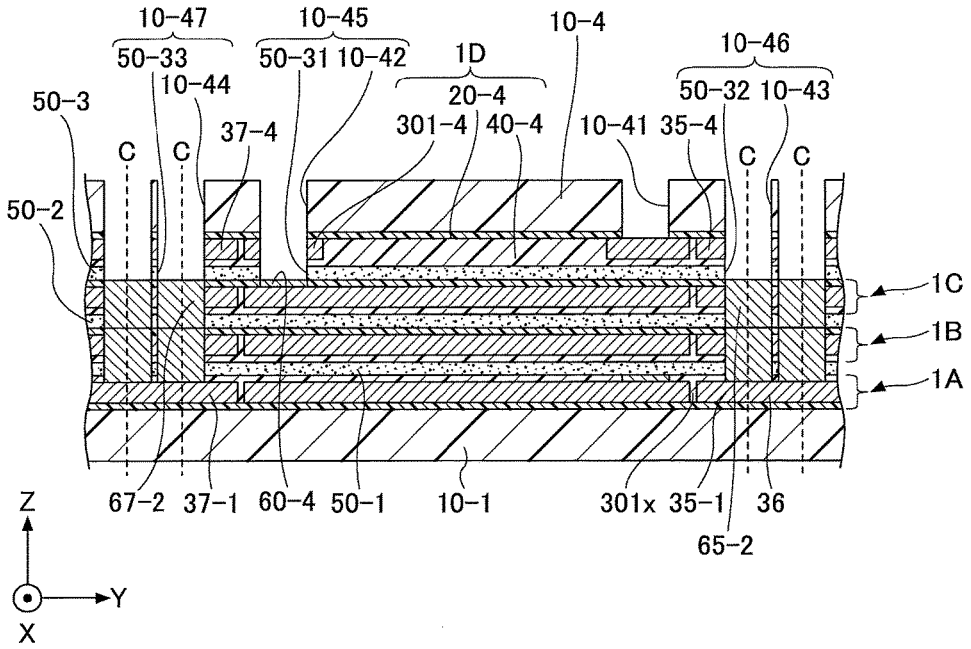
FIGS. 11A through 11C are diagrams depicting the method of manufacturing a coil substrate according to the embodiment.
Figure 11B:
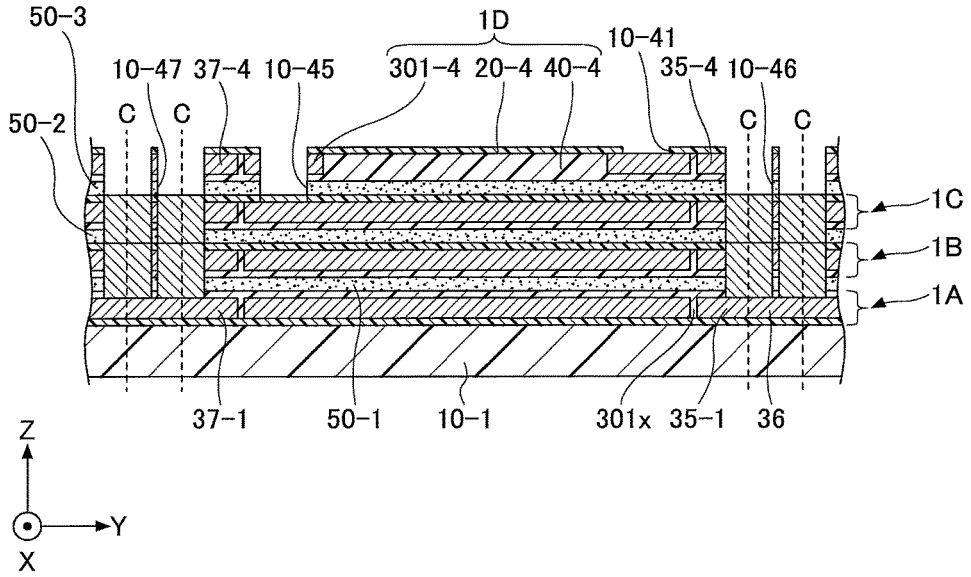
Figure 11C:
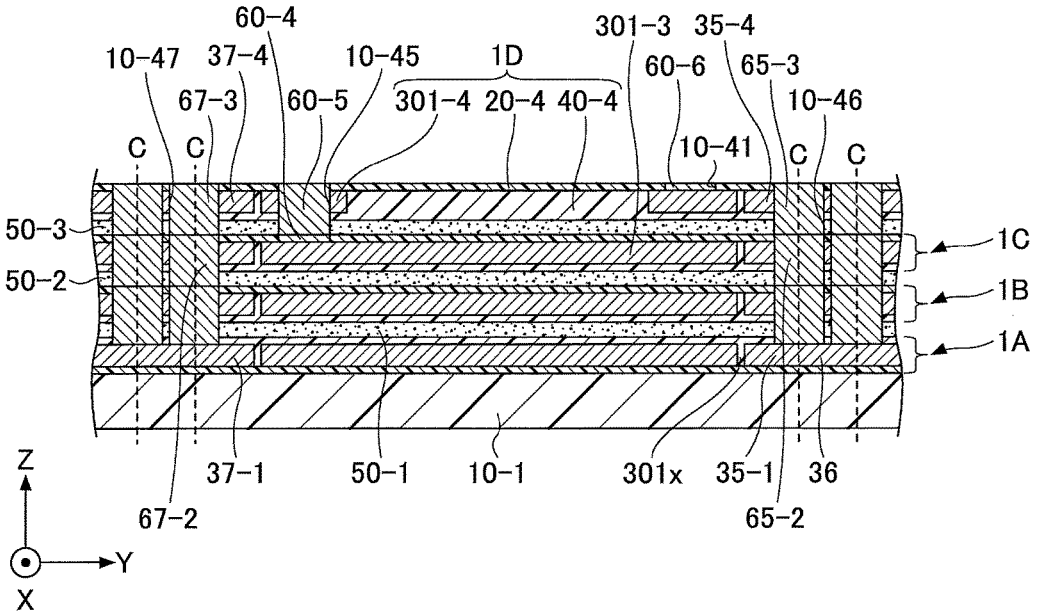

Next, the process depicted in FIGS. 11A through 11C is described. FIGS. 11A through 11C are cross-sectional views that correspond to FIG. 10A. First, in the process depicted in FIG. 11A, the adhesive layer 50-3 is prepared, and openings 50-31, 50-32 and 50-33 (each of which is a through hole) penetrating through the adhesive layer 50-3 are formed in each individual region C. The openings 50-31, 50-32, and 50-33 are formed at positions that coincide with the vias 60-4, 65-2 and 67-2, respectively, in a plan view when the third structure 1C and the fourth structure 1D are stacked through the adhesive layer 50-3 in a predetermined direction.

Next, the substrate 10-4 and the fourth structure 1D are turned upside down from the state depicted in FIGS. 10A and 10B to be stacked on the third structure 1C through the adhesive layer 50-3. That is, the third structure 1C and the fourth structure 1D are on opposite sides of the adhesive layer 50-3 so that the substrate 10-1 and the substrate 10-4 face outward. Thereafter, the adhesive layer 50-3 is cured. At this point, the openings 50-31 and 10-42 communicate with each other to form the single opening 10-45, so that the upper surface of the via 60-4 is exposed at the bottom of the opening 10-45. Furthermore, the openings 50-32 and 10-43 communicate with each other to form the single opening 10-46, so that the upper surface of the via 65-2 is exposed at the bottom of the opening 10-46. Furthermore, the openings 50-33 and 10-44 communicate with each other to form the single opening 10-47, so that the upper surface of the via 67-2 is exposed at the bottom of the opening 10-47.

Alternatively, in the process depicted in FIGS. 10A, 10B and 11A, the substrate 10-4 and the fourth structure 1D may be stacked on the third structure 1C through the adhesive layer 50-3 before providing the openings 10-41, 10-42, 10-43, 10-44, 50-31, 50-32 and 50-33, and the openings 10-41, 10-42, 10-43, 10-44, 50-31, 50-32 and 50-33 may thereafter be provided.

Next, in the process depicted in FIG. 11B, the substrate 10-4 is removed (delaminated) from the insulating layer 20-4 of the fourth structure 1D of each individual region C. For example, the substrate 10-4 may be mechanically delaminated from the insulating layer 20-4 of the fourth structure 1D.

Next, in the process depicted in FIG. 11C, the via 60-5 is formed on the via 60-4, exposed at the bottom of the opening 10-45. The metal layer 301-3 and the metal layer 301-4 are connected in series through the vias 60-4 and 60-5. Furthermore, the via 60-6 is formed on the metal layer 301-4 exposed at the bottom of the opening 10-41. The metal layer 301-4 and the via 60-6 are electrically connected. Furthermore, the via 65-3 is formed on the via 65-2 exposed at the bottom of the opening 10-46. The connection part 35-3 and the connection part 35-4 are electrically connected through the via 65-3. Furthermore, the via 67-3 is formed on the via 67-2 exposed at the bottom of the opening 10-47. The connection part 37-3 and the connection part 37-4 are electrically connected through the via 67-3.

Like the via 60-1, the vias 60-5, 60-6, 65-3 and 67-3 may be formed by electroplating, using the bus lines 36 to supply electric current or by the filling of metal paste, for example. Suitable materials for the vias 60-5, 60-6, 65-3 and 67-3 include, for example, copper (Cu). The upper surfaces of the vias 60-5, 60-6, 65-3 and 67-3 may be substantially flush with the upper surface of the insulating layer 20-4. As a result of this process, the metal layers 301-1, 301-2, 301-3 and 301-4 are connected in series through the vias 60-1 through 60-5 in a laminate where the first through fourth structures 1A through 1D are stacked in each individual region C. This series connection of the laminate is ultimately subjected to a forming process (such as punching) to become a coil of approximately three turns.

Figure 12A:
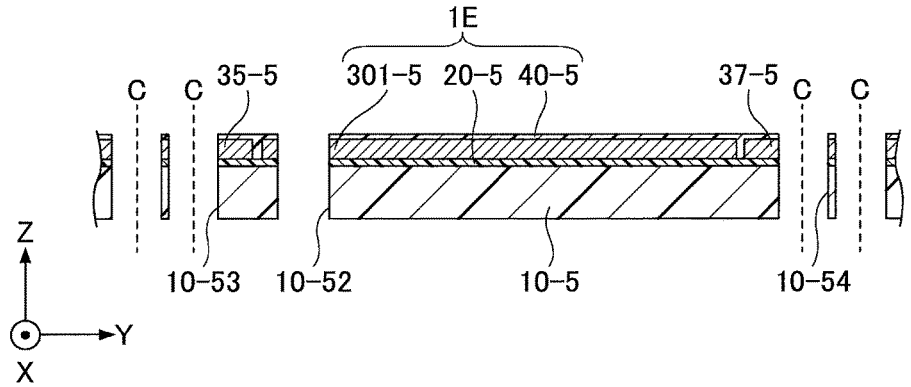
FIGS. 12A through 12C are diagrams depicting the method of manufacturing a coil substrate according to the embodiment.
Figure 12B:
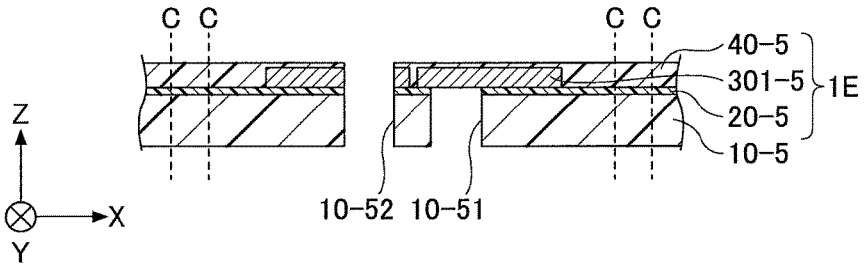
Figure 12C:
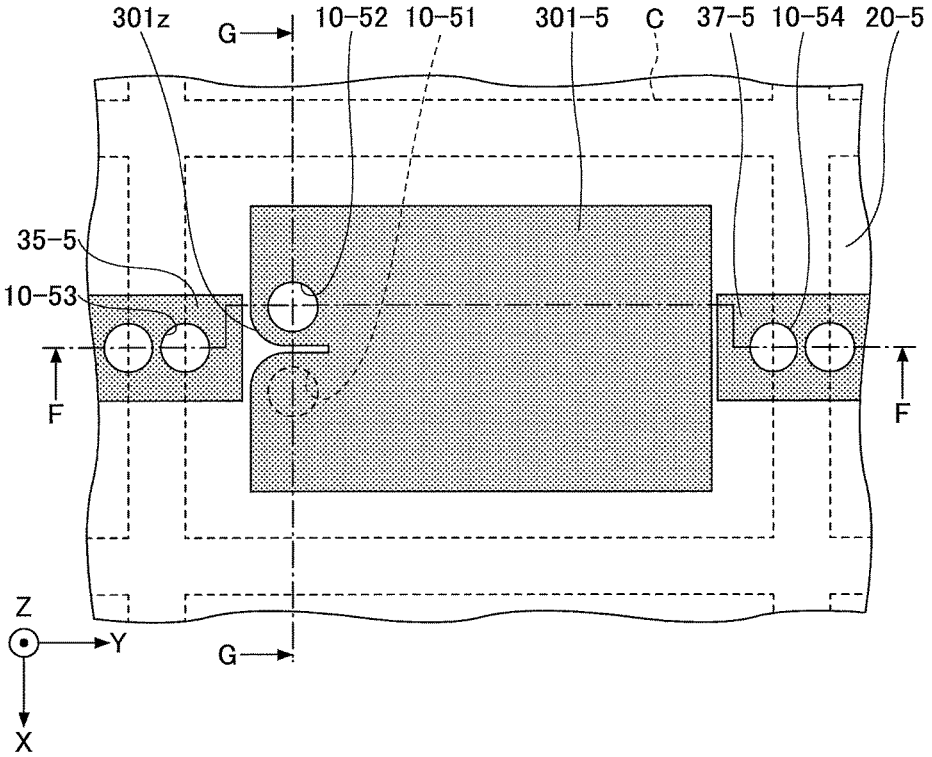

Next, in the process depicted in FIGS. 12A through 12C, the fifth structure 1E, in which a metal layer 301-5, the connection part 35-5, and the connection part 37-5 are formed, is formed in each individual region C on a substrate 10-5 in the same manner as in the process depicted in FIGS. 6A and 6B. FIG. 12C is a plan view, FIG. 12A is a cross-sectional view taken along a line F-F in FIG. 12C, and FIG. 12B is a cross-sectional view taken along a line G-G in FIG. 12C. The metal layer 301-5 is ultimately subjected to a forming process (such as punching) to become the fifth conductive track 30-5 that is a fifth-layer conductive track (approximately one turn) to form part of the coil. A cut 301*z* is formed in the metal layer 301-5. The cut 301*z* is provided to facilitate formation of the helical shape of the coil when shaping the coil substrate 1 (for example, by punching) in a subsequent process.

Next, with respect to each individual region C, the opening 10-51 that exposes the bottom surface of the metal layer 301-5 is formed through the substrate 10-5 and the insulating layer 20-5 of the fifth structure 1E. Furthermore, the opening 10-52 (through hole) that penetrates through the substrate 10-5 and the insulating layer 20-5, the metal layer 301-5, and the insulating layer 40-5 of the fifth structure 1E is formed. Furthermore, an opening 10-53 (through hole) that penetrates through the substrate 10-5 and the insulating layer 20-5, the insulating layer 40-5, and the connection part 35-5 of the fifth structure 1E is formed. Furthermore, an opening 10-54 (through hole) that penetrates through the substrate 10-5 and the insulating layer 20-5, the insulating layer 40-5, and the connection part 37-5 of the fifth structure 1E is formed.

The planar shape and the processing method of the openings 10-51, 10-52, 10-53 and 10-54 may be the same as those of, for example, the opening 10-21. The openings 10-52, 10-53 and 10-54 are formed at positions that coincide with the vias 60-6, 65-3 and 67-3, respectively, in a plan view when the fourth structure 1D and the fifth structure 1E are stacked in a predetermined direction. In FIG. 12C, a depiction of the insulating layer 40-5 is omitted. Furthermore, in FIG. 12C, a region of the metal layer 301-5 that corresponds to the opening 10-51 is indicated by a dashed line.

Figure 13A:
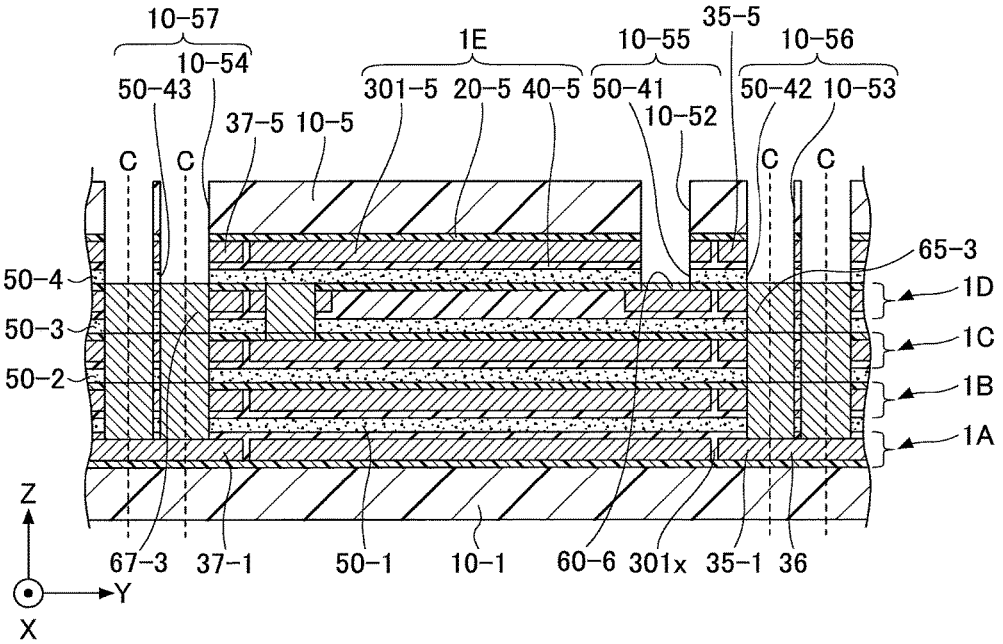
FIGS. 13A through 13C are diagrams depicting the method of manufacturing a coil substrate according to the embodiment.
Figure 13B:
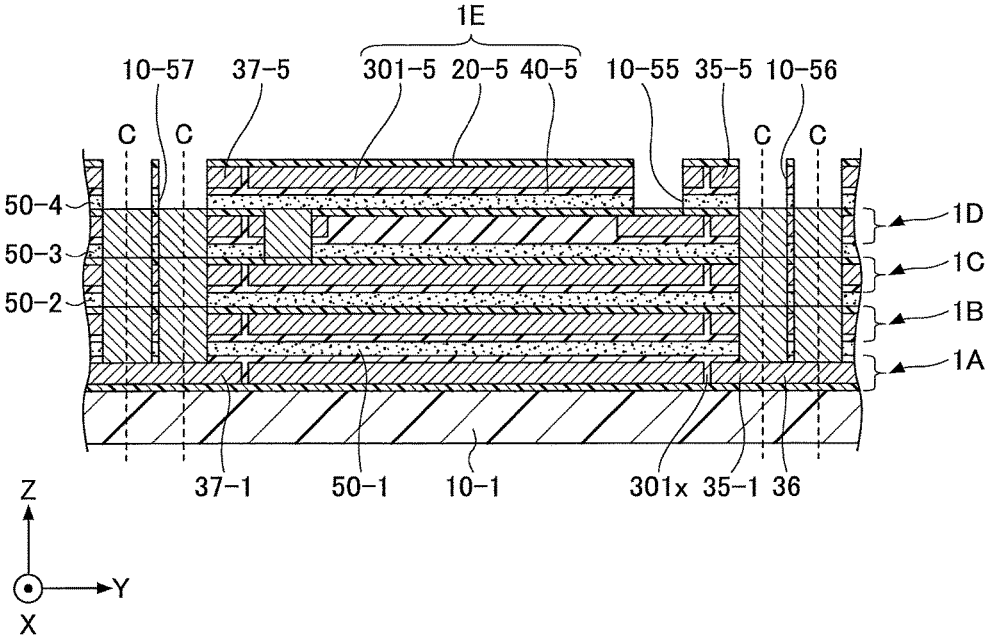
Figure 13C:
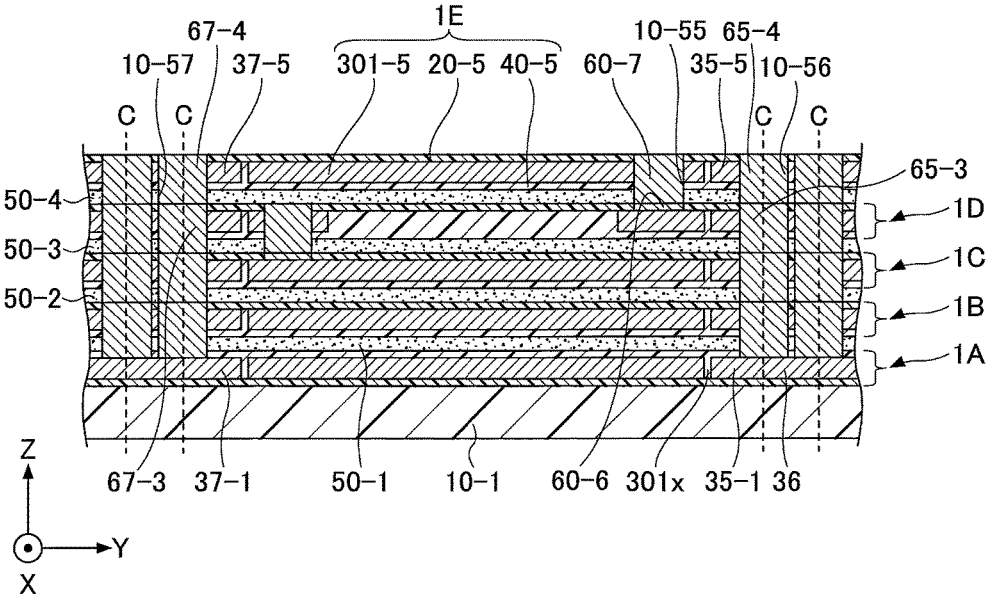

Next, the process depicted in FIGS. 13A through 13C is described. FIGS. 13A through 13C are cross-sectional views that correspond to FIGS. 11A through 11C. First, in the process depicted in FIG. 13A, the adhesive layer 50-4 is prepared, and openings 50-41, 50-42 and 50-43 (each of which is a through hole) penetrating through the adhesive layer 50-4 are formed in each individual region C. The openings 50-41, 50-42 and 50-43 are formed at positions that coincide with the vias 60-6, 65-3 and 67-3, respectively, in a plan view when the fourth structure 1D and the fifth structure 1E are stacked through the adhesive layer 50-4 in a predetermined direction.

Next, the substrate 10-5 and the fifth structure 1E are turned upside down from the state depicted in FIGS. 12A through 12C to be stacked on the fourth structure 1D through the adhesive layer 50-4. That is, the fourth structure 1D and the fifth structure 1E are on opposite sides of the adhesive layer 50-4 so that the substrate 10-1 and the substrate 10-5 face outward. Thereafter, the adhesive layer 50-4 is cured. At this point, the openings 50-41 and 10-52 communicate with each other to form the single opening 10-55, so that the upper surface of the via 60-6 is exposed at the bottom of the opening 10-55. Furthermore, the openings 50-42 and 10-53 communicate with each other to form the single opening 10-56, so that the upper surface of the via 65-3 is exposed at the bottom of the opening 10-56. Furthermore, the openings 50-43 and 10-54 communicate with each other to form the single opening 10-57, so that the upper surface of the via 67-3 is exposed at the bottom of the opening 10-57.

Alternatively, in the process depicted in FIGS. 12A through 12C and 13A, the substrate 10-5 and the fifth structure 1E may be stacked on the fourth structure 1D through the adhesive layer 50-4 before providing the openings 10-51, 10-52, 10-53, 10-54, 50-41, 50-42 and 50-43, and the openings 10-51, 10-52, 10-53, 10-54, 50-41, 50-42 and 50-43 may thereafter be provided.

Next, in the process depicted in FIG. 13B, the substrate 10-5 is removed (delaminated) from the insulating layer 20-5 of the fifth structure 1E of each individual region C. For example, the substrate 10-5 may be mechanically delaminated from the insulating layer 20-5 of the fifth structure 1E.

Next, in the process depicted in FIG. 13C, the via 60-7 is formed on the via 60-6, exposed at the bottom of the opening 10-55. The metal layer 301-4 and the metal layer 301-5 are connected in series through the vias 60-6 and 60-7. Furthermore, the via 60-8 (not depicted) is formed on the exposed metal layer 301-5 at the bottom of the opening 10-51 (not depicted). The metal layer 301-5 and the via 60-8 are electrically connected. Furthermore, the via 65-4 is formed on the via 65-3, exposed at the bottom of the opening 10-56. The connection part 35-4 and the connection part 35-5 are electrically connected through the via 65-4. Furthermore, the via 67-4 is formed on the via 67-3, exposed at the bottom of the opening 10-57. The connection part 37-4 and the connection part 37-5 are electrically connected through the via 67-4.

Like the via 60-1, the vias 60-7, 60-8, 65-4 and 67-4 may be formed by electroplating, using the bus lines 36 to supply electric current or by the filling of metal paste, for example. Suitable materials for the vias 60-7, 60-8, 65-4 and 67-4 include, for example, copper (Cu). The upper surfaces of the vias 60-7, 60-8, 65-4 and 67-4 may be substantially flush with the upper surface of the insulating layer 20-5. As a result of this process, the metal layers 301-1, 301-2, 301-3, 301-4 and 301-5 are connected in series through the vias 60-1 through 60-7 in a laminate where the first through fifth structures 1A through 1E are stacked in each individual region C. This series connection of the laminate is ultimately subjected to a forming process (such as punching) to become a coil of approximately four turns.

Figure 14A:
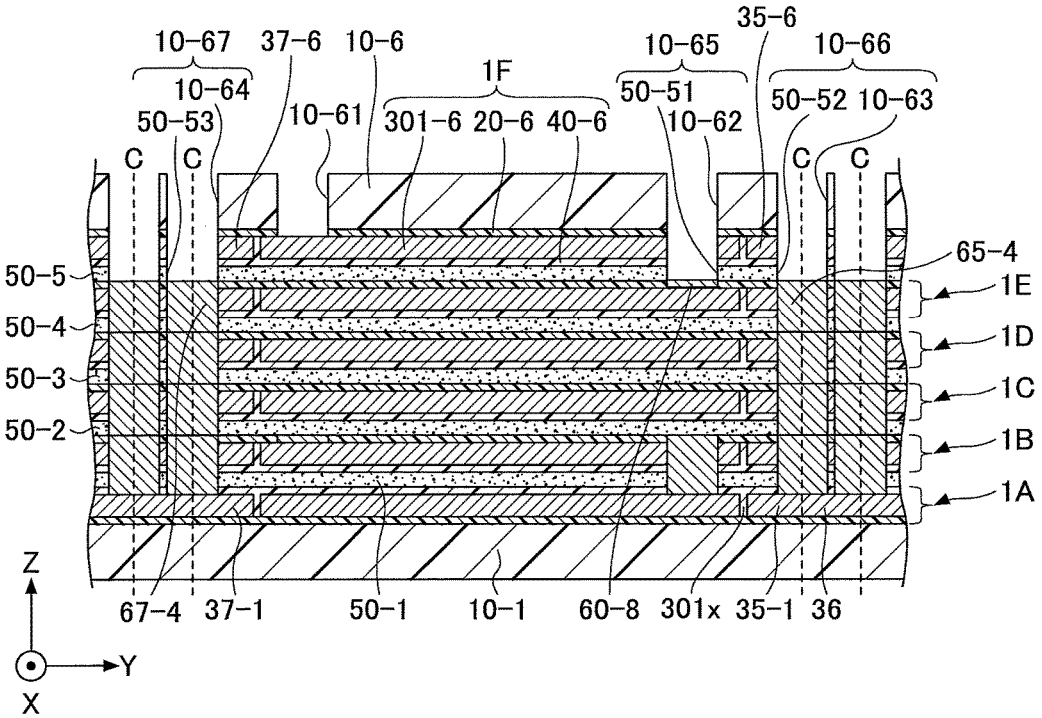
FIGS. 14A through 14C are diagrams depicting the method of manufacturing a coil substrate according to the embodiment.
Figure 14B:
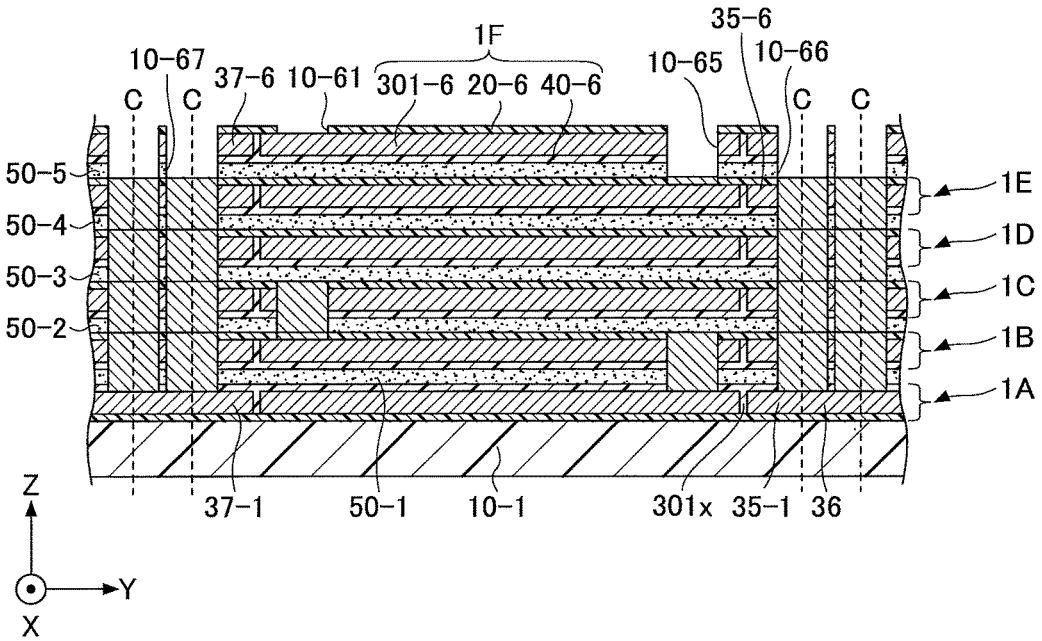
Figure 14C:
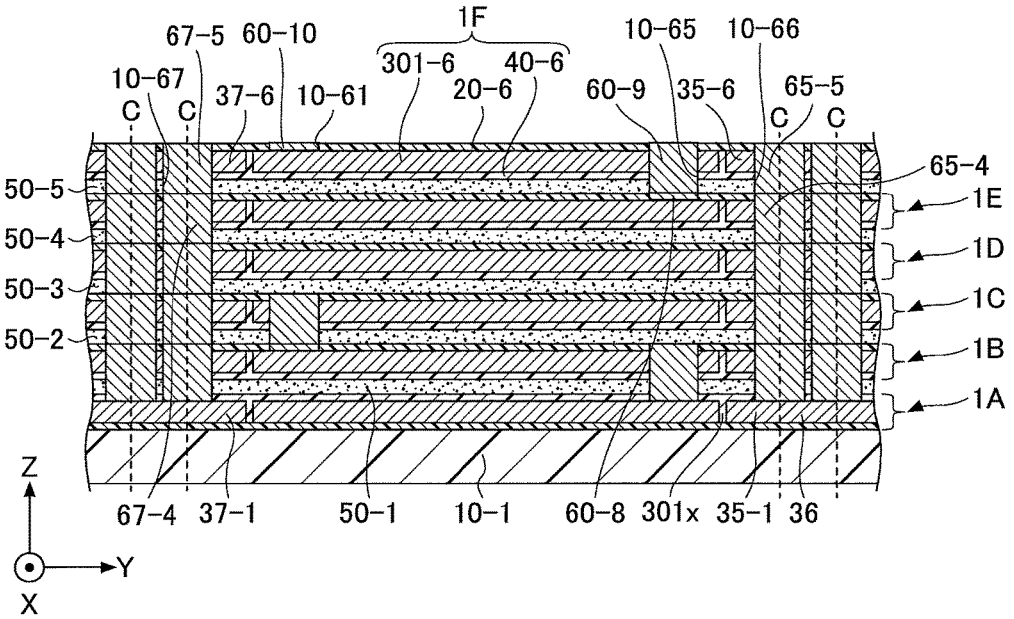

Next, the process depicted in FIGS. 14A through 14C is described. FIGS. 14A through 14C are cross-sectional views that correspond to FIG. 7A. First, in the process depicted in FIG. 14A, the sixth structure 1F, in which a metal layer 301-6, the connection part 35-6, and the connection part 37-6 are formed, is formed in each individual region C on a substrate 10-6 in the same manner as in the process depicted in FIGS. 6A and 6B. The metal layer 301-6 is ultimately subjected to a forming process (such as punching) to become the sixth conductive track 30-6 that is a sixth-layer conductive track (approximately ¾ turns) to form part of the coil. The opening 10-61 that exposes the bottom surface (the upper surface in FIG. 14A) of the metal layer 301-6 is formed through the substrate 10-6 and the insulating layer 20-6 of the sixth structure 1F. Furthermore, an opening 10-62 (through hole) that penetrates through the substrate 10-6 and the insulating layer 20-6, the metal layer 301-6, and the insulating layer 40-6 of the sixth structure 1F is formed. Furthermore, an opening 10-63 (through hole) that penetrates through the substrate 10-6 and the insulating layer 20-6, the insulating layer 40-6, and the connection part 35-6 of the sixth structure 1F is formed. Furthermore, an opening 10-64 (through hole) that penetrates through the substrate 10-6 and the insulating layer 20-6, the insulating layer 40-6, and the connection part 37-6 of the sixth structure 1F is formed. Although referred to using reference numerals different from those of the second structure 1B for the sake of convenience, the sixth structure 1F has the same structure as the second structure 1B, and the openings 10-61 and 10-62 in the sixth structure 1F correspond to the openings 10-21 and 10-22, respectively, in the second structure 1B.

Next, the adhesive layer 50-5 is prepared, and openings 50-51, 50-52 and 50-53 (each of which is a through hole) penetrating through the adhesive layer 50-5 are formed in each individual region C. The openings 50-51, 50-52 and 50-53 are formed at positions that coincide with the vias 60-8, 65-4 and 67-4, respectively, in a plan view when the fifth structure 1E and the sixth structure 1F are stacked through the adhesive layer 50-5 in a predetermined direction.

Then, in the same manner as depicted in FIG. 7A, the substrate 10-6 and the sixth structure 1F are turned upside down from the state depicted in FIGS. 6A and 6B to be stacked on the fifth structure 1E through the adhesive layer 50-5. That is, the fifth structure 1E and the sixth structure 1F are on opposite sides of the adhesive layer 50-5 so that the substrate 10-1 and the substrate 10-6 face outward. Thereafter, the adhesive layer 50-5 is cured. At this point, the openings 50-51 and 10-62 communicate with each other to form the single opening 10-65, so that the upper surface of the via 60-8 is exposed at the bottom of the opening 10-65. Furthermore, the openings 50-52 and 10-63 communicate with each other to form the single opening 10-66, so that the upper surface of the via 65-4 is exposed at the bottom of the opening 10-66. Furthermore, the openings 50-53 and 10-64 communicate with each other to form the single opening 10-67, so that the upper surface of the via 67-4 is exposed at the bottom of the opening 10-67.

Alternatively, in the process depicted in FIGS. 6A, 6B and 14A, the substrate 10-6 and the sixth structure 1F may be stacked on the fifth structure 1E through the adhesive layer 50-5 before providing the openings 10-61, 10-62, 10-63, 10-64, 50-51, 50-52 and 50-53, and the openings 10-61, 10-62, 10-63, 10-64, 50-51, 50-52 and 50-53 may thereafter be provided.

Next, in the process depicted in FIG. 14B, the substrate 10-6 is removed (delaminated) from the insulating layer 20-6 of the sixth structure 1F of each individual region C. For example, the substrate 10-6 may be mechanically delaminated from the insulating layer 20-6 of the fifth structure 1F.

Next, in the process depicted in FIG. 14C, the via 60-9 is formed on the via 60-8, exposed at the bottom of the opening 10-65. The metal layer 301-5 and the metal layer 301-6 are connected in series through the vias 60-8 and 60-9. Furthermore, the via 60-10 is formed on the exposed metal layer 301-6 at the bottom of the opening 10-61. The metal layer 301-6 and the via 60-10 are electrically connected. Furthermore, the via 65-5 is formed on the via 65-4 exposed at the bottom of the opening 10-66. The connection part 35-5 and the connection part 35-6 are electrically connected through the via 65-5. Furthermore, the via 67-5 is formed on the via 67-4 exposed at the bottom of the opening 10-67. The connection part 37-5 and the connection part 37-6 are electrically connected through the via 67-5.

Like the via 60-1, the vias 60-9, 60-10, 65-5 and 67-5 may be formed by electroplating, using the bus lines 36 to supply electric current or by the filling of metal paste, for example. Suitable materials for the vias 60-9, 60-10, 65-5 and 67-5 include, for example, copper (Cu). The upper surfaces of the vias 60-9, 60-10, 65-5 and 67-5 may be substantially flush with the upper surface of the insulating layer 20-6. As a result of this process, the metal layers 301-1, 301-2, 301-3, 301-4, 301-5 and 301-6 are connected in series through the vias 60-1 through 60-9 in a laminate where the first through sixth structures 1A through 1F are stacked in each individual region C. This series connection of the laminate is ultimately subjected to a forming process (such as punching) to become a coil of approximately four and ¾ turns.

Figure 15A:
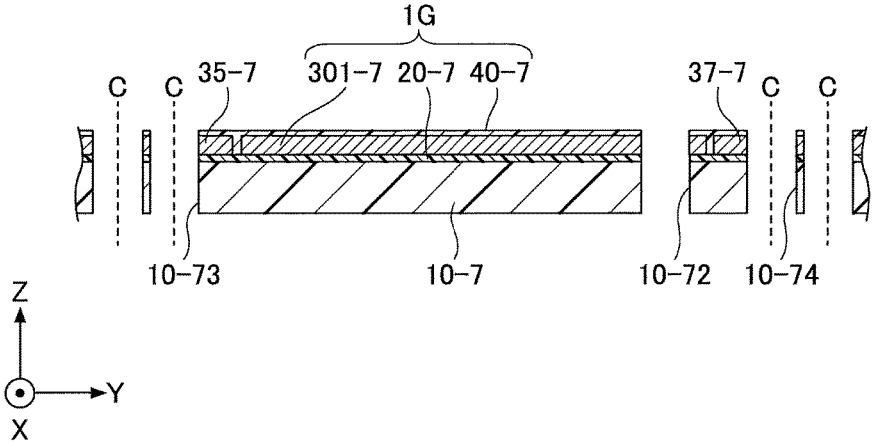
FIGS. 15A and 15B are diagrams depicting the method of manufacturing a coil substrate according to the embodiment.
Figure 15B:
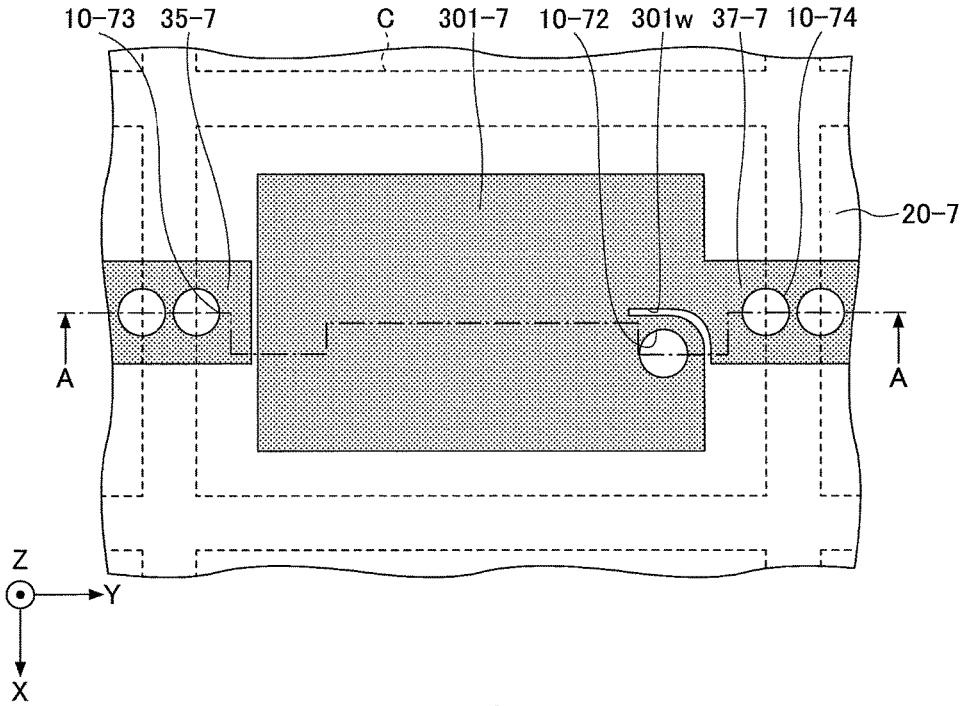

Next, in the process depicted in FIGS. 15A and 15B, the seventh structure 1G, in which a metal layer 301-7, the connection part 35-7, and the connection part 37-7 are formed, is formed in each individual region C on a substrate 10-7 in the same manner as in the process depicted in FIGS. 6A and 6B. The metal layer 301-7 is ultimately subjected to a forming process (such as punching) to become the seventh conductive track 30-7 that is a seventh-layer conductive track (approximately one turns) to form part of the coil. Specifically, the metal layer 301-7 is formed on the insulating layer 20-7. Furthermore, the connection part 37-7 is formed at one end of the metal layer 301-7. The metal layer 301-7 and the connection part 37-7 are monolithically formed. A cut 301*w* is formed in the metal layer 301-7. The cut 301*w* is provided to facilitate formation of the helical shape of the coil when shaping the coil substrate 1 (for example, by punching) in a subsequent process.

Next, an opening 10-72 (through hole) that penetrates through the substrate 10-7 and the insulating layer 20-7, the metal layer 301-7, and the insulating layer 40-7 of the seventh structure 1G is formed. Furthermore, an opening 10-73 (through hole) that penetrates through the substrate 10-7 and the insulating layer 20-7, the insulating layer 40-7, and the connection part 35-7 of the seventh structure 1G is formed. Furthermore, an opening 10-74 (through hole) that penetrates through the substrate 10-7 and the insulating layer 20-7, the insulating layer 40-7, and the connection part 37-7 of the seventh structure 1G is formed. FIG. 15B is a plan view and FIG. 15A is a cross-sectional view taken along a line A-A in FIG. 15B.

The planar shape and the processing method of the openings 10-72, 10-73 and 10-74 may be the same as those of, for example, the opening 10-21. The openings 10-72, 10-73 and 10-74 are formed at positions that coincide with the vias 60-10, 65-5 and 67-5, respectively, in a plan view when the sixth structure 1F and the seventh structure 1G are stacked in a predetermined direction. In FIG. 15B, a depiction of the insulating layer 40-7 is omitted.

Figure 16A:
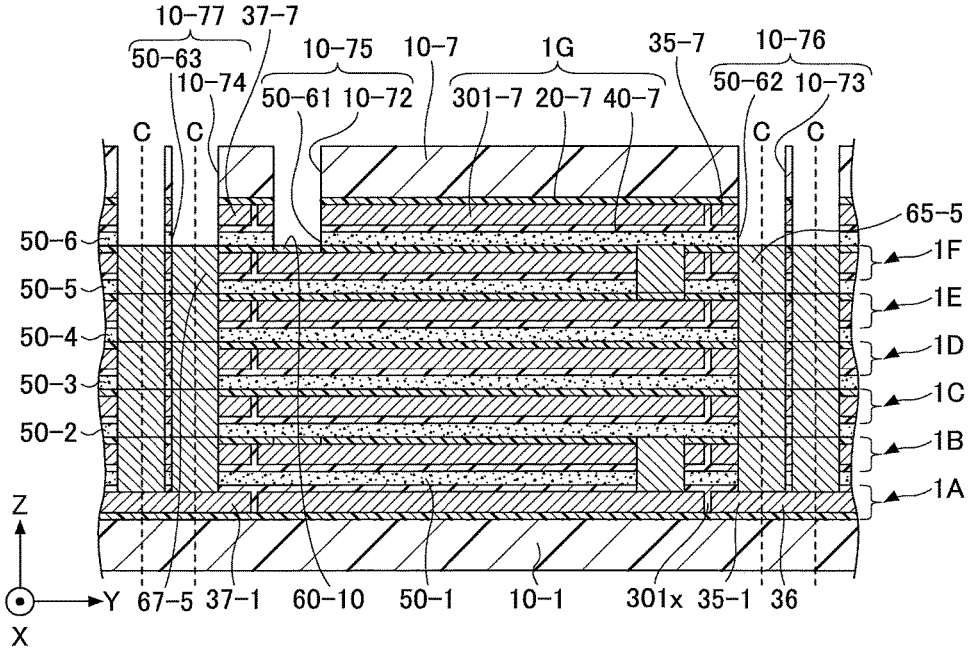
FIGS. 16A through 16C are diagrams depicting the method of manufacturing a coil substrate according to the embodiment.
Figure 16B:
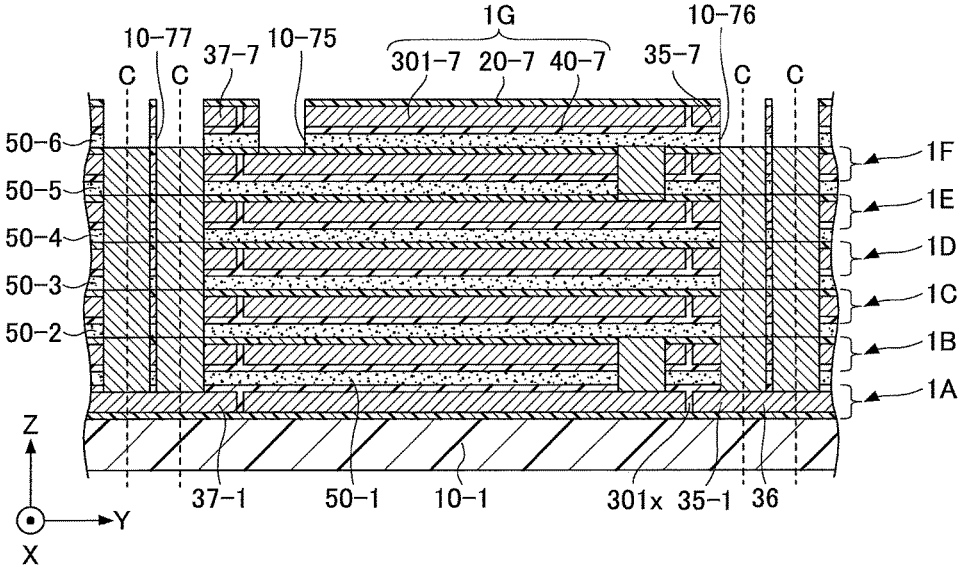
Figure 16C:
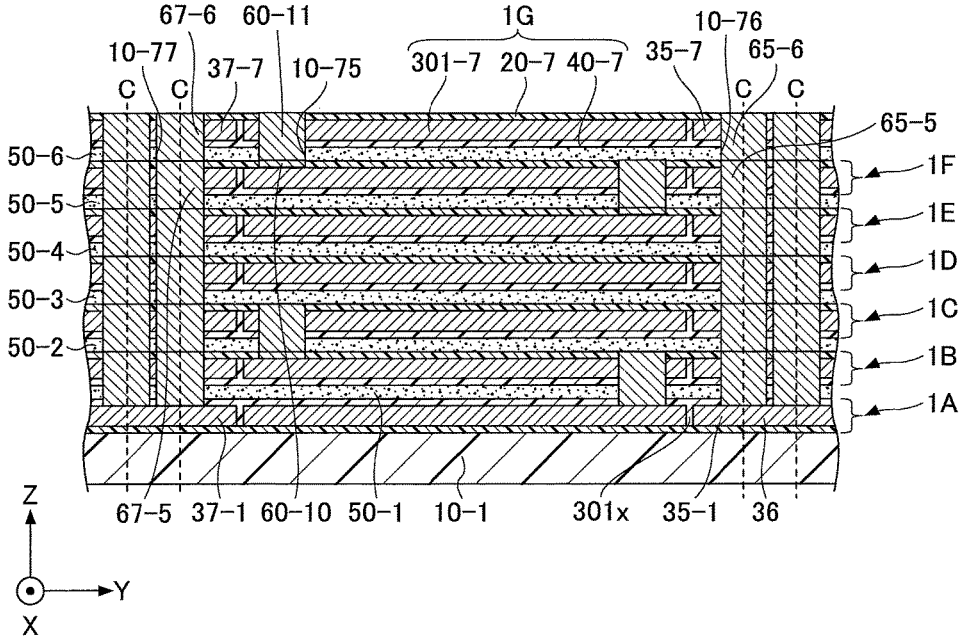

Next, the process depicted in FIGS. 16A through 16C is described. FIGS. 16A through 16C are cross-sectional views that correspond to FIGS. 14A through 14C. First, in the process depicted in FIG. 16A, the adhesive layer 50-6 is prepared, and openings 50-61, 50-62 and 50-63 (each of which is a through hole) penetrating through the adhesive layer 50-6 are formed in each individual region C. The openings 50-61, 50-62 and 50-63 are formed at positions that coincide with the vias 60-10, 65-5 and 67-5, respectively, in a plan view when the sixth structure 1F and the seventh structure 1G are stacked through the adhesive layer 50-6 in a predetermined direction.

Next, the substrate 10-7 and the seventh structure 1G are turned upside down from the state depicted in FIGS. 15A and 15B to be stacked on the sixth structure 1F through the adhesive layer 50-6. That is, the sixth structure 1F and the seventh structure 1G are on opposite sides of the adhesive layer 50-6 so that the substrate 10-1 and the substrate 10-7 face outward. Thereafter, the adhesive layer 50-6 is cured. At this point, the openings 50-61 and 10-72 communicate with each other to form the single opening 10-75, so that the upper surface of the via 60-10 is exposed at the bottom of the opening 10-75. Furthermore, the openings 50-62 and 10-73 communicate with each other to form the single opening 10-76, so that the upper surface of the via 65-5 is exposed at the bottom of the opening 10-76. Furthermore, the openings 50-63 and 10-74 communicate with each other to form the single opening 10-77, so that the upper surface of the via 67-5 is exposed at the bottom of the opening 10-77.

Alternatively, in the process depicted in FIGS. 15A, 15B and 16A, the substrate 10-7 and the seventh structure 1G may be stacked on the sixth structure 1F through the adhesive layer 50-6 before providing the openings 10-72, 10-73, 10-74, 50-61, 50-62 and 50-63, and the openings 10-72, 10-73, 10-74, 50-61, 50-62 and 50-63 may thereafter be provided.

Next, in the process depicted in FIG. 16B, the substrate 10-7 is removed (delaminated) from the insulating layer 20-7 of the seventh structure 1G of each individual region C. For example, the substrate 10-7 may be mechanically delaminated from the insulating layer 20-7 of the seventh structure 1G.

Next, in the process depicted in FIG. 16C, the via 60-11 is formed on the via 60-10 exposed at the bottom of the opening 10-75. The metal layer 301-6 and the metal layer 301-7 are connected in series through the vias 60-10 and 60-11. Furthermore, the via 65-6 is formed on the via 65-5 exposed at the bottom of the opening 10-76. The connection part 35-6 and the connection part 35-7 are electrically connected through the via 65-6. Furthermore, the via 67-6 is formed on the via 67-5 exposed at the bottom of the opening 10-77. The connection part 37-6 and the connection part 37-7 are electrically connected through the via 67-6.

Like the via 60-1, the vias 60-11, 65-6 and 67-6 may be formed by electroplating, using the bus lines 36 to supply electric current or by the filling of metal paste, for example. Suitable materials for the vias 60-11, 65-6 and 67-6 include, for example, copper (Cu). The upper surfaces of the vias 60-11, 65-6 and 67-6 may be substantially flush with the upper surface of the insulating layer 20-7. As a result of this process, the metal layers 301-1, 301-2, 301-3, 301-4, 301-5, 301-6 and 301-7 are connected in series through the vias 60-1 through 60-11 in a laminate where the first through seventh structures 1A through 1G are stacked in each individual region C. This series connection of the laminate is ultimately subjected to a forming process (such as punching) to become a coil of approximately five and ½ turns. Furthermore, the connection parts 35-1, 35-2, 35-3, 35-4, 35-5, 35-6 and 35-7 are electrically connected through the vias 65-1, 65-2, 65-3, 65-4, 65-5 and 65-6. Furthermore, the connection parts 37-1, 37-2, 37-3, 37-4, 37-5, 37-6 and 37-7 are electrically connected through the vias 67-1, 67-2, 67-3, 67-4, 67-5 and 67-6.

Figure 17A:
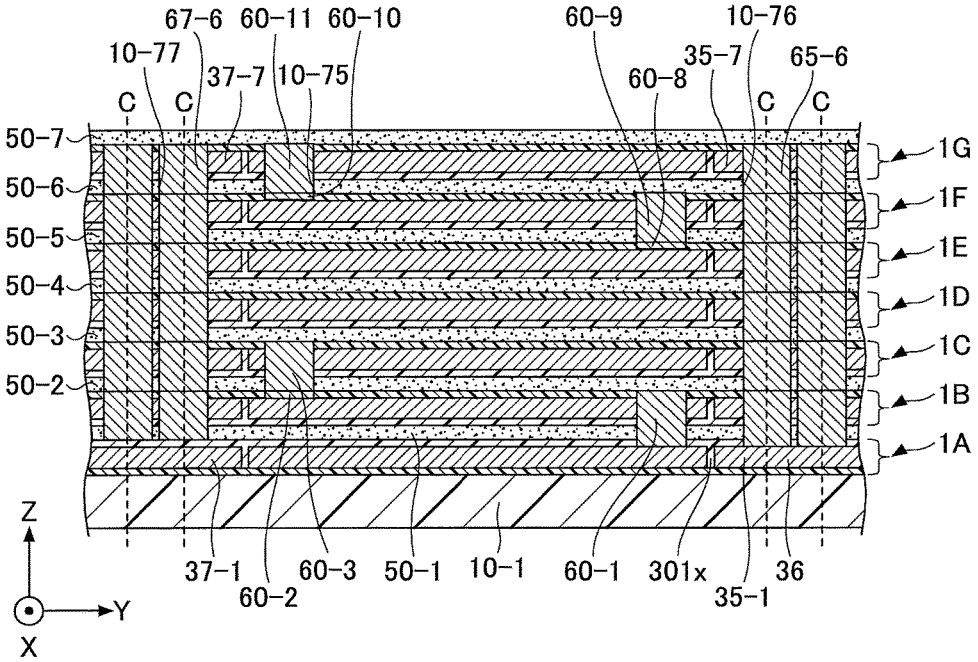
FIGS. 17A and 17B are diagrams depicting the method of manufacturing a coil substrate according to the embodiment.
Figure 17B:
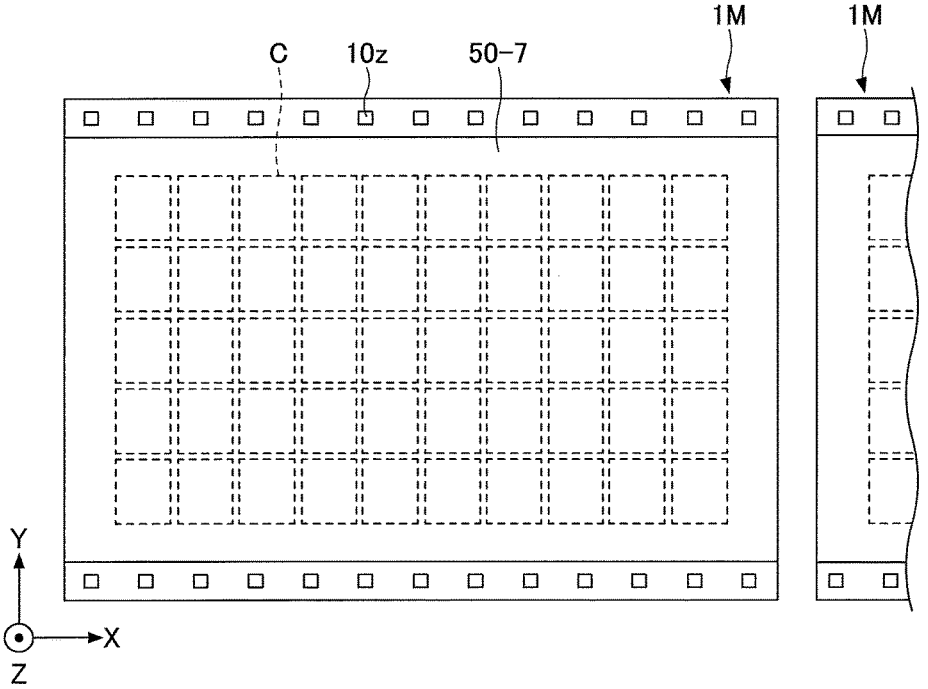

Next, in the process depicted in FIG. 17A, the adhesive layer 50-7, in which no opening is formed, is stacked on the seventh structure 1G of each individual region C. Next, in the process depicted in FIG. 17B, the structure depicted in FIG. 17A is cut at the cutting position D depicted in FIG. 4A into individual sheet-shaped substrates 1M. In the case depicted in FIG. 17B, fifty individual regions C are formed on each substrate 1M. Alternatively, a structure in a reeled state or in the form of tape obtained after the process depicted in FIGS. 21A through 21C may be directly shipped as a product without executing the process depicted in FIG. 17B.

Figure 18:
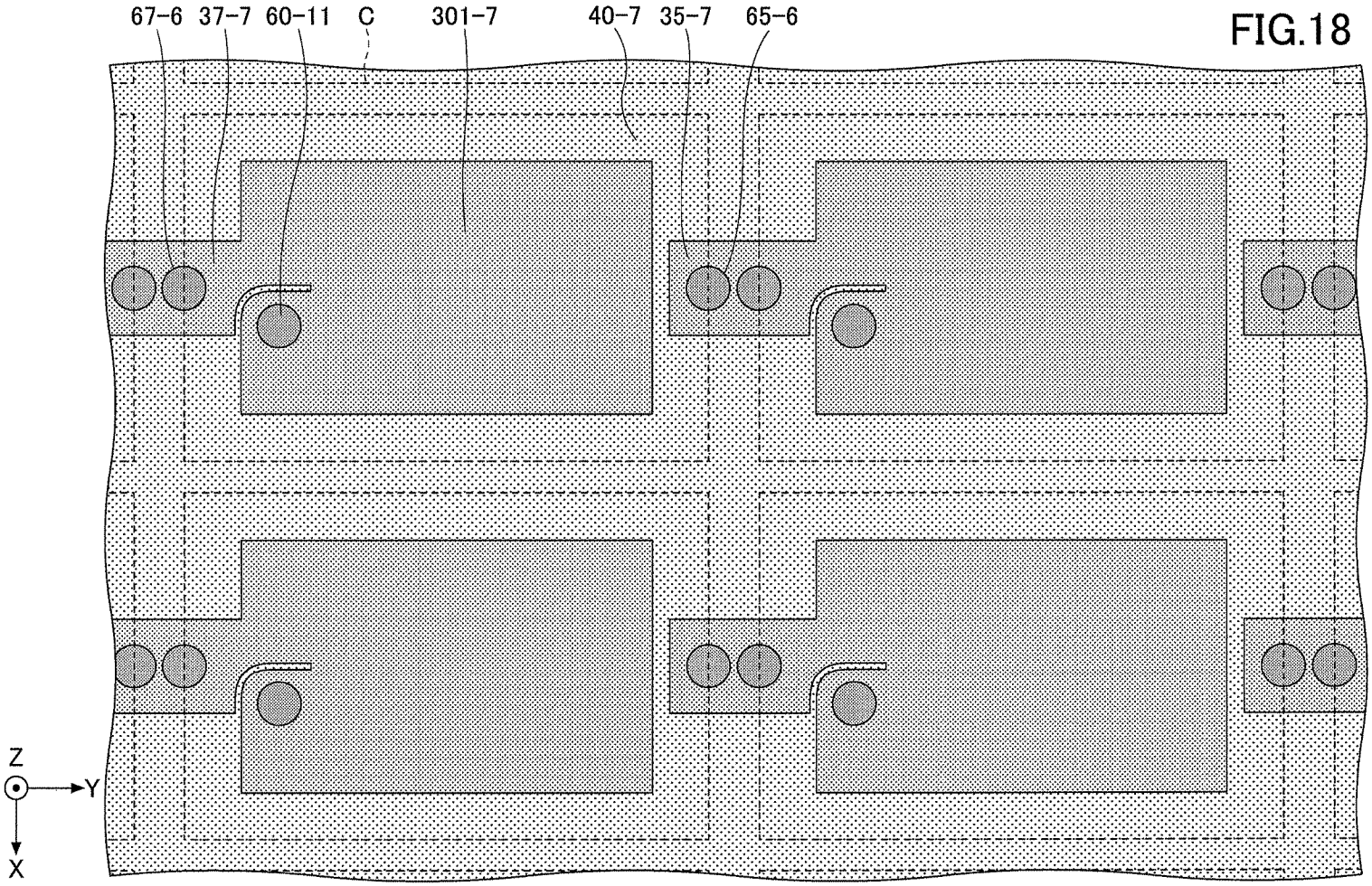
FIG. 18 is a diagram depicting the method of manufacturing a coil substrate according to the embodiment.
Figure 19:
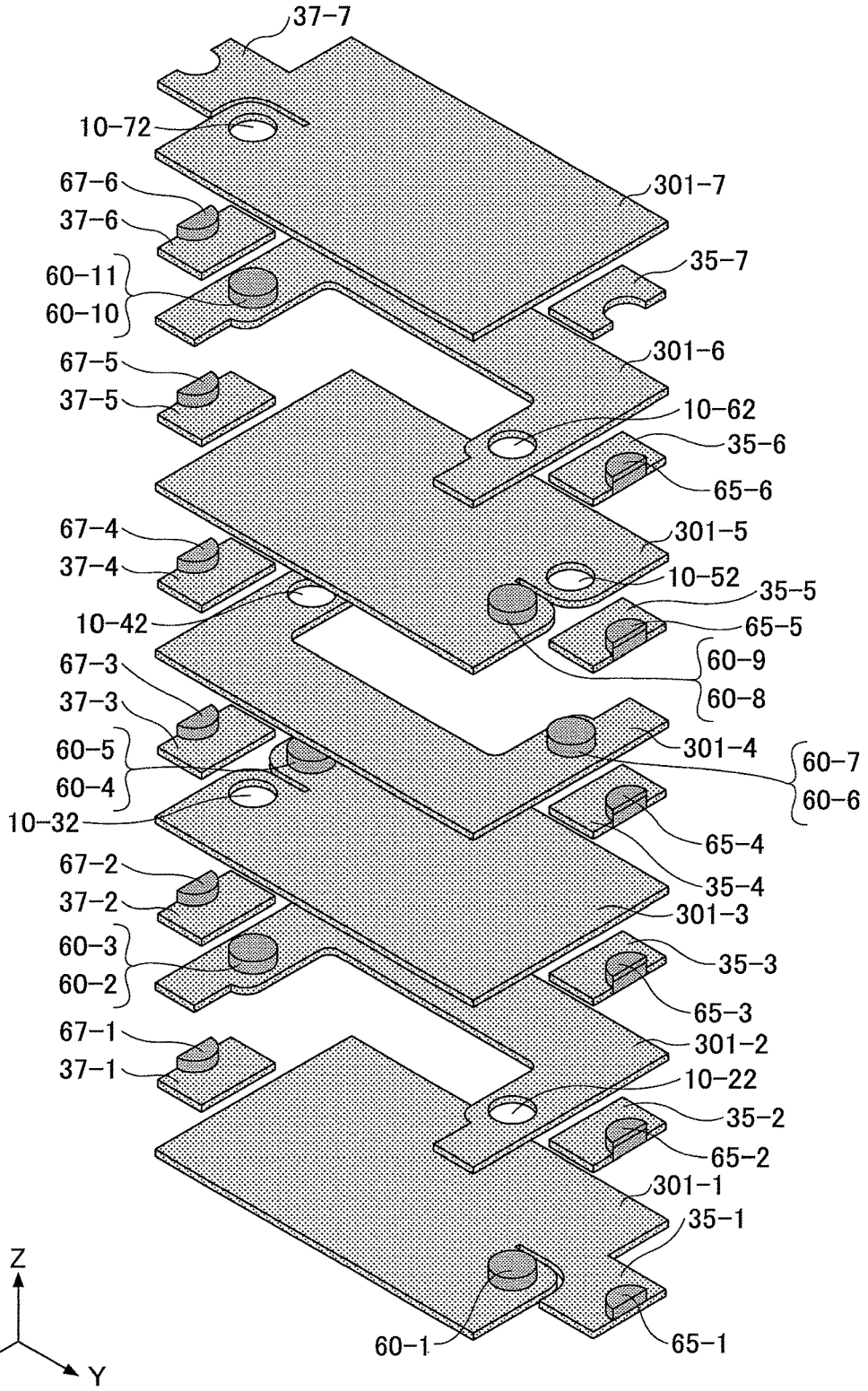
FIG. 19 is a diagram depicting the method of manufacturing a coil substrate according to the embodiment.
Figure 20:
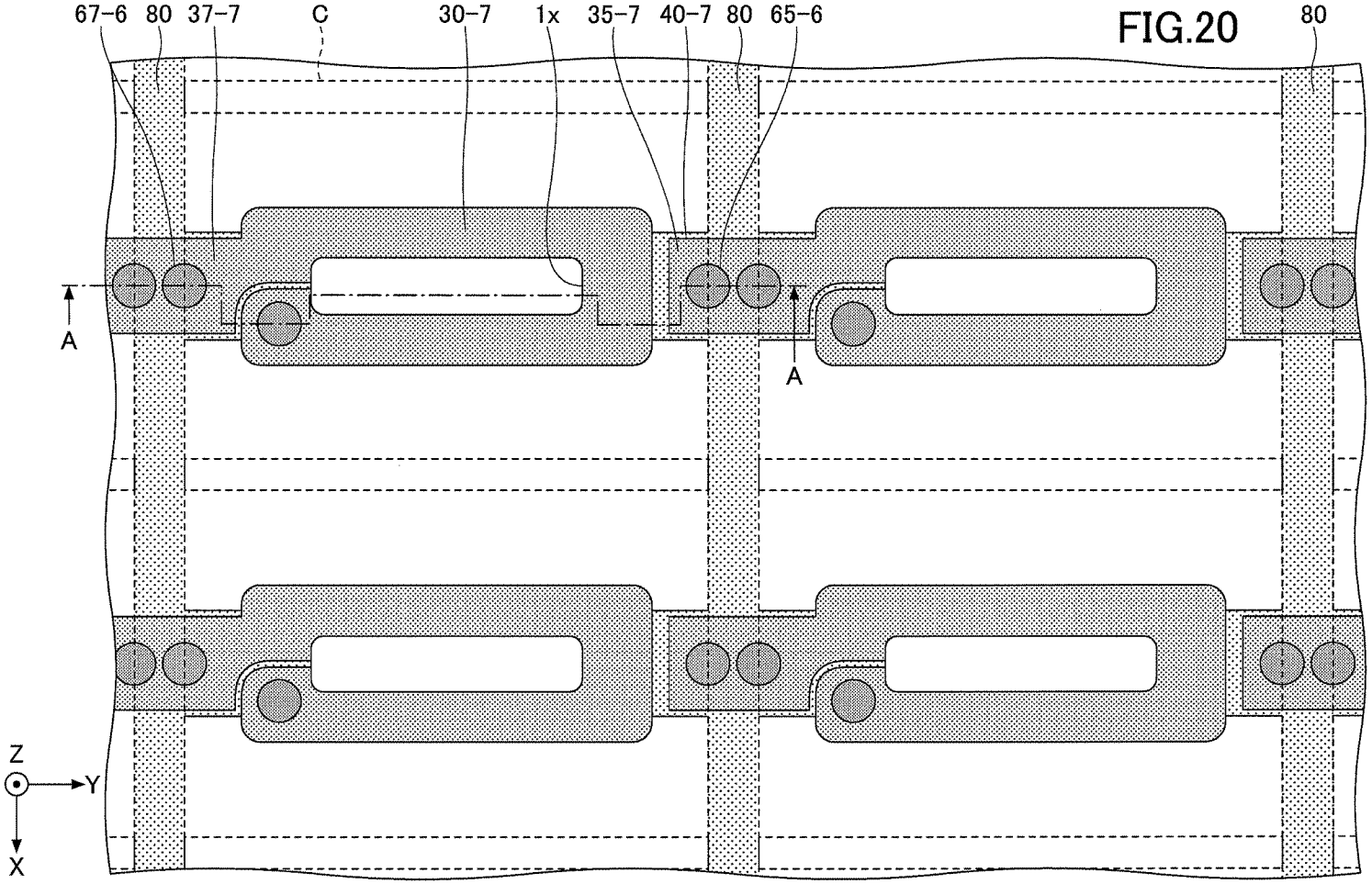
FIG. 20 is a diagram depicting the method of manufacturing a coil substrate according to the embodiment.
Figure 21A:
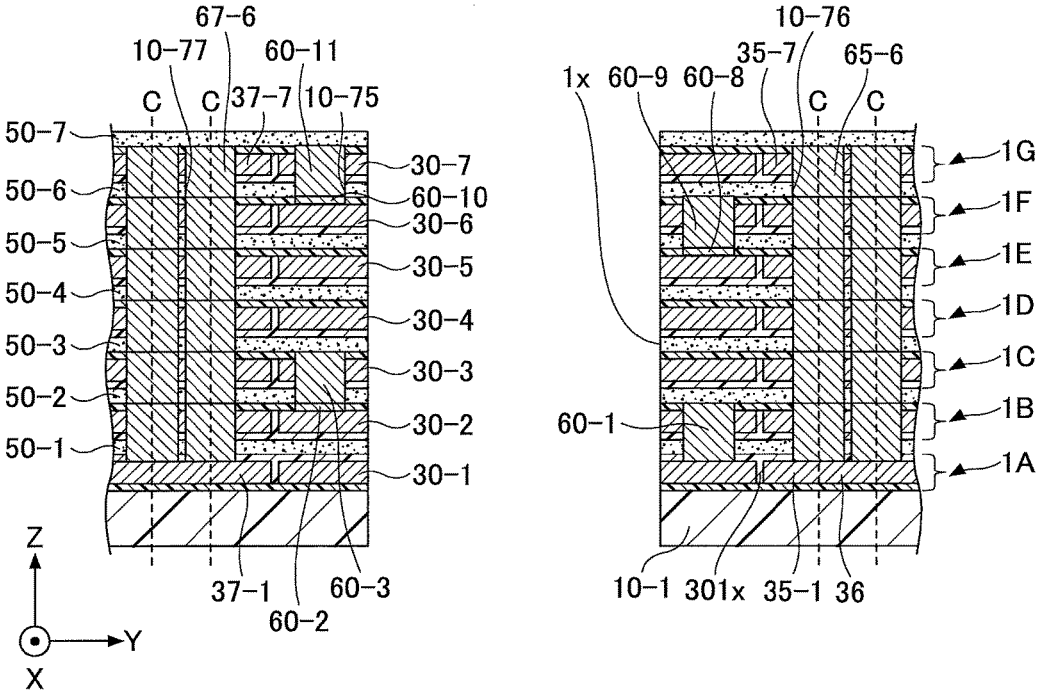
FIGS. 21A through 21C are diagrams depicting the method of manufacturing a coil substrate according to the embodiment.

Next, in the process depicted in FIGS. 18 through 21A, each substrate 1M is subjected to a forming process (such as punching) to remove unnecessary portions, so that each of the metal layers 301-1 through 301-7 formed in the respective layers is formed into a conductive track having the shape of part of the helical coil. FIG. 18 is a plan view depicting, by way of example, some of the metal layers 301-7 on the substrate 1M before subjecting the substrate 1M to a forming process (such as punching). In FIG. 18, a depiction of layers on or above the metal layer 301-7 is omitted. FIG. 19 is a perspective view schematically depicting, by way of example, the shape of each of the metal layers 301-1 through 301-7 formed in the respective layers before subjecting the substrate 1M to a forming process (such as punching). The substrate 1M on which the metal layers 301-1 through 301-7 depicted in FIGS. 18 and 19 are formed is subjected to form shaping by, for example, press working using a die, so that the substrate 1M has a shape depicted in FIGS. 20 and 21A. FIG. 20 is a plan view corresponding to FIG. 18. FIG. 21A is a cross-sectional view taken along a line A-A in FIG. 20. The shapes of the conductive tracks 30-1 through 30-7 of the respective layers of the structure depicted in FIGS. 20 and 21A are as depicted in FIG. 2. The substrate 1M may be subjected to form shaping by laser processing instead of press working using a die.

As a result of this process, in the laminate of the first structure 1A through the seventh structure 1G, the metal layer 301-1 is shaped into the first conductive track 30-1. Likewise, the metal layers 301-2, 301-3, 301-4, 301-5, 301-6 and 301-7 are shaped into the second, third, fourth, fifth, sixth and seventh conductive tracks 30-2, 30-3, 30-4, 30-5, 30-6 and 30-7, respectively. The first, second, third, fourth, fifth, sixth and seventh conductive tracks 30-1, 30-2, 30-3, 30-4, 30-5, 30-6 and 30-7 are connected in series through the vias 60-1 through 60-11 to form a helical coil of approximately five and ½ turns.

The laminate of the first structure 1A through the seventh structure 1G is formed in each individual region C. The laminates are interconnected through connection parts 80, which include the insulating layer 40-7, etc., formed between adjacent individual regions C, but are not electrically connected to one another. Layers other than the metal layers 301-1 through 301-7, such as the insulating layer 40-7, of the laminate of each individual region C also are subjected to form shaping to be substantially the same in shape as the corresponding conductive tracks 30-1 through 30-7, so that the through hole 1*x* penetrating through each layer is formed substantially in the center of the laminate. The ratio of the conductive tracks 30-1 through 30-7 to the through hole 1*x* may be suitably changed in accordance with required inductor characteristics.

Figure 21B:
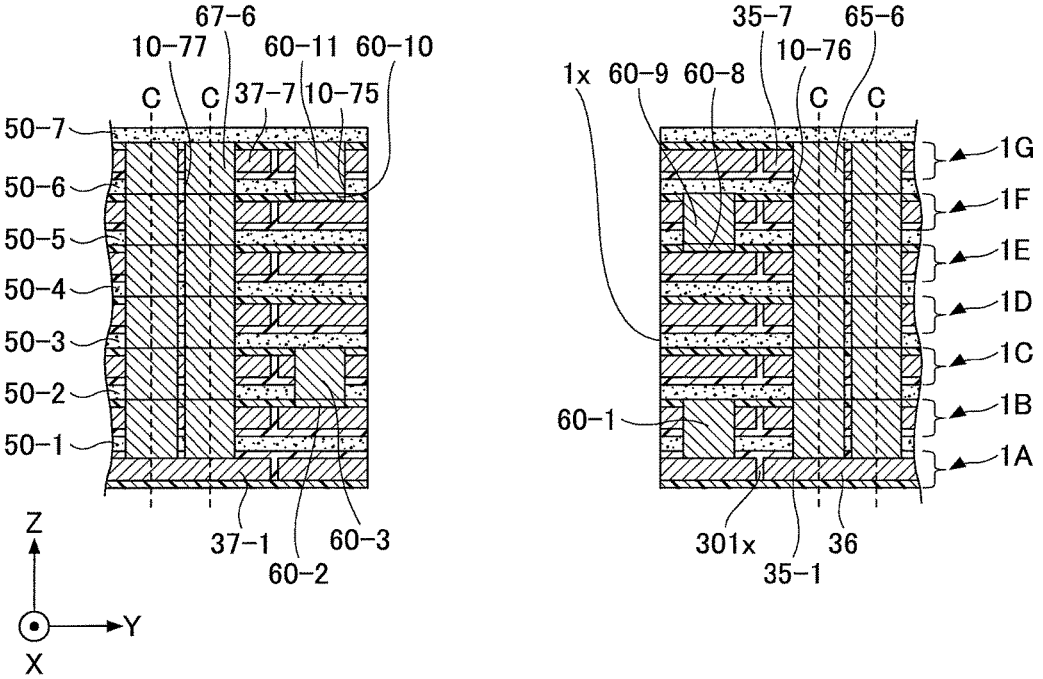

Next, in the process depicted in FIG. 21B, the substrate 10-1 is delaminated from the insulating layer 20-1. Then, in the process depicted in FIG. 21C, the insulating film 70 that covers the surface of the laminate of the first structure 1A through the seventh structure 1G is formed. This is because in the case where the encapsulation material 110 contains the above-described magnetic metal powder, there is the possibility of a short circuit between the conductive tracks 30-1 through 30-7 and the magnetic metal powder in the encapsulation material 110 when the inductor 100 (see FIGS. 3A and 3B) is manufactured, if end faces of the conductive tracks 30-1 through 30-7 are exposed at the exterior wall (sidewall) surfaces of the laminate and the interior wall surface of the laminate defining the through hole 1*x*. By forming the insulating layer 70 on the surface of the laminate, it is possible to prevent a short circuit with a conductive material (such as a filler of a magnetic material) that may be contained in the encapsulation material 110.

Figure 21C:
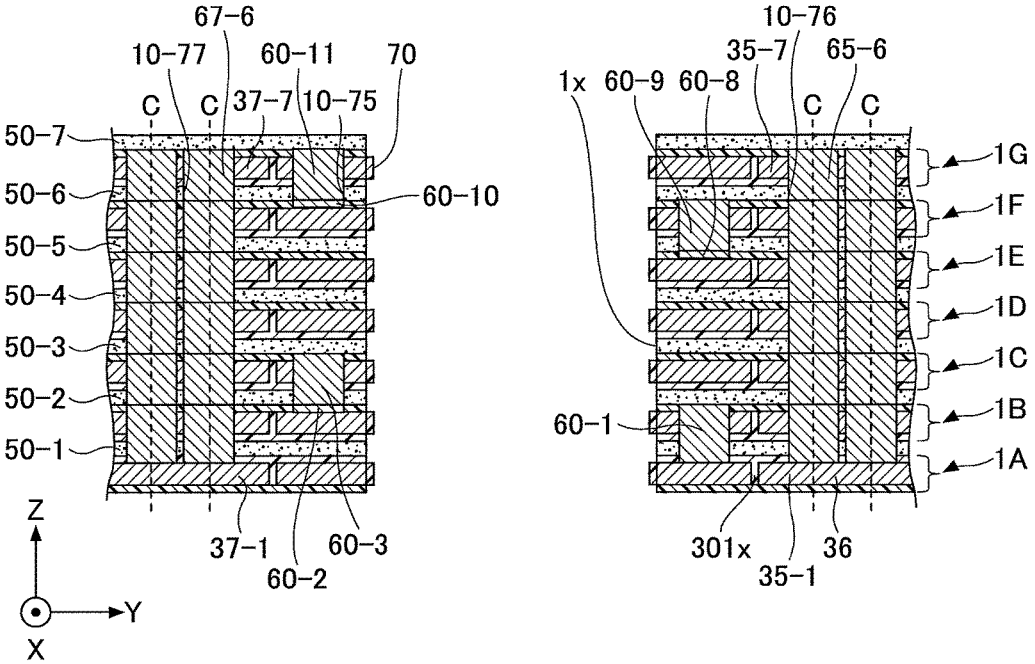

Specifically, the insulating film 70 is formed by electrodeposition coating, using an electrodeposited resist of an epoxy, acrylic or imide insulating resin as the insulating film 70. In this case, as depicted in FIG. 21C, an electrodeposited resist adheres to only the end faces of the conductive tracks 30-1 through 30-7 that are exposed at the exterior wall (sidewall) surfaces of the laminate and the interior wall surface of the laminate defining the through hole 1*x*. The thickness of the insulating film 70 may be, for example, approximately 20 μm to approximately 50 μm.

Alternatively, the insulating film 70 may be formed by, for example, spin coating or spray coating using an epoxy or acrylic insulating resin. Furthermore, the insulating film 70 may contain a filler such as silica. In this case, the insulating film 70 that continuously covers the exterior wall (sidewall) surfaces of the laminate, the upper surface of the adhesive layer 50-7, and the interior wall surface of the laminate defining the through hole 1*x* in each individual region C is formed.

As a result of the above-described process, the coil substrate 1 (see FIGS. 1A through 1C) is completed in each individual region C. The coil substrates 1 in the individual regions C are interconnected by the connection parts 80 formed between adjacent individual regions C (but are not electrically connected).

Figure 22A:
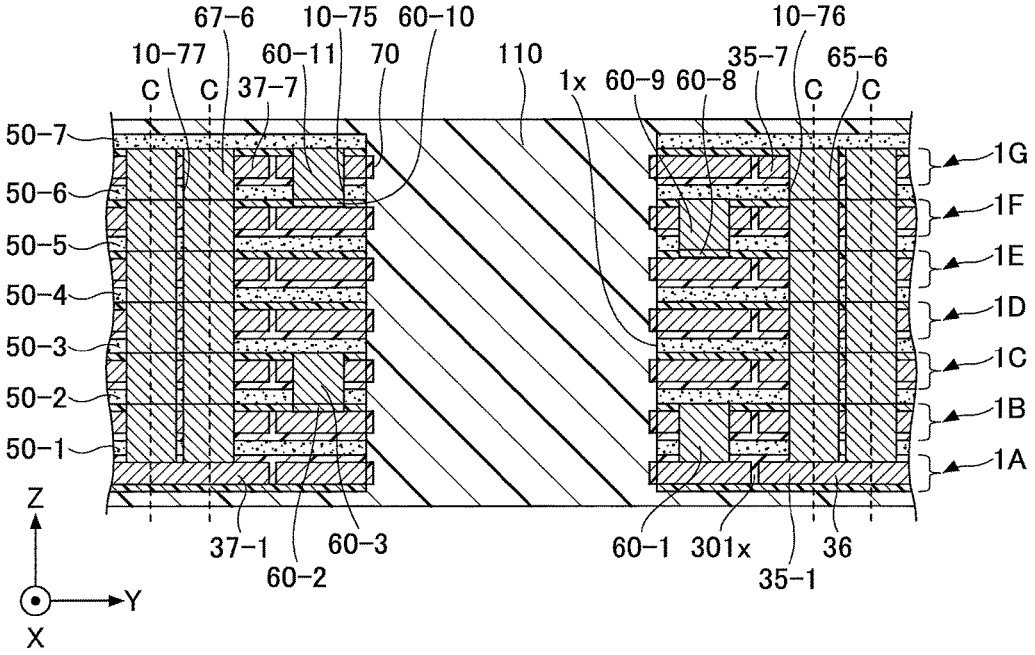
FIGS. 22A through 22C are diagrams depicting a method of manufacturing an inductor according to the embodiment.

In manufacturing the inductor 100 (see FIGS. 3A and 3B), as depicted in FIG. 22A, the insulating material 110 is formed in the entirety of each individual region C with the coil substrates 1 interconnected by the connection parts 80 as depicted in FIG. 21C. For example, an insulating resin such as an epoxy insulating resin containing a filler of a magnetic material, such as a ferrite, may be used as the encapsulation material 110.

Specifically, for example, the coil substrates 1 interconnected by the connection parts 80 and the encapsulation material 110 are placed in a mold and subjected to compression molding. It is preferable to use mechanical, hydraulic, or isostatic pressing as the method of compression molding. At this point, it is preferable to perform pressing in a heated state (heat pressing) to increase the molding density of magnetic material contained in the encapsulation material 110.

Figure 22B:
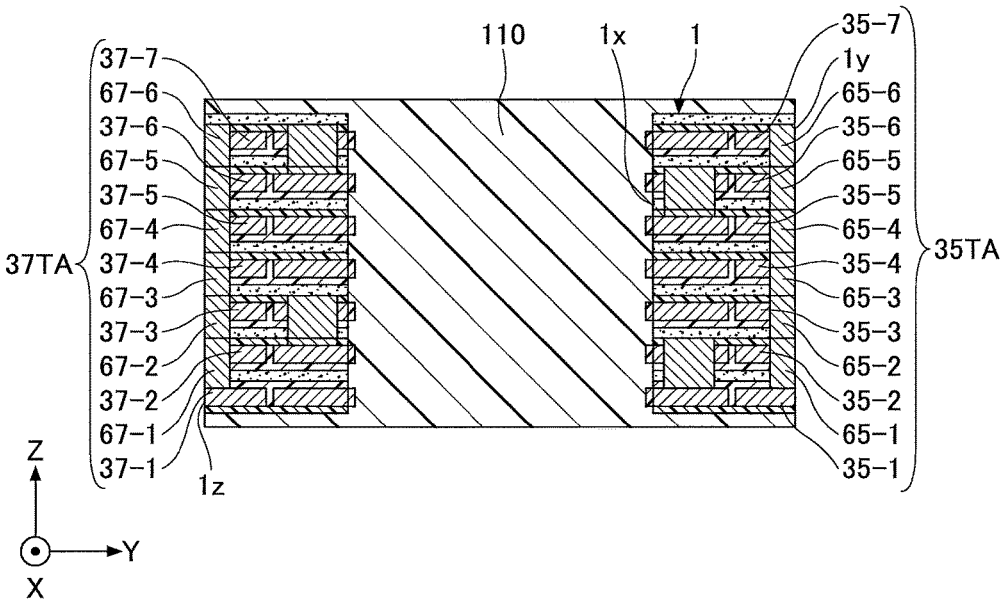

Next, as depicted in FIG. 22B, the structure depicted in FIG. 22A is cut along each individual region C. As a result, the connection parts 80 are removed so that multiple individual coil substrates 1 are completed. In this process, in each individual region C, the connection parts 35-1 through 35-7 and the vias 65-1 through 65-6 of the first electrode terminal 35TA are cut in the thickness direction, so that the cut surfaces of the connection parts 35-1 through 35-7 and the vias 65-1 through 65-6 are exposed at the first side surface 1*y* of the coil substrate 1 as the side surface of the first electrode terminal 35TA. Furthermore, the connection parts 37-1 through 37-7 and the vias 67-1 through 67-6 of the second electrode terminal 37TA are cut in the thickness direction, so that the cut surfaces of the connection parts 37-1 through 37-7 and the vias 67-1 through 67-6 are exposed at the second side surface 1*z* of the coil substrate 1 as the side surface of the second electrode terminal 37TA.

Figure 22C:
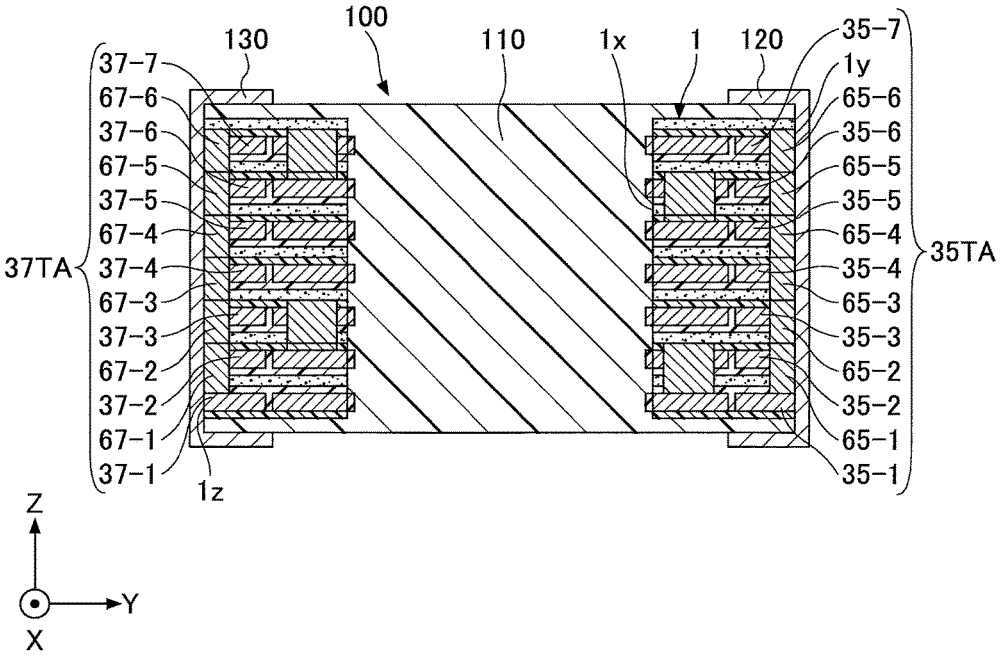

Next, as depicted in FIG. 22C, the first external electrode 120 is formed as a monolithic structure that extends over the first side surface (facing in the Y direction), part of the upper surface, part of the lower surface, and part of each of the surfaces extending between the upper surface and the lower surface of the encapsulation material 110 by dipping, sputtering, application of conductive paste, or electroless plating. The interior wall surface of the first external electrode 120 is in surface contact with the side surface of the first electrode terminal 35TA exposed at the first side surface 1*y* of the coil substrate 1, so that the first external electrode 120 and the first electrode terminal 35TA are electrically connected. Likewise, the second external electrode 130 is formed as a monolithic structure that extends over the second side surface (opposite to the first side surface), part of the upper surface, part of the lower surface, and part of each of the surfaces extending between the upper surface and the lower surface of the encapsulation material 110 by dipping, sputtering, application of conductive paste, or electroless plating. The interior wall surface of the second external electrode 130 is in surface contact with the side surface of the second electrode terminal 37TA exposed at the second side surface 1*z* of the coil substrate 1, so that the second external electrode 130 and the second electrode terminal 37TA are electrically connected. The material of the first and second external electrodes 120 and 130 preferably has good electrical conductivity. Suitable materials for the first and second external electrodes 120 and 130 include, for example, silver (Ag), nickel (Ni), copper (Cu), and copper alloys. The first and second external electrodes 120 and 130 may be laminates of multiple metal layers. As a result, the inductor 100 is completed.

Thus, according to the inductor 100, the first electrode terminal 35TA of the coil substrate 1 and the first external electrode 120 are in surface contact, and the second electrode terminal 37TA of the coil substrate 1 and the second external electrode 130 are in surface contact. Therefore, compared with conventional inductors, it is possible to increase the contact area of an electrode terminal of the coil substrate and an external electrode of the inductor, and it is thereby possible to reduce the electrical resistance between the electrode terminal of the coil substrate and the external electrode of the inductor. Furthermore, an increase in the long-term reliability of the joint of the electrode terminal and the external electrode is expected.

Furthermore, according to the coil substrate 1 used in the inductor 100, multiple structures are formed in each of which a conductive track to form part of a helical coil is covered with insulating layers, and a single helical coil is formed by stacking the structures through adhesive layers and connecting the conductive tracks of the structures in series through vias. This makes it possible to achieve a coil of a desired number of turns without changing a planar shape by increasing the number of stacked structures. That is, compared with conventional coil substrates, it is possible to increase the number of turns of a coil with reduced size (for example, a substantially rectangular planar shape of 1.6 mm by 0.8 mm or 2.0 mm by 1.6 mm, or a planar shape of approximately 3.0 mm square).

Here, for example, it is assumed that a conductive track having the shape of part of a coil is formed in advance in each of multiple structures and the structures are thereafter stacked. In this case, however, the conductive tracks are laterally offset and are prevented from being stacked in such a manner as to completely coincide with each other in a plan view. When a through hole is thereafter formed in the laminate of the structures, part of the offset conductive tracks may be removed. Reducing the width of the conductive tracks formed in advance in the structures may solve this problem, but would result in an increase in the direct-current resistance of the coil.

Meanwhile, according to the method of manufacturing a coil substrate of this embodiment, a metal layer having a planar shape greater than a conductive track is formed in advance in each of the structures, and the structures are stacked to form a laminate. The laminate is subjected to a forming process in the thickness direction, so that the metal plates are simultaneously processed into conductive tracks each having the shape of part of the helical coil. Therefore, the conductive tracks are prevented from being laterally offset, so that it is possible to form a helical coil from the conductive tracks that are stacked with high accuracy to coincide with each other in a plan view. As a result, it is possible to reduce the direct-current resistance of the coil. That is, because there is no need to consider the lateral offsets of the conductive tracks, it is possible to increase the width of the conductive tracks, so that it is possible to reduce the direct-current resistance of the coil.

Furthermore, because it is possible to increase the number of turns of a coil without changing the planar shape of the coil, it is possible to facilitate formation of a small-size coil substrate having high inductance.

Furthermore, because a conductive track formed in one structure (one layer) may be less than or equal to one turn of a coil, it is possible to increase the width of the conductive track formed in one structure (one layer). That is, it is possible to increase the cross-sectional area of the conductive track in the width direction, so that it is possible to reduce coil resistance directly linked to the inductor performance.

Furthermore, while a flexible insulating resin film (for example, a polyphenylenesulfide film) is used as the substrate 10–n during the process of manufacturing the coil substrate 1, the substrate 10–n is ultimately delaminated and does not remain in a finished product. Accordingly, it is possible to reduce the thickness of the coil substrate 1.

Furthermore, by using a flexible insulating resin film (for example, a polyphenylenesulfide film) in a reeled state (in the form of tape) as the substrate 10–n , it is possible to manufacture the coil substrate 1 reel-to-reel on the substrate 10–n . As a result, it is possible to achieve reduction in the cost of the coil substrate 1 due to mass production.

Next, a variation of the embodiment is described. According to the variation of the embodiment, the external electrodes of the inductor are different in structure from those in the embodiment. In the following description of the variation of the embodiment, a description of the same elements as those of the above-described embodiment may be omitted.

Figure 23A:
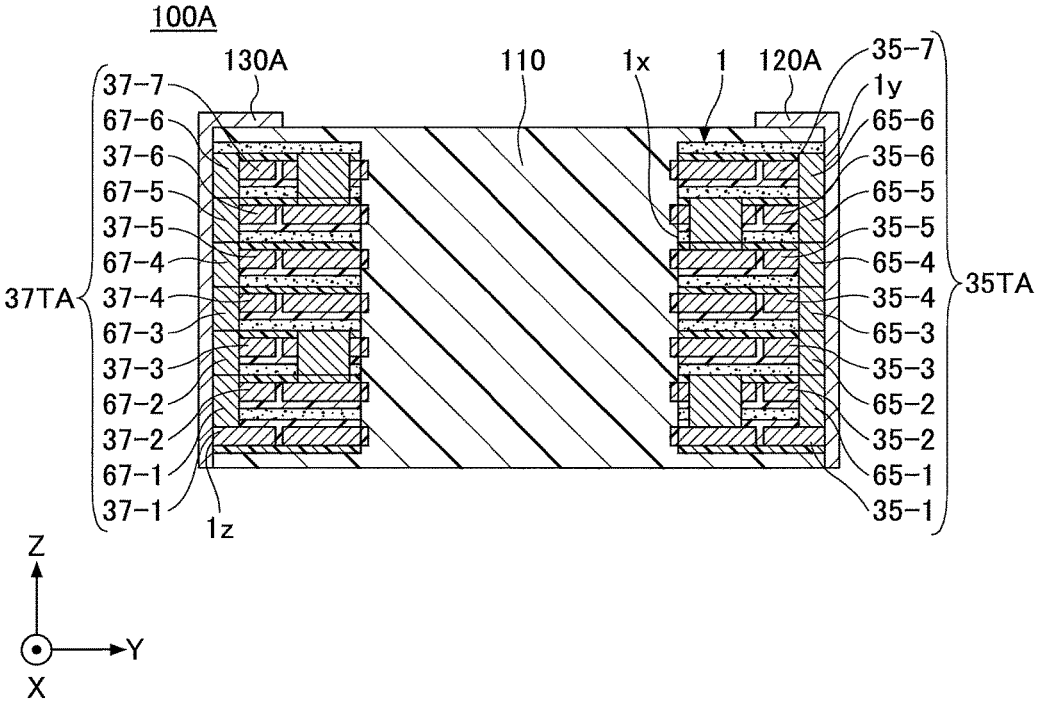
FIGS. 23A and 23B are diagrams depicting an inductor according to a variation of the embodiment.
Figure 23B:
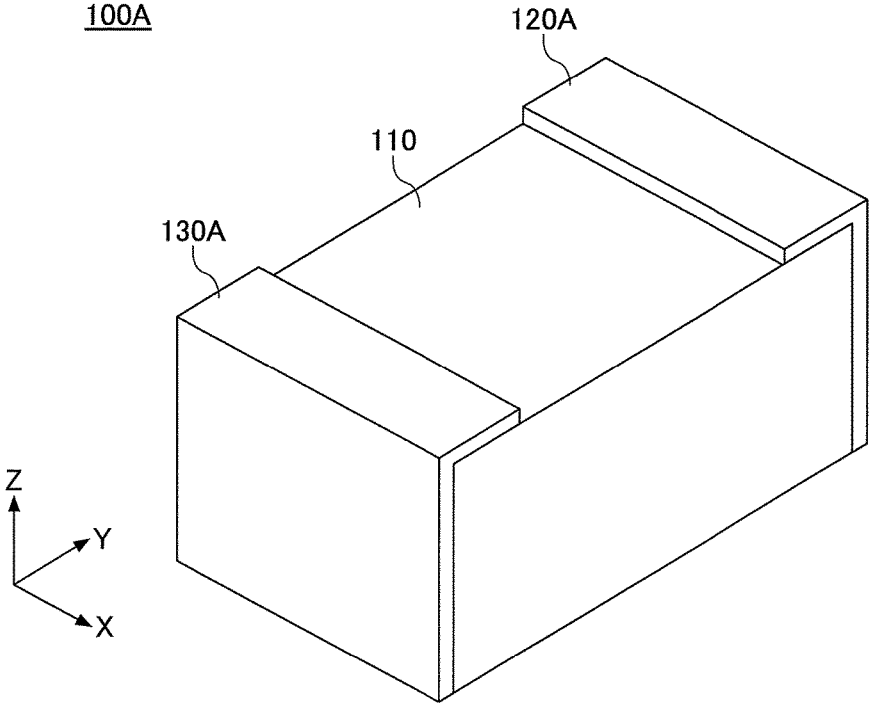

FIGS. 23A and 23B are diagrams depicting an inductor according to the variation of the embodiment. FIG. 23A is a cross-sectional view of the inductor. FIG. 23B is a perspective view of the inductor. According to the inductor 100 (see FIGS. 3A and 3B) of the embodiment, the first external electrode 120 is formed as a monolithic structure that extends over the five surfaces of the encapsulation material 110 including the first side surface of the encapsulation material 110 at which the first electrode terminal 35TA is exposed at the first end of the exterior of the encapsulation material 110. Furthermore, the second external electrode 130 is formed as a monolithic structure that extends over the five surfaces of the encapsulation material 110 including the second side surface of the encapsulation material 110 at which the second electrode terminal 37TA is exposed at the second end of the exterior of the encapsulation material 110.

Meanwhile, according to an inductor 100A of the variation of the embodiment, a first external electrode 120A is formed on the side surface of the first electrode terminal 35TA, and extends continuously from the side surface of the first electrode terminal 35TA to be formed on only one surface (the upper surface in FIGS. 23A and 23B) of the four peripheral surfaces of the encapsulation material 110 at its first end. That is, the first external electrode 120A is formed to cap the first end of the exterior of the encapsulation material 110, covering two surfaces of the encapsulation material 110 including the first side surface of the encapsulation material 110 at which the first electrode terminal 35TA is exposed.

Furthermore, a second external electrode 130A is formed on the side surface of the second electrode terminal 37TA, and extends continuously from the side surface of the second electrode terminal 37TA to be formed on only one surface (the upper surface in FIGS. 23A and 23B) of the four peripheral surfaces of the encapsulation material 110 at its second end. That is, the second external electrode 130A is formed to cap the second end of the exterior of the encapsulation material 110, covering two surfaces of the encapsulation material 110 including the second side surface of the encapsulation material 110 at which the second electrode terminal 37TA is exposed.

In general, when mounting an inductor on a board by reflow soldering using a lead-free Sn—Ag solder alloy, the inductor may rise against a gravitational force when subjected to heating because of a difference in surface tension between solder adhering to one external electrode and solder adhering to the other external electrode, depending on the external electrode structure (a so-called Manhattan phenomenon).

According to the inductor 100A, the first external electrode 120A and the second external electrode 130A are formed on only two surfaces of the encapsulation material 110. Accordingly, when mounting the inductor 100A on a board, solder adheres to the first external electrode 120A and the second external electrode 130A with a proper balance. As a result, it is possible to reduce the difference in surface tension between the solder at the first external electrode 120A and the solder at the second external electrode 130A, so that it is possible to prevent the inductor 100A from rising against a gravitational force. According to the inductor 100A, the upper surface in FIGS. 23A and 23B faces toward the board.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that various changes, substitutions, and alterations could be made hereto without departing from the spirit and scope of the invention.

For example, while the first through seventh structures 1A through 1G are sequentially stacked on the substrate 10-1 according to the above-described embodiment, the first through seventh structures 1A through 1G do not have to be stacked on the substrate 10-1. For example, the substrate 10-1 may be removed in the process depicted in FIGS. 5A and 5B, and the second structure 1B may be stacked on the first structure 1A without the substrate 10-1 in the process depicted in FIG. 7A.

Furthermore, the number of turns of a conductive track formed in one structure (single layer) and the number of turns of a conductive track formed in another structure may be combined as desired. A conductive track of approximately one turn and a conductive track of approximately ¾ turns may be combined as in the above-described embodiment. Alternatively, a conductive track of approximately one turn and a conductive track of approximately ½ turns may be combined. When using a conductive track of approximately ¾ turns, four patterns of conductive tracks (the second conductive track 30-2, the third conductive track 30-3, the fourth conductive track 30-4, and the fifth conductive track 30-5 in the above-described case) are required. Meanwhile, when using a conductive track of approximately ½ turns, only two patterns of conductive tracks are required.

Furthermore, the first through seventh structures 1A through 1G may be bonded and stacked using the insulating layers 40-2 through 40-7. In this case, the inter-structure adhesive layers 50-1 through 50-6 may be omitted. In this case, the first through seventh structures 1A through 1G may be stacked with the resin of the insulating layers 40-2 through 40-7 being kept adhesive in a semi-cured state. For example, the insulating layer 40-2 of the second structure 1B may be kept in a semi-cured state in the state depicted in FIGS. 6A and 6B, and may be directly bonded to and stacked on the first structure 1A in the process depicted in FIG. 7A.

What is claimed is:

1. A method of manufacturing an inductor including a coil substrate, the coil substrate including a helical coil and first and second electrode terminals connected to a first end and a second end, respectively, of the helical coil, the method comprising:

forming a plurality of structures each including a metal layer and a first connection part and a second connection part on opposite sides of the metal layer, the metal layer and the first and second connection parts being in a single layer;

forming a laminate by sequentially stacking the structures, wherein said forming the laminate includes connecting the metal layers of the structures in series;

connecting the first connection parts of the structures by a first via to form the first electrode terminal; and connecting the second connection parts of the structures by a second via to form the second electrode terminal; and forming the helical coil by simultaneously processing the metal layers connected in series so that each of the metal layers has a shape of a part of the helical coil.

2. The method as claimed in claim 1, further comprising:

covering the laminate with an encapsulation material containing a magnetic material after forming the helical coil.

3. The method as claimed in claim 2, further comprising:

cutting the laminate covered with the encapsulation material at predetermined positions, wherein in cutting the laminate, the first connection parts and the first via are cut in a stacking direction of the structures so that cut surfaces of the first connection parts and the first via are exposed at a first end surface of the laminate, and the second connection parts and the second via are cut in the stacking direction of the structures so that cut surfaces of the second connection parts and the second via are exposed at a second end surface of the laminate opposite to the first end surface.

4. The method as claimed in claim 2, wherein said simultaneously processing the metal layers fauns a through hole penetrating through the laminate, and said covering the laminate includes filling the through hole with the encapsulation material.

* * * * *